US010626674B2

(12) United States Patent
Spatz et al.

(10) Patent No.: US 10,626,674 B2
(45) Date of Patent: Apr. 21, 2020

(54) DRILLING APPARATUS WITH EXTENSIBLE PAD

(71) Applicant: XR LATERAL LLC, Houston, TX (US)

(72) Inventors: Edward Spatz, Houston, TX (US); Michael Reese, Houston, TX (US); James Dudley, Houston, TX (US)

(73) Assignee: XR LATERAL LLC, Houston, TX (US)

( * ) Notice: Subject to any disclaimer, the term of this patent is extended or adjusted under 35 U.S.C. 154(b) by 0 days.

(21) Appl. No.: 15/430,254

(22) Filed: Feb. 10, 2017

(65) Prior Publication Data

US 2017/0234071 A1 Aug. 17, 2017

Related U.S. Application Data

(60) Provisional application No. 62/295,904, filed on Feb. 16, 2016.

(51) Int. Cl.
*E21B 7/06* (2006.01)
*E21B 7/28* (2006.01)
(Continued)

(52) U.S. Cl.
CPC ..... *E21B 7/06* (2013.01); *E21B 7/064* (2013.01); *E21B 7/067* (2013.01); *E21B 7/068* (2013.01);
(Continued)

(58) Field of Classification Search
CPC combination set(s) only.
See application file for complete search history.

(56) References Cited

U.S. PATENT DOCUMENTS 356,154 A 1/1887 William et al.
1,638,337 A 8/1927 Hutton et al.
(Continued)

FOREIGN PATENT DOCUMENTS

CA 2291922 A1 6/2000
EP 530045 B1 4/1997

OTHER PUBLICATIONS

International Search Report and the Written Opinion of the International Searching Authority, or the Declaration, issued by International Searching Authority, for PCT/US2017/017515 dated Apr. 28, 2017. 8 pages.
International Search Report and Written Opinion in PCT Application No. PCT/US2017/066707, dated Apr. 6, 2018, 13 pages.
(Continued)

*Primary Examiner* — Robert E Fuller
*Assistant Examiner* — Theodore N Yao
(74) *Attorney, Agent, or Firm* — Perkins Coie LLP

(57) ABSTRACT

A drilling machine for a wellbore is provided. The drilling machine may include a dynamic lateral pad that is movable between an extended and retracted position. In the extended position, the pad moves the drill bit in a direction for drilling. The drilling machine may include a dynamic lateral cutter that is movable between an extended and retracted position. In at least the extended position, the cutter engages the wellbore and removes formation. The drilling machine may include a monolithic or integral drill bit/drive shaft to reduce the distance between a positive displacement motor and a distal end of the monolithic or integral drill bit/drive shaft. The drilling machine may include separate cutting structures that have different rotational speeds and can further utilize the integral drill bit/drift shaft and/or a bent housing that generates an off-axis rotation which helps optimize the formation removal in the center area of the wellbore.

19 Claims, 34 Drawing Sheets

Figure 1:
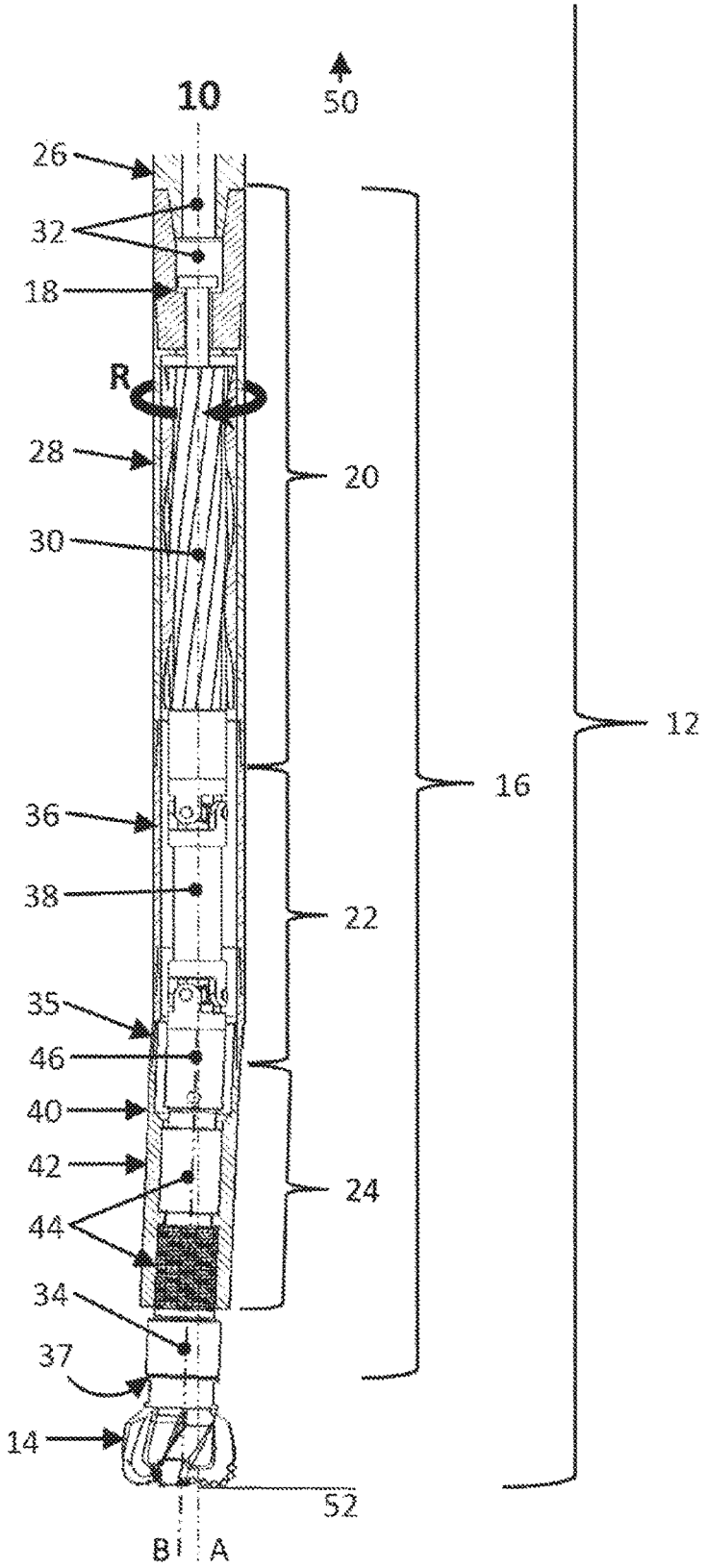

(51) Int. Cl.

| | |
|---|---|
| ***E21B 10/26*** | (2006.01) |
| ***E21B 10/32*** | (2006.01) |
| ***E21B 10/62*** | (2006.01) |
| ***E21B 10/42*** | (2006.01) |
| ***E21B 17/10*** | (2006.01) |
| ***E21B 10/567*** | (2006.01) |

(52) U.S. Cl.

CPC ..... *E21B 7/28* (2013.01); *E21B 10/26* (2013.01); *E21B 10/32* (2013.01); *E21B 10/42* (2013.01); *E21B 10/567* (2013.01); *E21B 10/62* (2013.01); *E21B 17/1092* (2013.01)

(56) References Cited

U.S. PATENT DOCUMENTS 1,667,155 A 4/1928 Higdon et al.
2,919,897 A 1/1960 Sims et al.
3,061,025 A 10/1962 Stockard, Jr. et al.
3,159,224 A 12/1964 Cleary et al.
3,224,513 A 12/1965 Weeden, Jr. et al.
3,561,549 A 2/1971 Garrison et al.
3,880,246 A 4/1975 Farris
3,882,946 A 5/1975 Ioannesian
4,156,374 A 5/1979 Shwayder
4,270,619 A 6/1981 Base et al.
4,373,592 A 2/1983 Dellinger et al.
4,385,669 A 5/1983 Knutsen et al.
4,407,377 A 10/1983 Russell
4,456,080 A 6/1984 Holbert et al.
4,465,147 A 8/1984 Feenstra et al.
4,485,879 A 12/1984 Kamp et al.
4,491,187 A 1/1985 Russell
4,492,276 A 1/1985 Kamp et al.
4,523,652 A 6/1985 Schuh et al.
4,577,701 A 3/1986 Dellinger et al.
4,618,010 A 10/1986 Falgout et al.
4,667,751 A 5/1987 Geczy et al.
4,690,229 A 9/1987 Raney et al.
4,697,651 A 10/1987 Dellinger
4,715,453 A 12/1987 Falgout et al.
4,729,438 A 3/1988 Walker et al.
4,775,017 A 10/1988 Forrest et al.
4,842,083 A 6/1989 Raney et al.
4,848,490 A 7/1989 Anderson et al.
4,862,974 A 9/1989 Warren et al.
4,877,092 A 10/1989 Helm et al.
5,010,789 A 4/1991 Brett et al.
5,042,596 A 8/1991 Brett et al.
5,099,929 A 3/1992 Keith et al.
5,115,872 A 5/1992 Brunet et al.
5,139,094 A 8/1992 Prevedel et al.
5,159,577 A 10/1992 Twist et al.
5,181,576 A * 1/1993 Askew ..... E21B 17/1014 175/61
5,320,179 A 6/1994 Roos et al.
5,333,699 A 8/1994 Thigpen et al.
5,361,859 A 11/1994 Tibbitts et al.
5,458,208 A 10/1995 Clarke
5,673,763 A 10/1997 Thorp
5,812,068 A 9/1998 Hubner et al.
5,857,531 A 1/1999 Estep et al.
5,904,213 A 5/1999 Caraway et al.
5,931,239 A 8/1999 Schuh
5,937,958 A 8/1999 Mensa-Wilmot et al.
5,957,223 A 9/1999 Doster et al.
5,967,246 A 10/1999 Caraway et al.
5,971,085 A 10/1999 Colebrook et al.
5,979,570 A 11/1999 McLoughlin et al.
5,992,547 A 11/1999 Caraway et al.
6,073,707 A 6/2000 Noe et al.
6,092,613 A 7/2000 Caraway et al.
6,109,372 A 8/2000 Dorel et al.
6,116,356 A 9/2000 Doster et al.
6,158,533 A 12/2000 Gillis et al.
6,186,251 B1 2/2001 Butcher et al.
6,213,226 B1 4/2001 Eppink et al.
6,257,356 B1 7/2001 Wassell et al.
6,349,780 B1 2/2002 Beuershausen et al.
6,427,792 B1 8/2002 Roberts et al.
6,523,623 B1 2/2003 Schuh et al.
6,722,453 B1 4/2004 Crooks et al.
6,742,605 B2 6/2004 Martini et al.
6,991,046 B2 1/2006 Fielder et al.
7,207,398 B2 4/2007 Runia et al.
7,562,725 B1 7/2009 Broussard et al.
7,831,419 B2 11/2010 Cariveau et al.
8,061,453 B2 11/2011 Cariveau et al.
8,162,081 B2 4/2012 Ballard et al.
8,201,642 B2 6/2012 Radford et al.
8,210,283 B1 7/2012 Benson et al.
8,240,399 B2 8/2012 Kulkarni et al.
8,316,968 B2 11/2012 Ferrari et al.
8,448,721 B2 5/2013 Johnson et al.
8,448,722 B2 5/2013 Konschuh et al.
8,550,190 B2 10/2013 Hall et al.
8,757,298 B2 6/2014 Broussard et al.
8,763,726 B2 7/2014 Johnson et al.
D710,174 S 8/2014 Moss
D710,175 S 8/2014 Moss et al.
D710,176 S 8/2014 Santamarina
D713,706 S 9/2014 Jing et al.
D717,626 S 11/2014 Dickrede
8,905,159 B2 12/2014 Downton
9,016,400 B2 4/2015 Clausen et al.
D731,277 S 6/2015 Manwaring et al.
D732,364 S 6/2015 Rinaldis et al.
9,163,460 B2 10/2015 Meier et al.
9,556,683 B2 1/2017 Simmons et al.
9,605,482 B2 3/2017 Lange et al.
D786,645 S 5/2017 Svendsen et al.
D793,831 S 8/2017 Russell et al.
D793,832 S 8/2017 Russell et al.
D793,833 S 8/2017 Russell et al.
D813,003 S 3/2018 Chang
9,963,938 B2 5/2018 Foote et al.
2002/0070021 A1 6/2002 Van et al.
2002/0175006 A1* 11/2002 Findley ..... B22F 7/06 175/425
2003/0010534 A1 1/2003 Chen et al.
2003/0024742 A1 2/2003 Swietlik et al.
2004/0216921 A1 11/2004 Krueger et al.
2005/0096847 A1 5/2005 Huang
2005/0150692 A1 7/2005 Ballantyne et al.
2005/0236187 A1 10/2005 Chen et al.
2006/0196697 A1 9/2006 Raney et al.
2007/0007000 A1 1/2007 Dewey et al.
2007/0163810 A1 7/2007 Underwood et al.
2007/0205024 A1 9/2007 Mensa-Wilmot et al.
2007/0235227 A1 10/2007 Kirkhope et al.
2007/0272445 A1 11/2007 Cariveau et al.
2008/0000693 A1 1/2008 Hutton et al.
2008/0047754 A1 2/2008 Evans et al.
2008/0075618 A1 3/2008 Martin et al.
2008/0115974 A1 5/2008 Johnson et al.
2008/0190665 A1 8/2008 Earles et al.
2008/0271923 A1 11/2008 Kusko et al.
2009/0000823 A1 1/2009 Pirovolou
2009/0044980 A1 2/2009 Sheppard et al.
2009/0044981 A1 2/2009 Sheppard et al.
2009/0065262 A1 3/2009 Downton et al.
2009/0107722 A1 4/2009 Chen et al.
2009/0188720 A1* 7/2009 Johnson ..... E21B 7/06 175/61
2010/0006341 A1 1/2010 Downton
2010/0307837 A1 12/2010 King et al.
2011/0031025 A1* 2/2011 Kulkarni ..... E21B 7/064 175/76
2011/0247816 A1 10/2011 Carter
2012/0055713 A1 3/2012 Herberg et al.
2012/0234610 A1 9/2012 Azar et al.
2013/0180782 A1 7/2013 Ersan et al.

(56) References Cited

U.S. PATENT DOCUMENTS

| | | | | |
|---|---|---|---|---|
| 2014/0097026 | A1 | 4/2014 | Clark et al. | |
| 2014/0110178 | A1 | 4/2014 | Savage et al. | |
| 2014/0246209 | A1 | 9/2014 | Themig et al. | |
| 2014/0246234 | A1 | 9/2014 | Gillis et al. | |
| 2014/0311801 | A1 | 10/2014 | Jain et al. | |
| 2014/0379133 | A1 | 12/2014 | Toma | |
| 2015/0122551 | A1 | 5/2015 | Chen | |
| 2015/0152723 | A1* | 6/2015 | Hay | E21B 47/01 175/17 |
| 2016/0024846 | A1 | 1/2016 | Parkin | |
| 2016/0024848 | A1 | 1/2016 | Desmette et al. | |
| 2016/0115779 | A1 | 4/2016 | Moss et al. | |
| 2016/0265287 | A1 | 9/2016 | Newman et al. | |
| 2016/0326863 | A1 | 11/2016 | Lange et al. | |
| 2017/0130533 | A1 | 5/2017 | Ling | |
| 2017/0234071 | A1 | 8/2017 | Spatz et al. | |
| 2018/0073301 | A1 | 3/2018 | Russell et al. | |
| 2019/0055810 | A1 | 2/2019 | Fripp et al. | |

OTHER PUBLICATIONS

International Search Report and Written Opinion in PCT Application No. PCT/US18/41316, dated Sep. 25, 2018, 14 pages.

International Search Report and Written Opinion in PCT Patent Application No. PCT/US2017/066745, dated Feb. 15, 2018, 9 pages.

"Direction deviation tools", PetroWiki, downloaded Nov. 13, 2017 from http://petrowiki.org/Directional_deviation_tools, 5 pages.

"Rotary Steerable Motor for Directional Drilling", APS Technology, downloaded Nov. 13, 2017 from http://www.aps-tech.com/products/drilling-systems/rotary-steerable-motor, 4 pages.

Felczak , et al., "The Best of Both Worlds—A Hybrid Rotary Steerable System", Oilfield Review; vol. 23, No. 4, Winter 2011, pp. 36-44.

Warren , et al., "Casing Directional Drilling", AADE-05-NTCE-48; American Association of Drilling Engineers (AADE) 2005 National Technical Conference and Exhibition, Houston, Texas, Apr. 5-7, 2005, pp. 1-10.

* cited by examiner

DRILLING APPARATUS WITH EXTENSIBLE PAD

CROSS-REFERENCE TO RELATED APPLICATIONS

The present application claims priority to U.S. Provisional Patent Application No. 62/295,904, filed Feb. 16, 2016, the disclosure of which is incorporated herein by reference as if set out in full.

BACKGROUND

Hydrocarbon retorts for the most part reside beneath a surface layer of dirt and rock (and sometimes water as well). Thus, companies generally erect drilling rigs and drill piping from the surface to a point located below the surface to allow access and retrieval of the hydrocarbons from the retorts.

Drilling may comprise vertical wells, non-vertical wells, and combinations thereof. Vertical wells provide a reasonably straight drill path that is generally intended to be perpendicular to the earth's surface, and the drill bit is operational along the axis of the drill string to which it is attached. Non-vertical wells, also known as directional wells, usually involve directional drilling. Directionally drilling a well requires movement of the drill bit off the axis of the drill string. Generally, a directionally drilled wellbore includes a vertical section until a kickoff point where the wellbore deviates from vertical.

To directional drill, most operations use a motor steerable system or rotary steerable tool (sometimes referred to as RST or RSS). Both tools are useful because they allow for directional drilling (moving from vertical to horizontal in some cases), but also provide for a tool that generally travels in a straight path as well. A conventional RSS can generally be classified as a point the bit architecture or a push the bit architecture. A point the bit architecture generally flexes the shaft attached to the bit, to cause the bit to point in a different direction. The GEO-PILOT® rotary steerable system available from Halliburton Company is an exemplary point the bit architecture. A push the bit architecture generally has one or more pads on the outer surface of the rotating drill string housing. The pads press on the wellbore to cause the drill bit to move in the opposite direction causing a directional change in the wellbore. The AutoTrak Curve rotary steerable system, available from Baker Hughes Incorporated, is an exemplary push the bit architecture. Many companies offer steerable motors that incorporate a bent housing within its architecture that must be oriented in the desired position to generate the required directional change. The drill string that connects this assembly and bit to the rig floor must remain essentially stationary during the drilling of these directional change segments. Various RSS tool offerings have no non-rotational requirements or segments that need to be stationary while other RSS designs incorporate certain sections of the tool that must remain stationary or only rotate at a very slow speed.

FIG. 1, for background, shows a conventional steerable motor system 10 that is part of drill string 12 that extends from the surface, at the most proximal end 50, and terminates in drill bit 14 at distal end 52. Conventionally, as drill string 12 rotates as shown by arrow R and mud flow through steerable motor 16 adds rotation to bit 14, the steerable motor system drills in a generally straight line. The drilling path may be vertical or angled (generally between 0 to 90 degrees, but in some instances, up to 180 degrees with respect to vertical) depending on the drill plan. Once drill string 12 has deviated from vertical, a well bore direction is established and is typically measured, like a compass, as a magnetic heading or azimuth (ranging from 0 to 360 degrees). When steerable motor system 10 is being manipulated to directionally drill (by which directional or directionally drilling generally means modifying the angle of inclination and/or azimuth of the hole), where the rate of change is typically measured in degrees over a distance (generally degrees per 100 feet or degrees per 30 meters), rotation of drill string 12 from the surface is normally halted to facilitate directional change. As is well known in the art, one drawback of a conventional steerable system 10, is that cessation of rotation may cause friction to turn from dynamic to static resulting in an undesirable increase in friction between drill string 12, including steerable motor 16, and the wellbore (not shown).

In any event, drill string 12 includes a number of segments, not all of which are shown in FIG. 1, including drill piping or tubulars 26 to the surface, steerable motor 16 and drill bit 14. Steerable motor 16 generally comprises rotor catch assembly 18, power section 20, transmission 22, bearing package 24, and bit drive shaft 46 with bit box 34. Power section 20 generally comprises stator housing 28 connected to and part of drill string 12, and rotor 30. Transmission 22 includes transmission housing 36, that is part of drill string 12, and transmission driveline 38 that connects rotor 30 to bit drive shaft 46. Bearing package 24 includes bearing housing 42, part of the drill string, and one or more bearing assemblies 44 that may include different combinations of axial, radial, and thrust bearings. Transmission housing 36 generally includes bend 35 to modify drill bit 14 angular rotation axis B relative to drill string 12 rotation axis A, generally a bend is from around 0.5 to 5.0 degrees. (The modification of the angular axis of rotation is more thoroughly described below and is well-documented art.) Because the magnitude of bend 35 can be visually relatively small, the direction of the bend plane is generally marked by a shallow longitudinal groove called scribe line 40.

With mud flow, drilling mud (not shown) travels down internal cavities 32 of drill string 12 and through power section 20 causing rotor 30 to rotate with respect to stator housing 28 and therefore drill string 12. Rotor 30 drives rotation through transmission driveline 38 and bit drive shaft 46, to drill bit 14. Depending on the rotation direction (clockwise or counter clockwise) of rotor 30 relative to drill string 12, power section 20 can increase, decrease or reverse the relative rotation rate of drill bit 14 with respect to a rotating drill string 12. During drilling operations with a conventional steerable motor assembly 10, when it is determined to be desirable to modify the trajectory (angle of inclination and azimuth) of the wellbore, rotation of drill string 12 is terminated while maintaining mud flow through motor power section 20 and therefore continuing rotation of drill bit 14. By one of many methods that are well known and regularly practiced in the industry (such as MWD tools, LWD tools, drilling gyro tool and wireline orienting tool), the current orientation of drill bit 14 is determined. Drill string 12 is then manually oriented from the surface, generally by fractions of a full rotation, until scribe line 40 (and therefore bit 14) is oriented in the desired direction. Thus, the wellbore direction is altered in the direction of the scribe line 40 by the continued rotation of the drill bit 14 via the steerable motor 16 while the drill string 12 is not rotating. As the well continues to be drilled, the orientation of the scribe line 40 is continually monitored and adjusted to create the desired wellbore path. The adjustment of the scribe line 40 conventionally includes manual orientation of the drill string to keep the scribe line 40 oriented in the desired direction. The details of conventional steerable motor system 10 are reasonably well known in the industry and will not be further explained except as necessary to understand the technology of the present application.

Drill bit 14 conventionally can be a number of different styles or types of drill bits. Drill bit 14 may be a polycrystalline diamond cutter (PDC) design, a roller cone (RC) design, an impregnated diamond design, a natural diamond cutter (NDC) design, a thermally stable polycrystalline (TSP) design, a carbide blade/pick design, a hammer bit (a.k.a. percussion bits) design, etc. Each of these different rock destruction mechanisms has qualities that make it a desirable choice depending on formation to be drilled and available energy in association with the drilling apparatus.

For a variety of disparate reasons, drill bit technology integrated within a drilling apparatus or drilling machine methodology could use much improvement, whether implemented in a vertical drilling system or incorporated into a Steerable Motor or RSS usable with directional drilling. Thus, against the above background, improved drill bits separately or as part of an integrated drilling apparatus or machine coordinated with drill string components, are further described herein.

SUMMARY

This Summary is provided to introduce a selection of concepts in a simplified form that are further described below in the Detailed Description. This Summary, and the foregoing Background, is not intended to identify all key aspects or essential aspects of the claimed subject matter. Moreover, this Summary is not intended for use as an aid in limiting the scope of the claimed subject matter.

In some aspects of the technology, a downhole drilling apparatus or machine is provided. The drilling apparatus or machine comprises a drill bit or cutting structure assembly having a pad that can extend generally perpendicularly to the bit axis by a variable amount from a minimum distance to a maximum distance where the minimum distance is flush or recessed with an axial sidewall of the drill bit or drill string. In the extended position, the pad has a surface that is configured to engage the sidewall of a wellbore. The drilling apparatus may include an actuator to move the pad between the extended position and the retracted position. In certain aspects, the actuator is a push rod or cam follower driven by a cam. The actuator can provide a solid/positive transfer of force or the actuator can provide compliant transfer of force to limit travel, force or both. In other aspects, the actuator is a cam. In still other aspects, the actuator can be magnets configured to attract or repel depending on proximity and magnetic pole orientation. The push rod may include a taper such that the pad is positionable at a plurality of positions between the maximum extension in the extended position and the minimum position in the retracted position. The drill bit or cutting structure assembly comprises a plurality of cutting elements. When extended, the pad is configured to push against the sidewall and move the drill bit and cutting elements in an opposing direction.

In certain embodiments, the drill bit may include at least one lateral cutting apparatus located on a side of the drilling apparatus. At least one lateral cutting apparatus would generally engage the sidewall of a wellbore and remove formation at least when the pad is in the extended position. As a result of the added force of the lateral pad or pads, the opposing cutting structure design could have a variable position design or an enhanced fixed cutter design to assist in the directional change capacity.

In certain aspects, the drilling apparatus comprises a plurality of pads, wherein each of the plurality of pads is operatively coupled to at least one actuator such that as the plurality of pads are configured to rotate with the drill bit or configured to rotate with the drill string that is generally not rotating while directionally drilling. The actuator may be configured to move each of the plurality of pads from the retracted position to the extended position wherein a maximum extension occurs at a position generally opposite a minimum extension.

In certain aspects, the pad begins moving from a retracted position to an maximum extended position and back to a retracted position as the pad rotates about a longitudinal axis of the drilling apparatus. The pad may begin extending and retracting at virtually any angle such as about 30, 45, 90, or 135 degrees and be fully retracted at a corresponding 330, 315, 270, 225 degrees of rotation providing generally symmetric operation. Of course, the pad may begin extension at less than 15 degrees of rotation and finish retracting at greater than 345 degrees of rotation. In certain other embodiments, aspects relating to such things as drilling system design and formation properties may be better optimized using asymmetric operation modes where the pad may be begin extending at say 135 degrees and not be fully retracted until 330 degrees of rotation. In certain embodiments, the pad may always be slightly extended. A further aspect provides for multiple full or partial extensions and retractions of a pad or a plurality of pads during each revolution to improve cutting effectiveness by providing multiple cutter engagements to the well bore. Another embodiment would be to extend a pad or pads off center of the cutter or cutters to modify the cutter contact angle with the well bore.

In other embodiments, a downhole drilling apparatus to be attached to a drill string is provided. The apparatus has a drill bit having at least one cutting element axially extending out to the sidewall and a drill bit having a plurality of cutting structures. A cutting pad is operatively coupled to a recess formed in the outer sidewall of the drill bit. A cutting element is coupled to an outwardly facing surface such that at least when in the extended position, the cutting element is configured to engage a sidewall of a wellbore to remove formation.

In certain embodiments, and generally applicable with any drilling apparatus or drilling machine methodology using moveable pads to contact the bore hole, the pad extension path can be axially rotated from perpendicular (by around 2 to 45 degrees) to push the drill string forward or better align the contact plane of the pad with the borehole wall to minimize pad pressure or both when extended. In certain aspects, the cam can include a conical profile such that an axially rotated extension pad can be engaged with a cam race that is parallel with the plane of the pad to contact the borehole wall. A further aspect provides a pad path that is cross-axially offset to provide a side force temporarily across an opposing cutter face.

In certain embodiments, the technology of the present application provides a drill string that includes a power section to provide rotative force and a transmission that is operatively coupled to the power section. A monolithic or integral drill bit/drive shaft consists of a drill bit portion at a distal end and a drive shaft portion at a proximal end, wherein the transmission is operatively coupled to the proximal end of the monolithic or integral drill bit/drive shaft to transmit rotative force from the power section to the drill bit portion. The drill string may further include a bearing section and possibly a bent housing section.

In some aspects of the technology, a downhole apparatus is provided that comprises at least a dual rotating cutting structure having various cutting element types positioned on an inner assembly element and on a separate outer cutting structure where the power source to rotate the two cutting structures can be independently derived. In almost all cases, the resultant rotation rate for each cutting structure would be different. In those cases, where PDC cutters are used to form both the internal and external cutting structures a lower rotation rate of the outer cutting structure can result in a matched or lower surface speed than the internal cutting structure. This can extend the life of the PDC cutter by reducing and better controlling heat generation in the outermost cutters. Additionally, having multiple PDC cutting structures rotating at different rotation rates allows for designing a better mechanical solution to fail (destroy rock) in distinct areas of the formation to be drilled.

In certain embodiments, a plurality of rotating cutting structures would be associated with a bent housing above said rotating cutting structures to support the efficient removal of the central area of the wellbore. In this configuration, the directional usefulness of the bent housing would not be available unless it only supported a rotating directional tendency of the assembly.

In certain other embodiments, the technology of the present invention provides a drill string that may include various sizes and shapes of mud motors to accommodate reduced power requirements. The drill string may further include a bearing section and transmission section sized accordingly to the reduced loads anticipated versus a standard single bit/motor combination.

These and other aspects of the present system and method will be apparent after consideration of the Detailed Description and Drawings herein.

DRAWINGS

Non-limiting and non-exhaustive embodiments of the present invention, including the preferred embodiment, are described with reference to the following figures, wherein like reference numerals refer to like parts throughout the various views unless otherwise specified.

FIG. 1 provides a cross-sectional view of a conventional steerable motor system.

Figure 2:
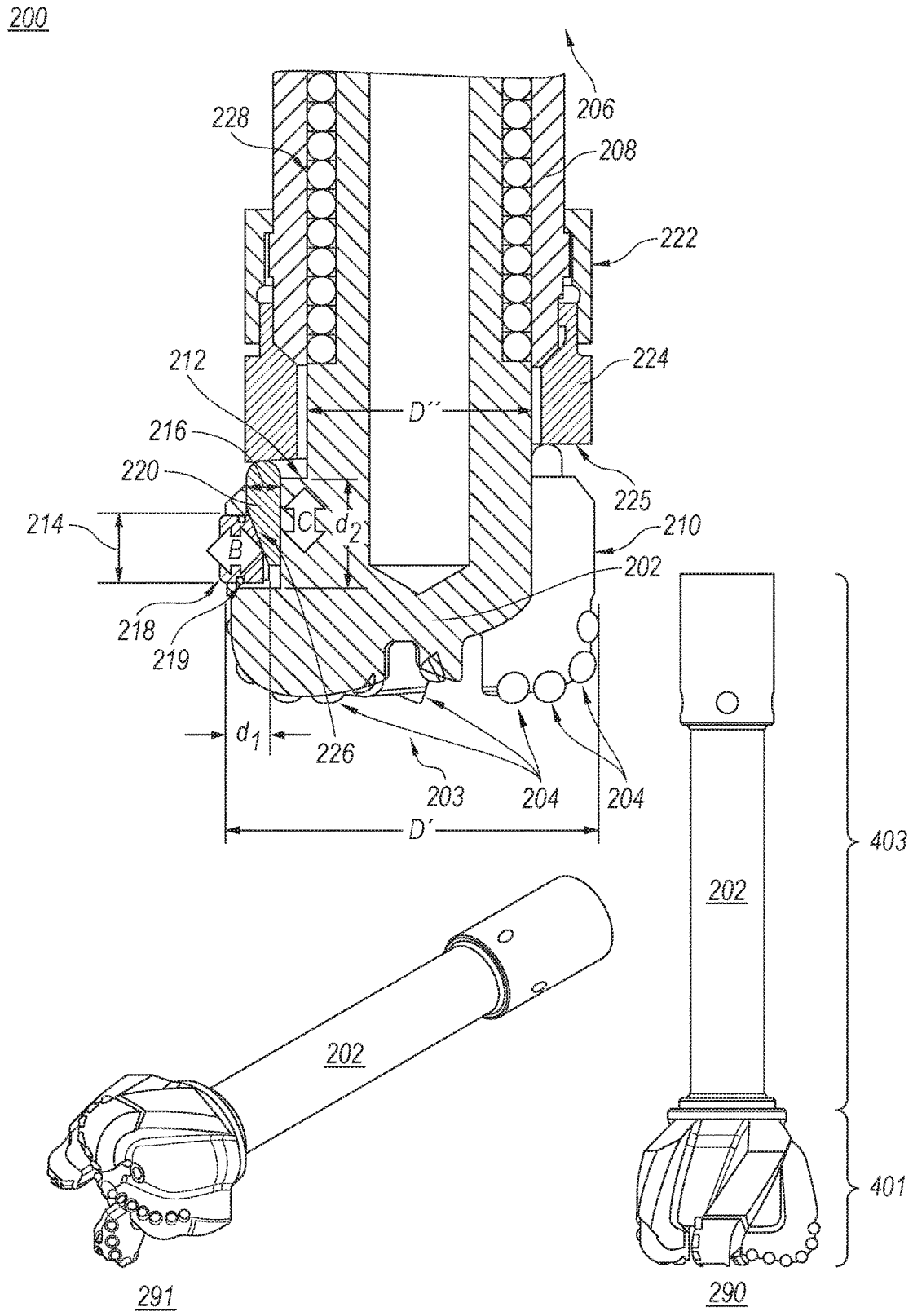

FIG. 2 provides a cross sectional view of a drilling assembly having a dynamic lateral pad consistent with the technology of the present application. FIG. 2 also includes a side view and isometric view of a monolithic or integral drill bit/drive shaft.

Figure 3A:
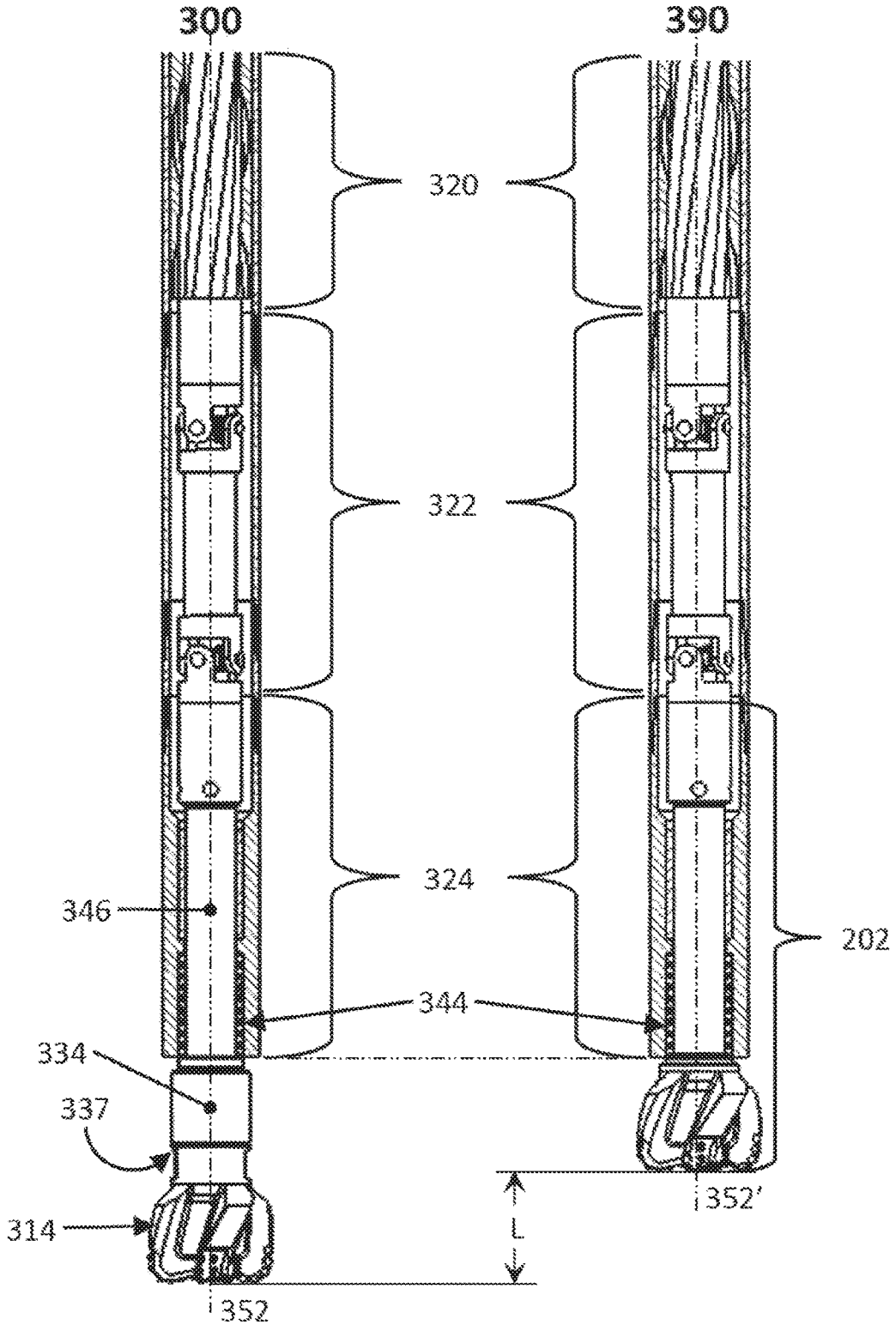

FIG. 3A provides a comparison between a conventional motor drill string and an improved motor drill string having a monolithic or integral bit/drive shaft consistent with the technology of the present invention.

Figure 3B:
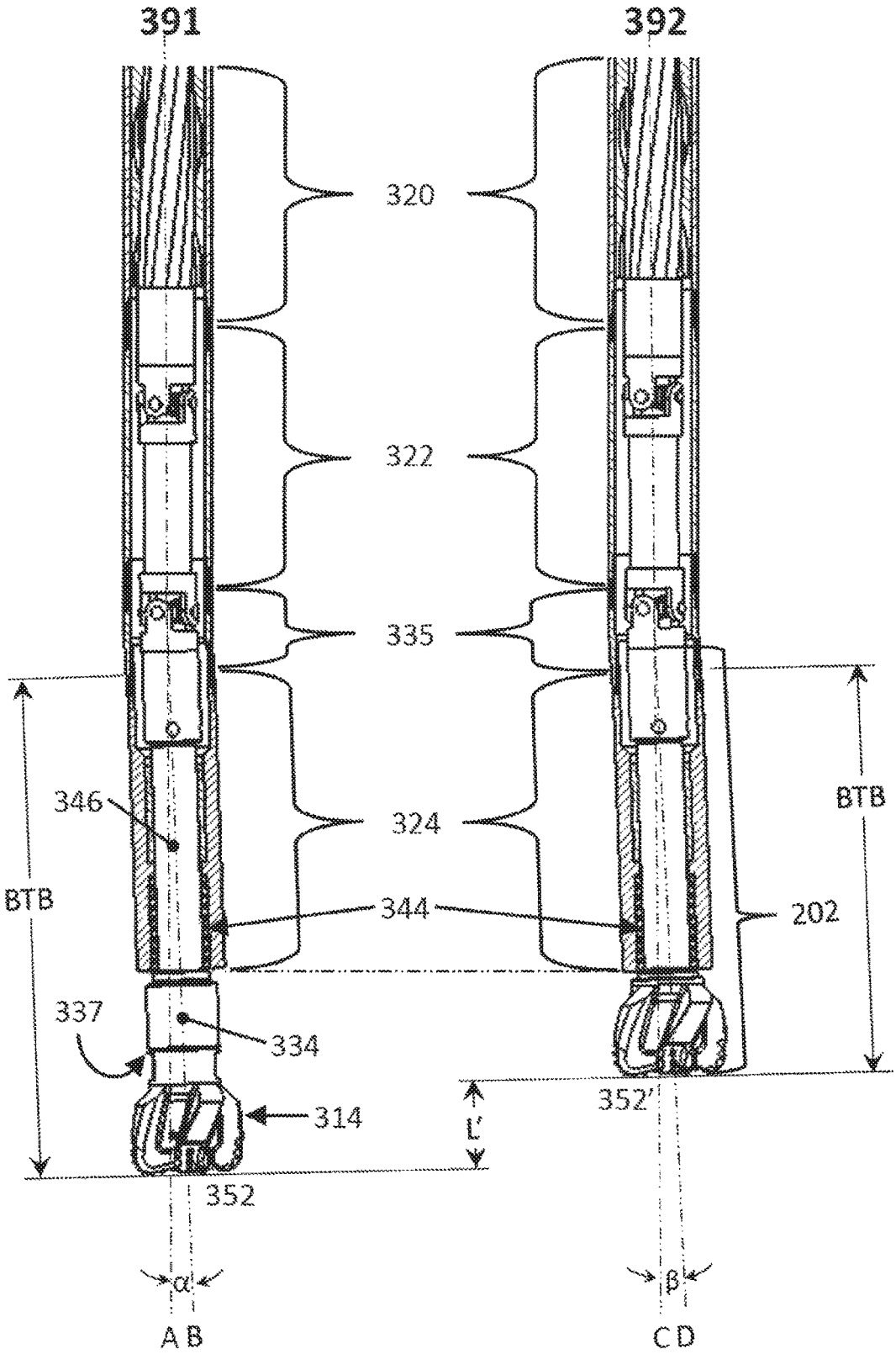

FIG. 3B provides a comparison between a conventional motor drill string with a bend and an improved motor drill string having a monolithic or integral drill bit/drive shaft and bend consistent with the technology of the present invention.

Figure 4A:
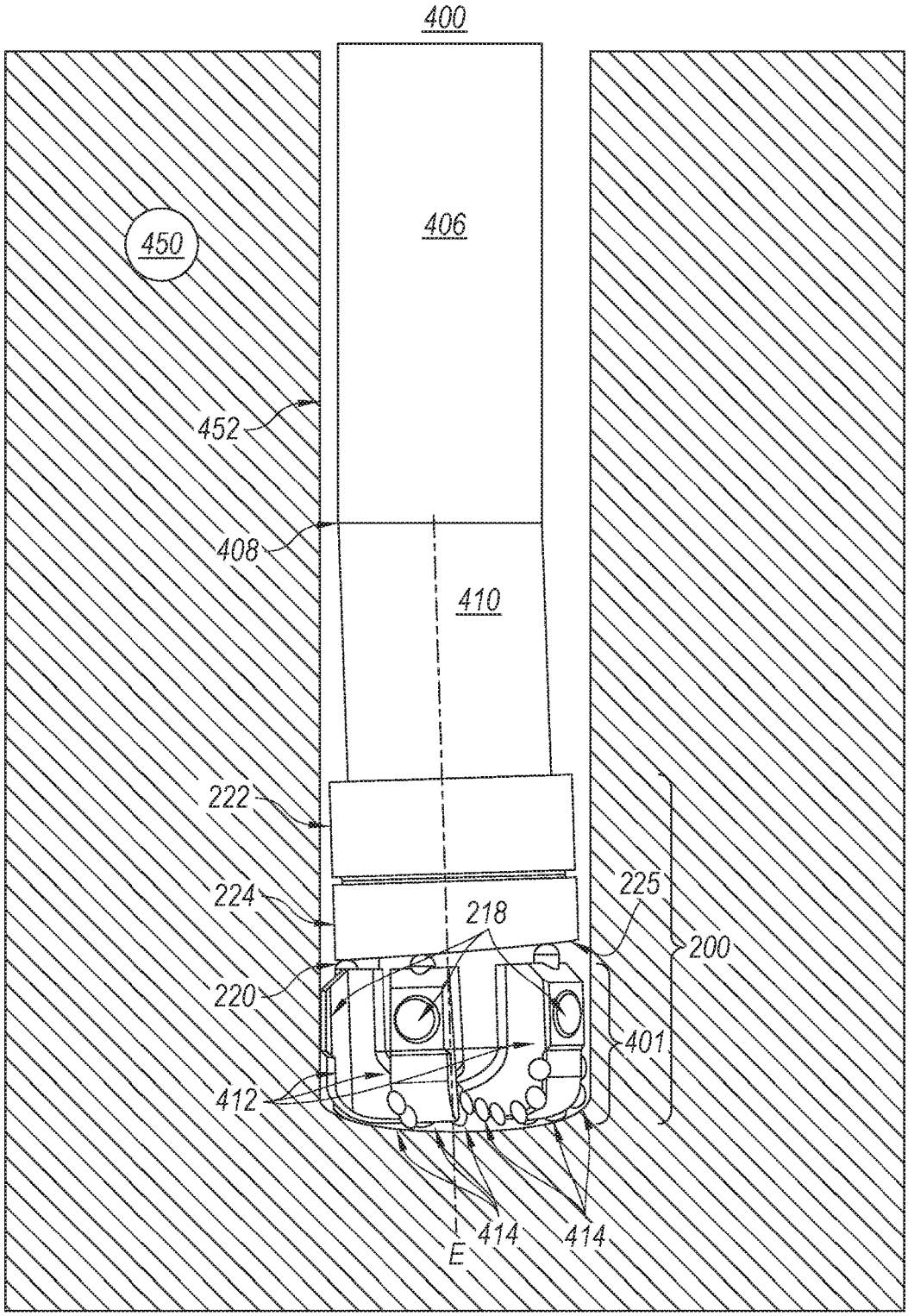

FIG. 4A provides a side view of a drill string with an axial cam and integral drill bit/drive shaft consistent with the technology of the present application.

Figure 4B:
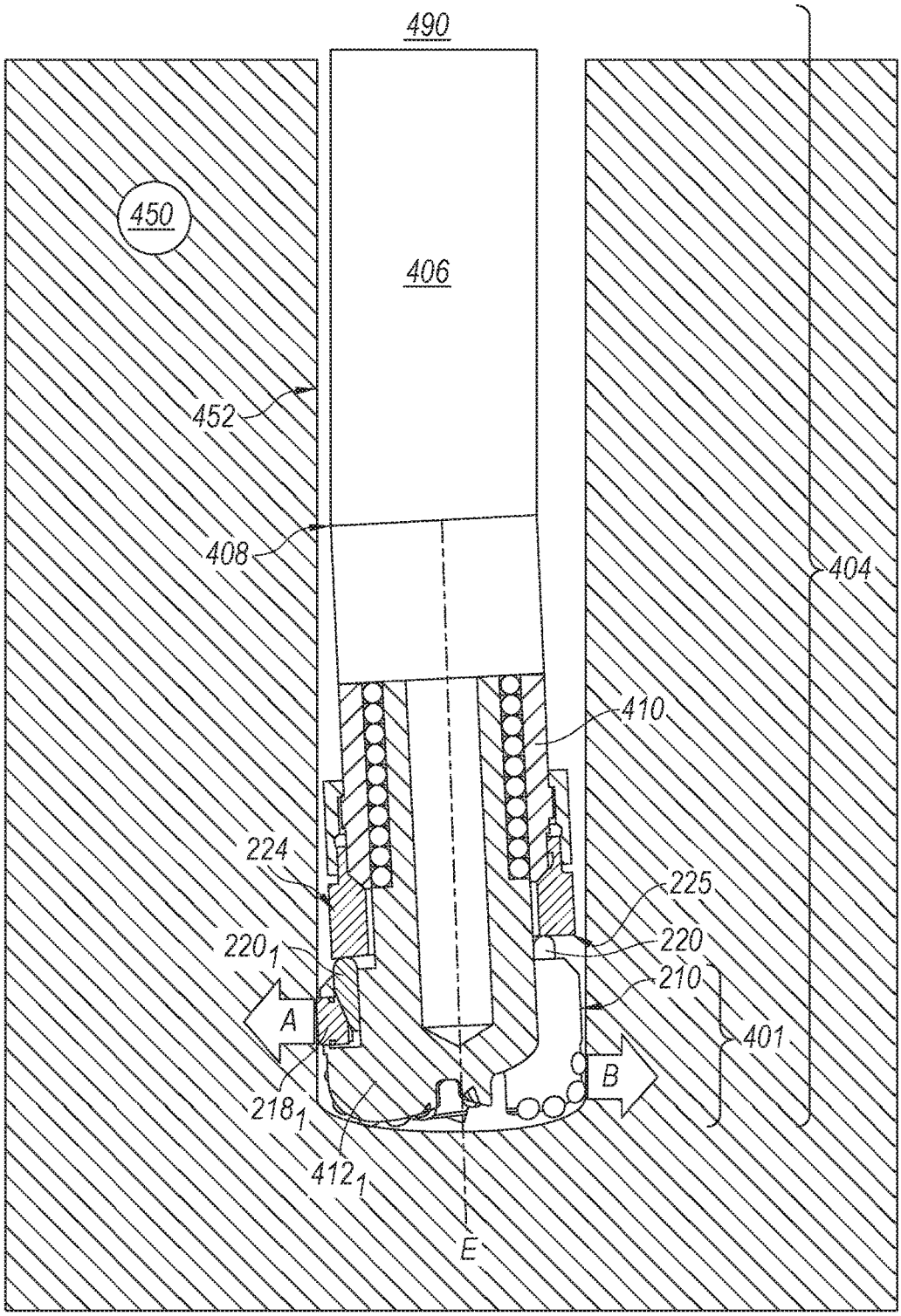

FIG. 4B provides a cross-section view of the drill string provided in FIG. 4A.

Figure 4C:
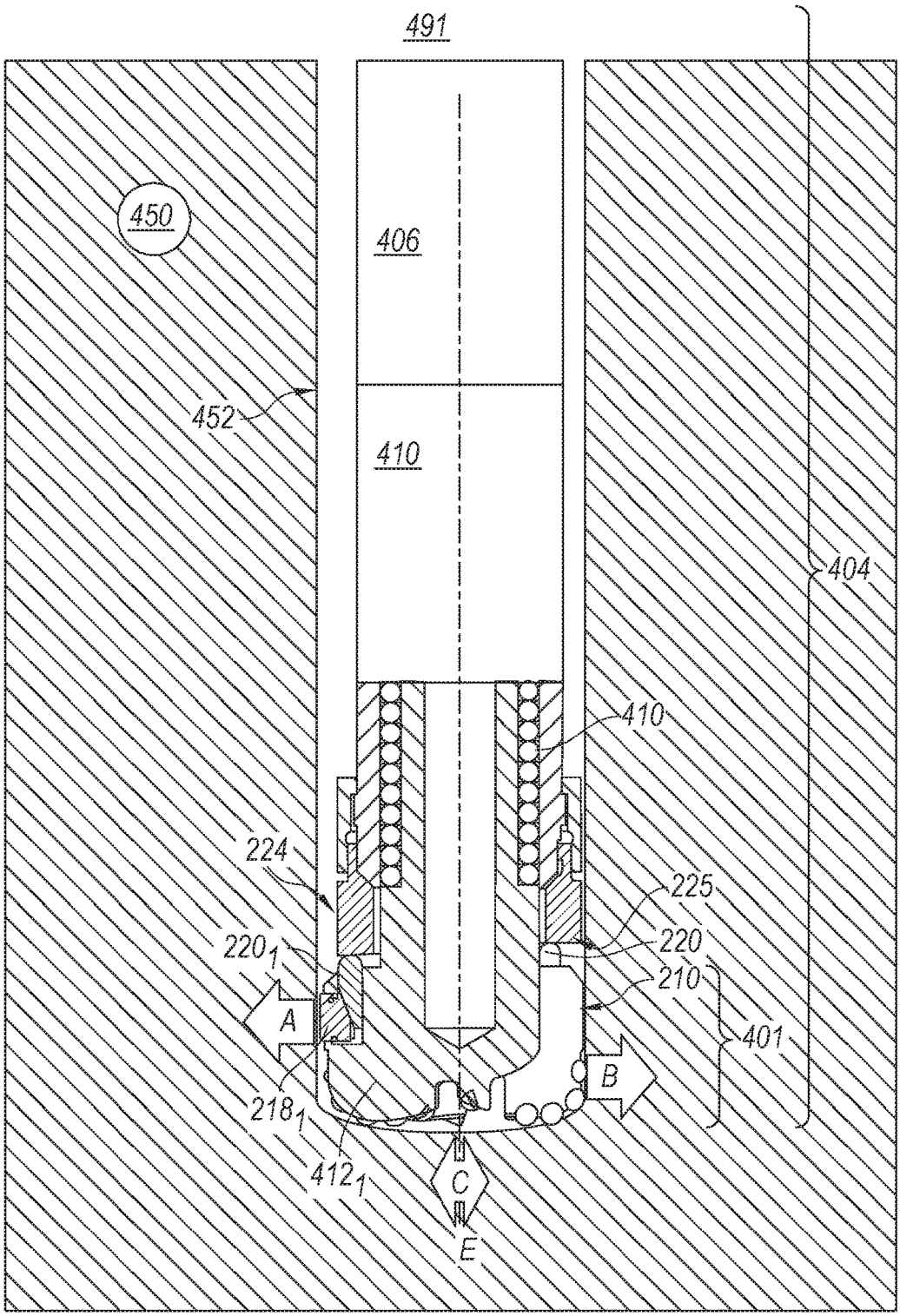

FIG. 4C provides a cross-section view of the drill string provided in FIG. 4A without a bend.

Figure 5A:
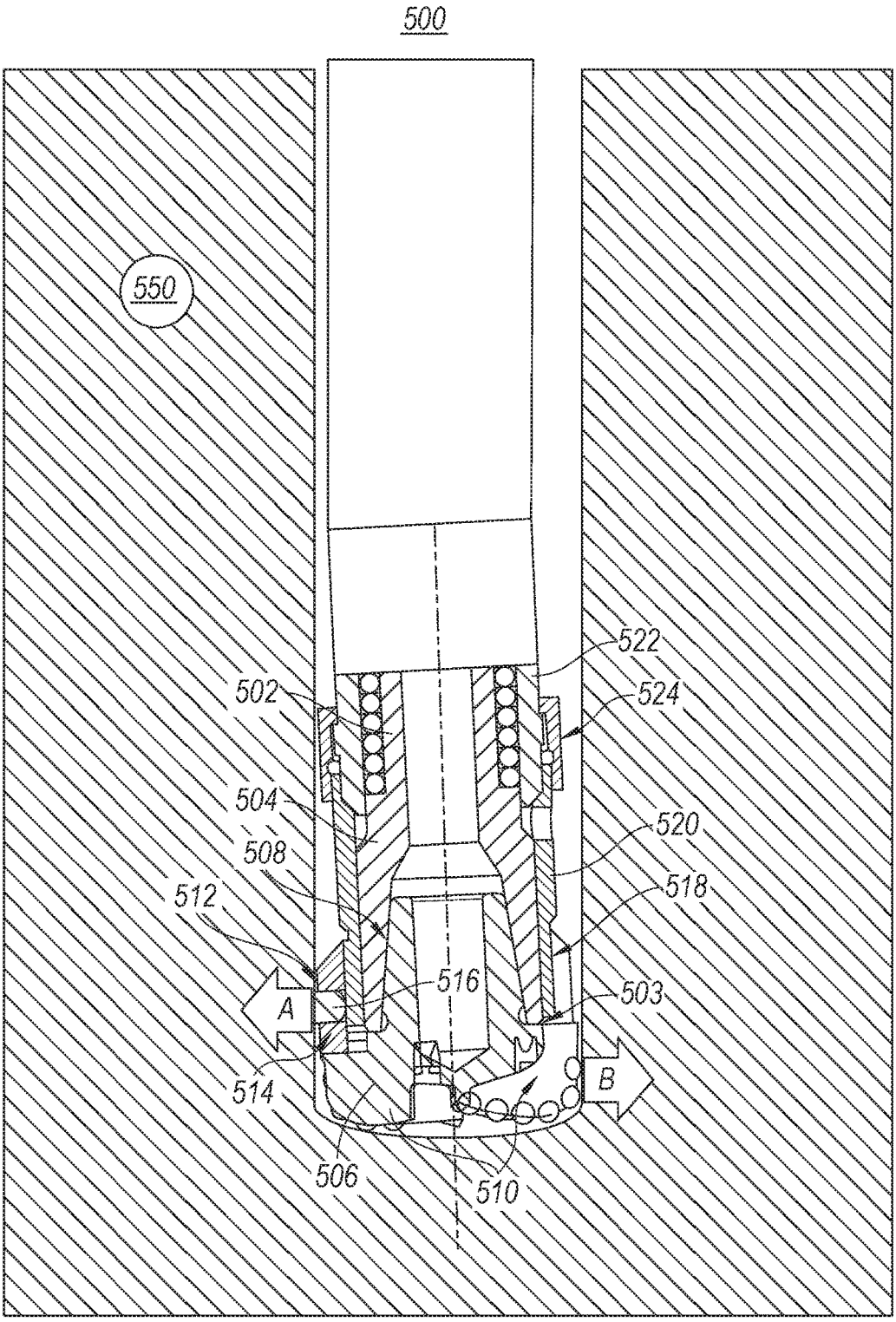

FIG. 5A provides a cross-sectional view of a drill string including a dynamic lateral pad and sleeve cam consistent with the technology of the present application.

Figure 5B:
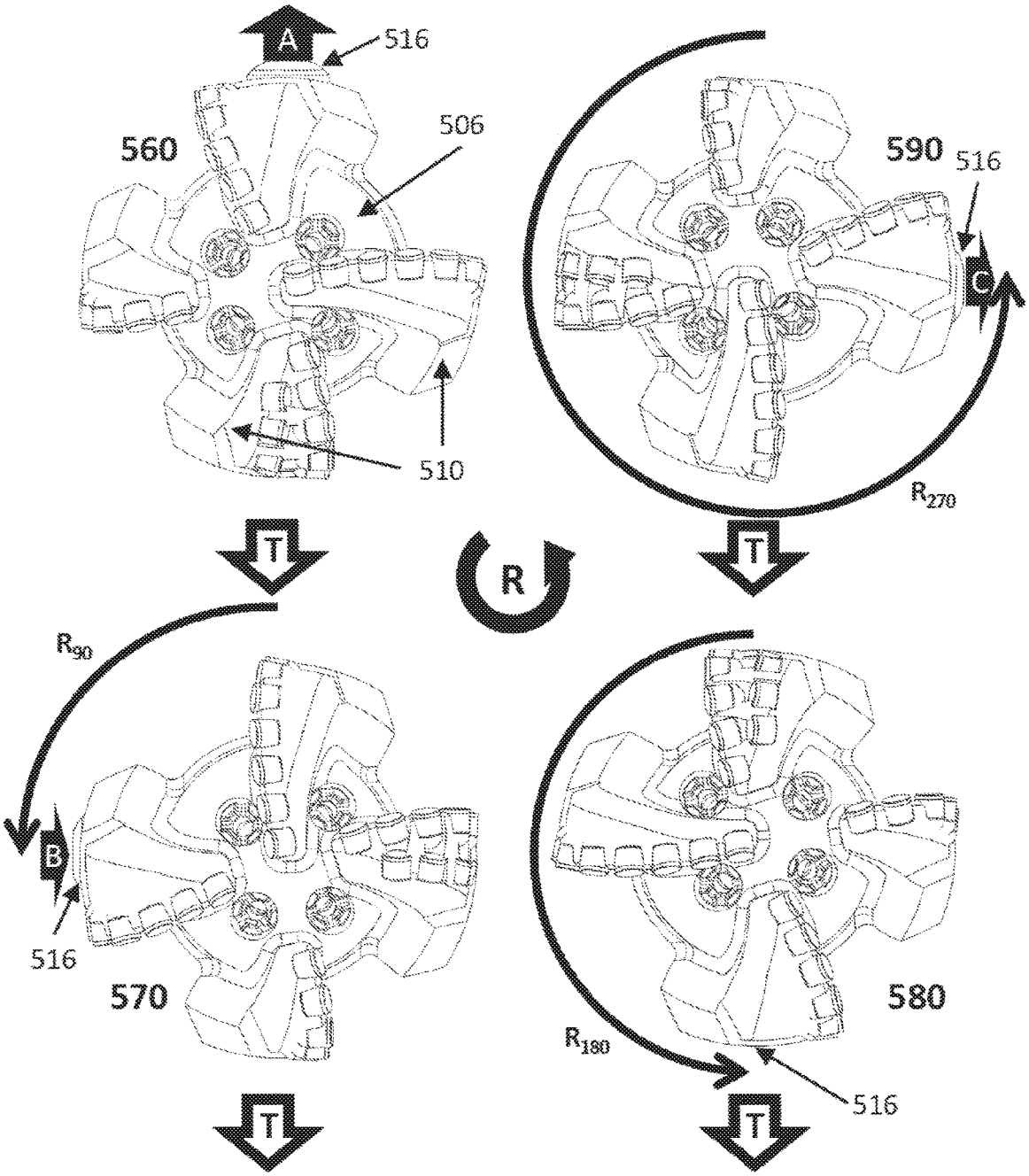

FIG. 5B provides a series of end views of the drill string provided in FIG. 5A showing bit rotation and pad movement at successive 90 degree rotation intervals.

Figure 6:
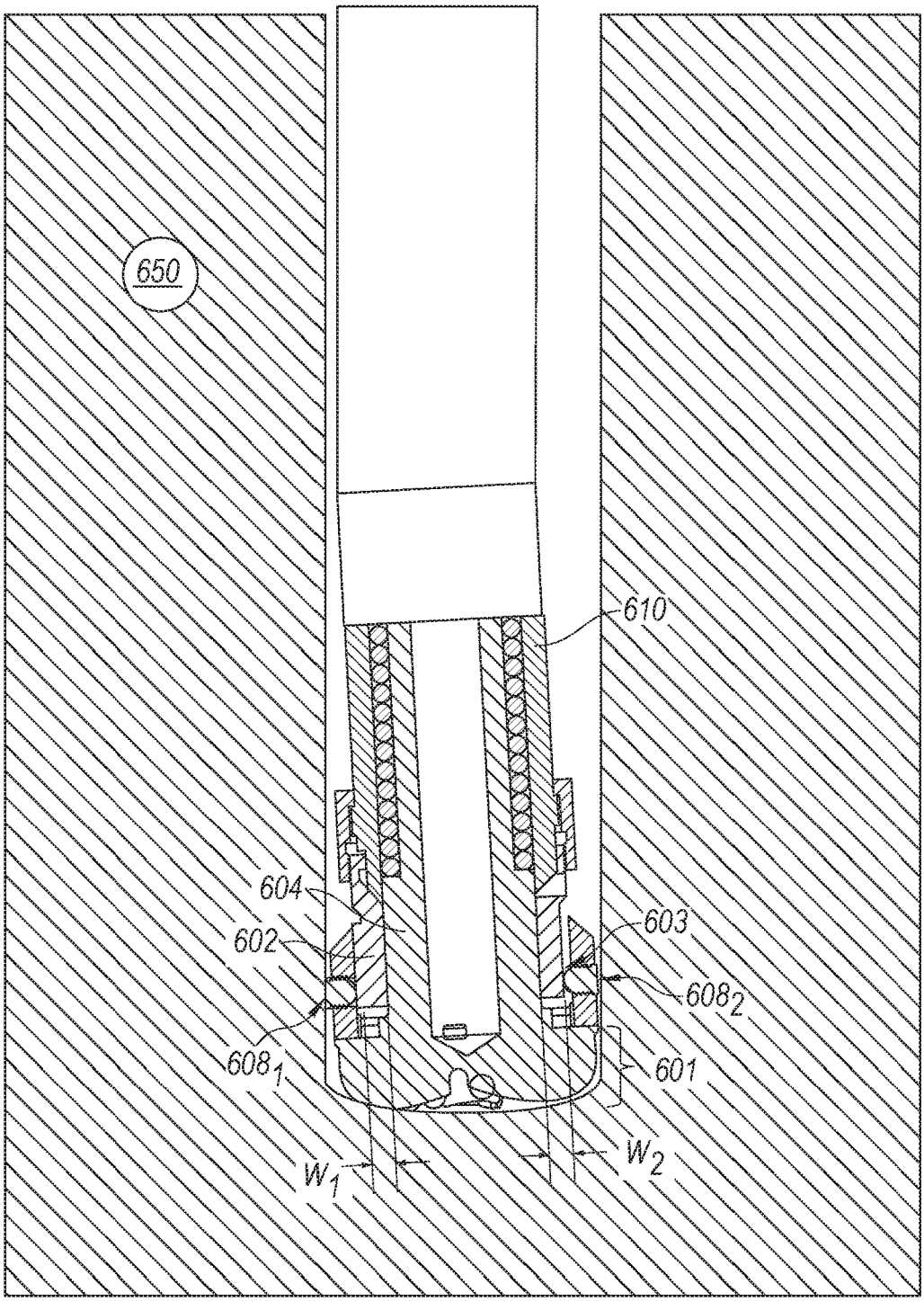

FIG. 6 provides a cross sectional view of a monolithic or integral drill bit/drive shaft having multiple dynamic lateral pads consistent with the technology of the present application.

Figure 7:
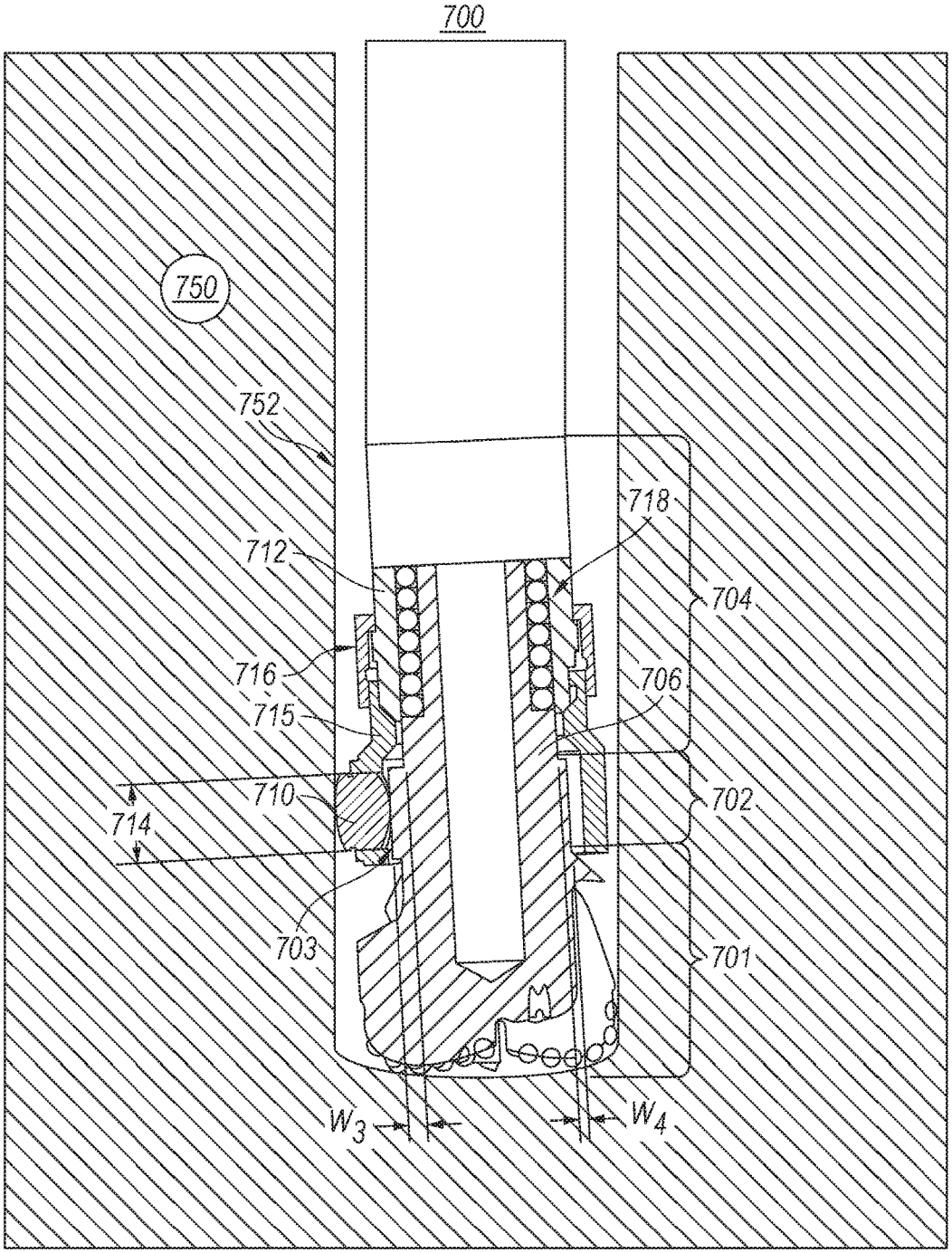

FIG. 7 provides a cross sectional view of a monolithic or integral drill bit/drive shaft having a dynamic lateral pad and bit shank cam consistent with the technology of the present application.

Figure 8A:
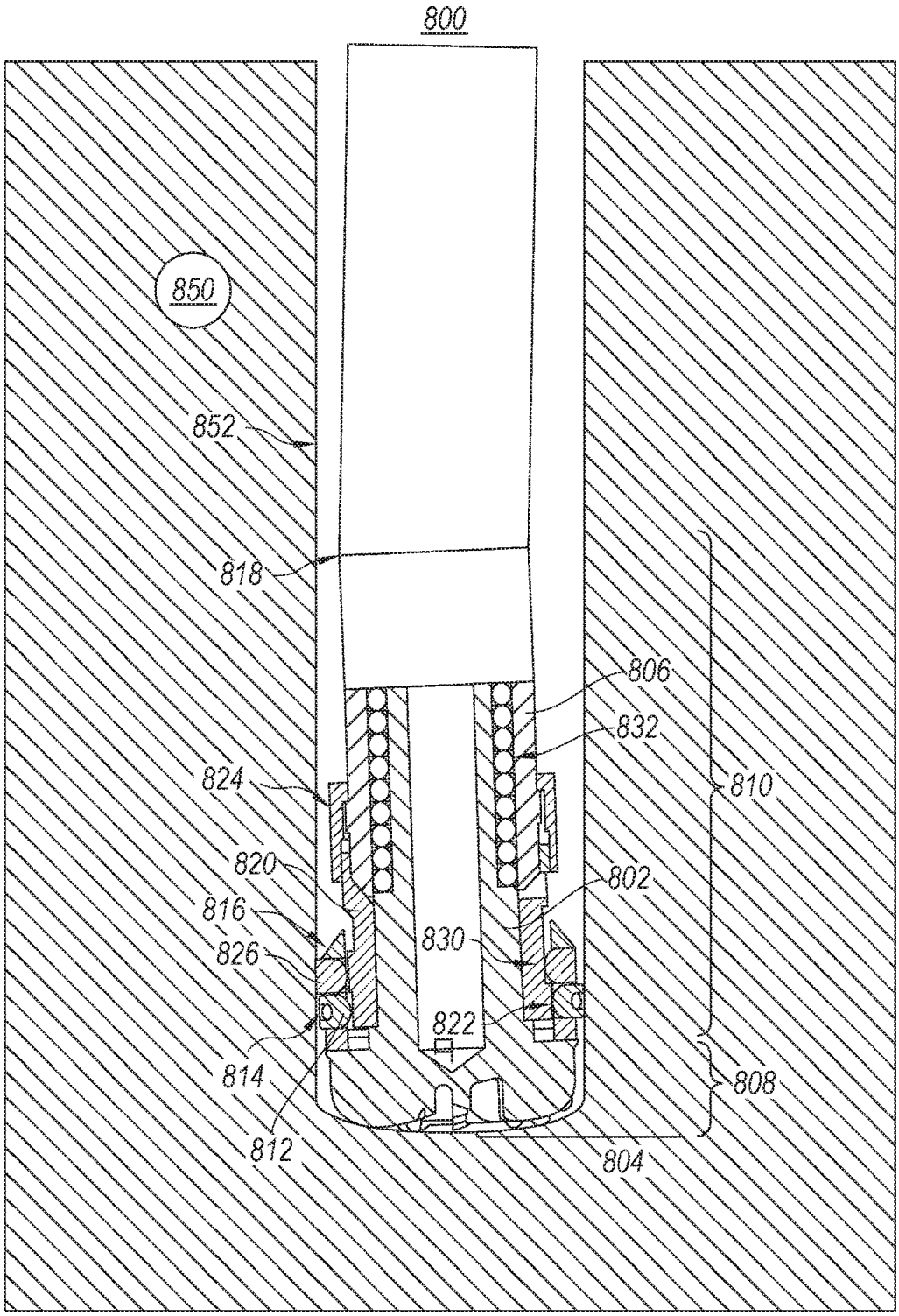

FIG. 8A provides a cross-sectional view of drill string 800 including a monolithic or integral drill bit/drive shaft, a plurality of Dynamic Lateral Pads (DLPs), a plurality of Dynamic Lateral Cutters and sleeve cam consistent with the technology of the present application.

Figure 8B:
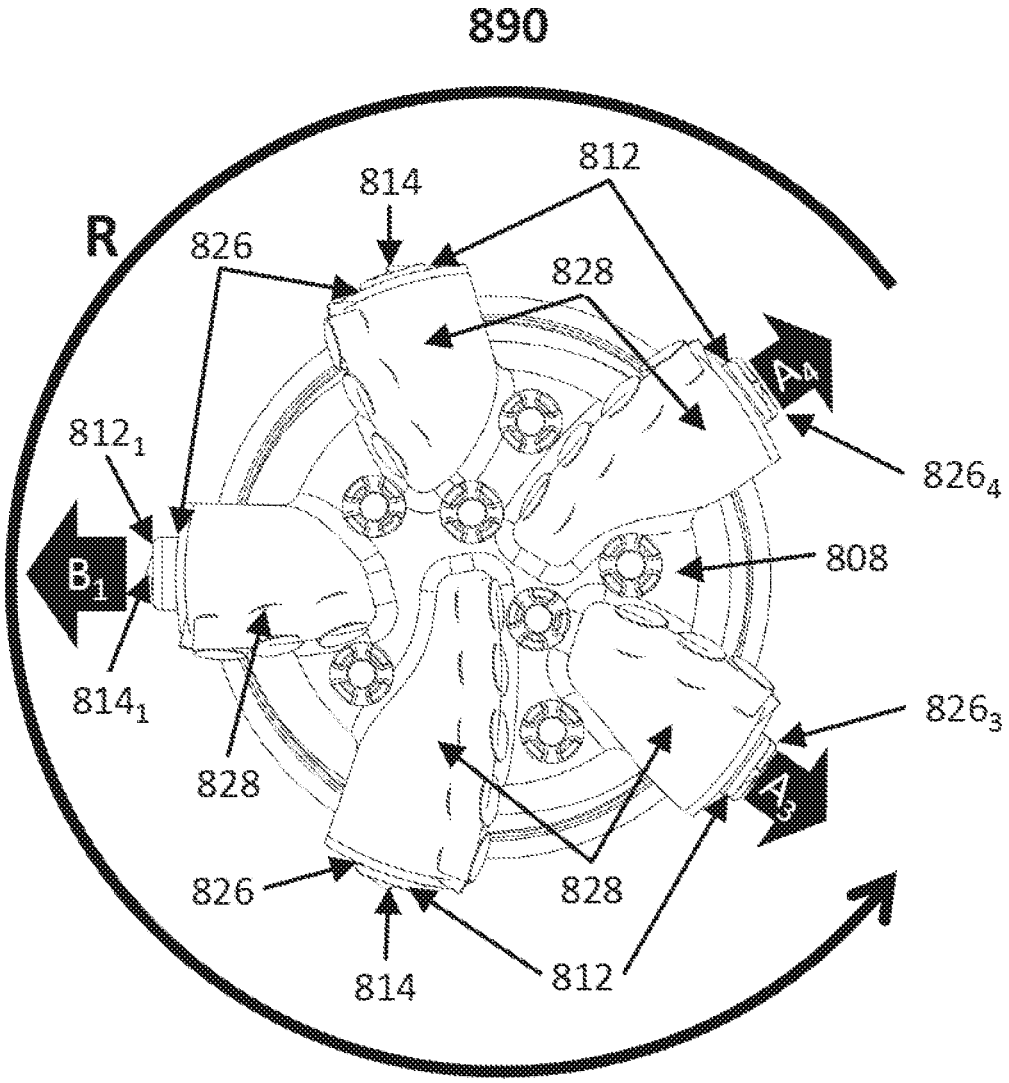

FIG. 8B provides an end view of the drill string provided in FIG. 8A illustrating an odd number of blades, cutters and pads consistent with the technology of the present application.

Figure 9:
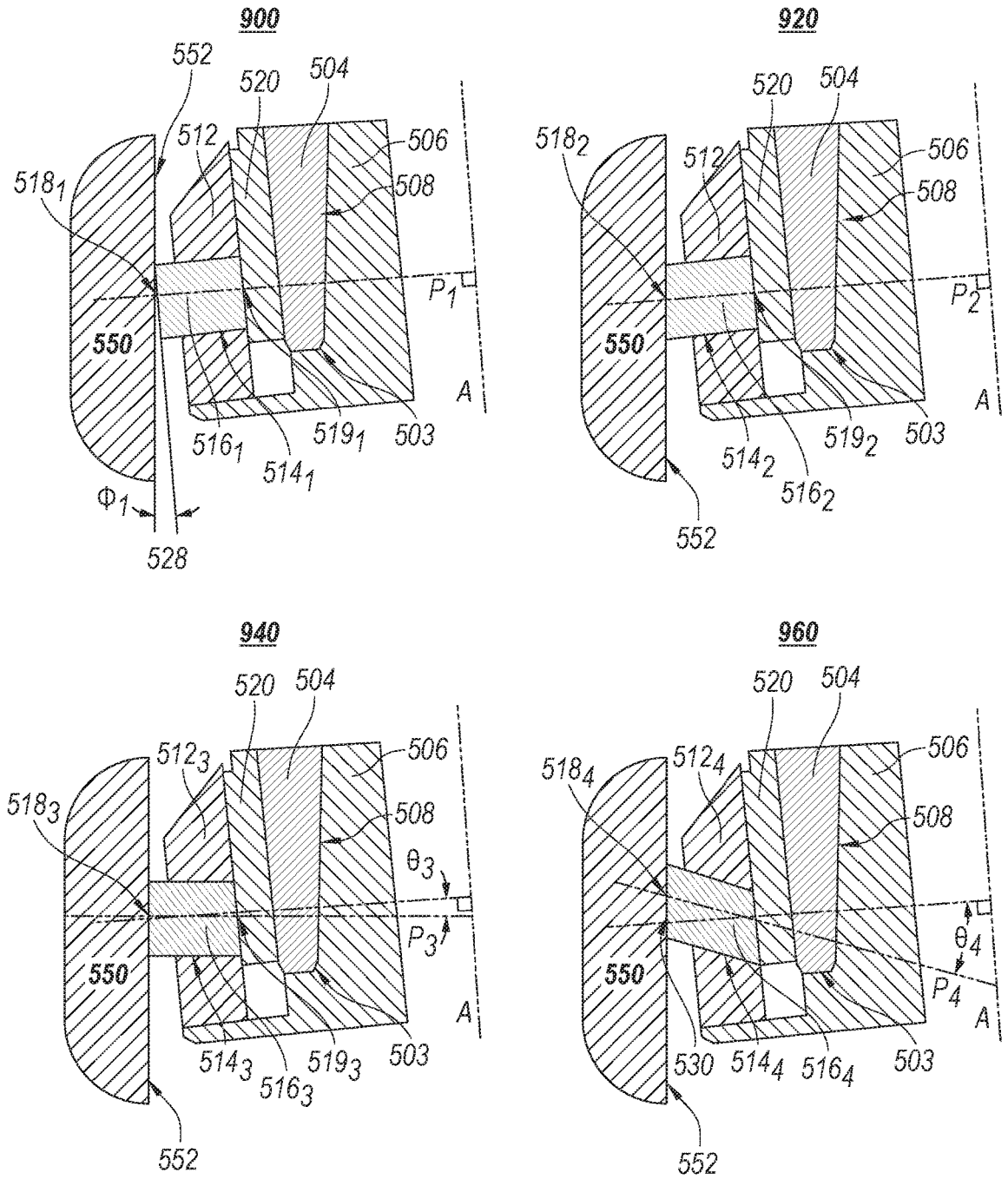

FIG. 9 provides a series of alternative embodiments for dynamic lateral pad and dynamic lateral cutter mechanisms.

Figure 10A:
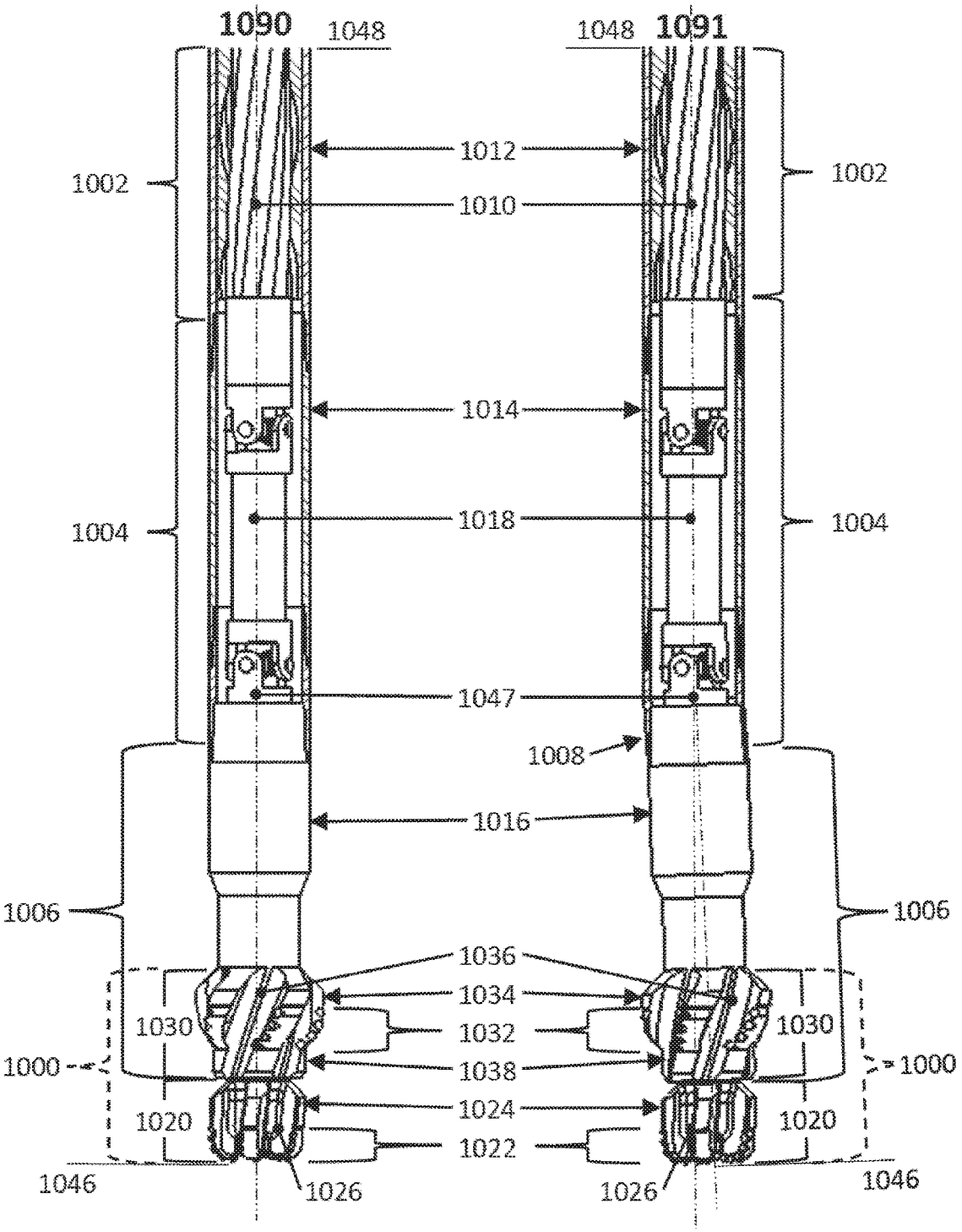

FIG. 10A provides a side-by-side partial section view of a Dual Rotating Cutting Structure (DRCS) system, with and without a bend, consistent with the technology of the present application.

Figure 10B:
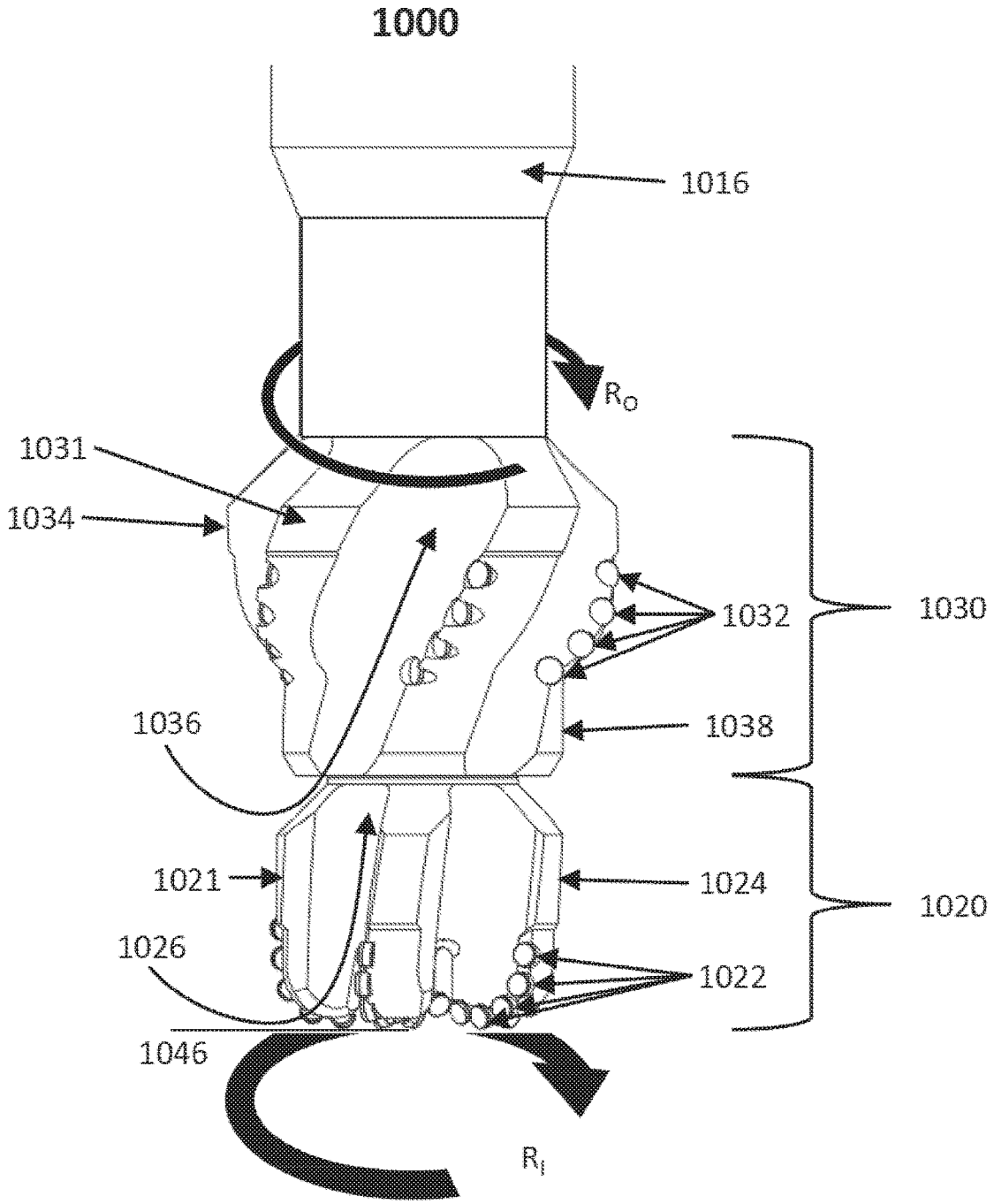

FIG. 10B provides an enlarged side view of the dual rotating cutting structure portion of FIG. 10A.

Figure 10C:
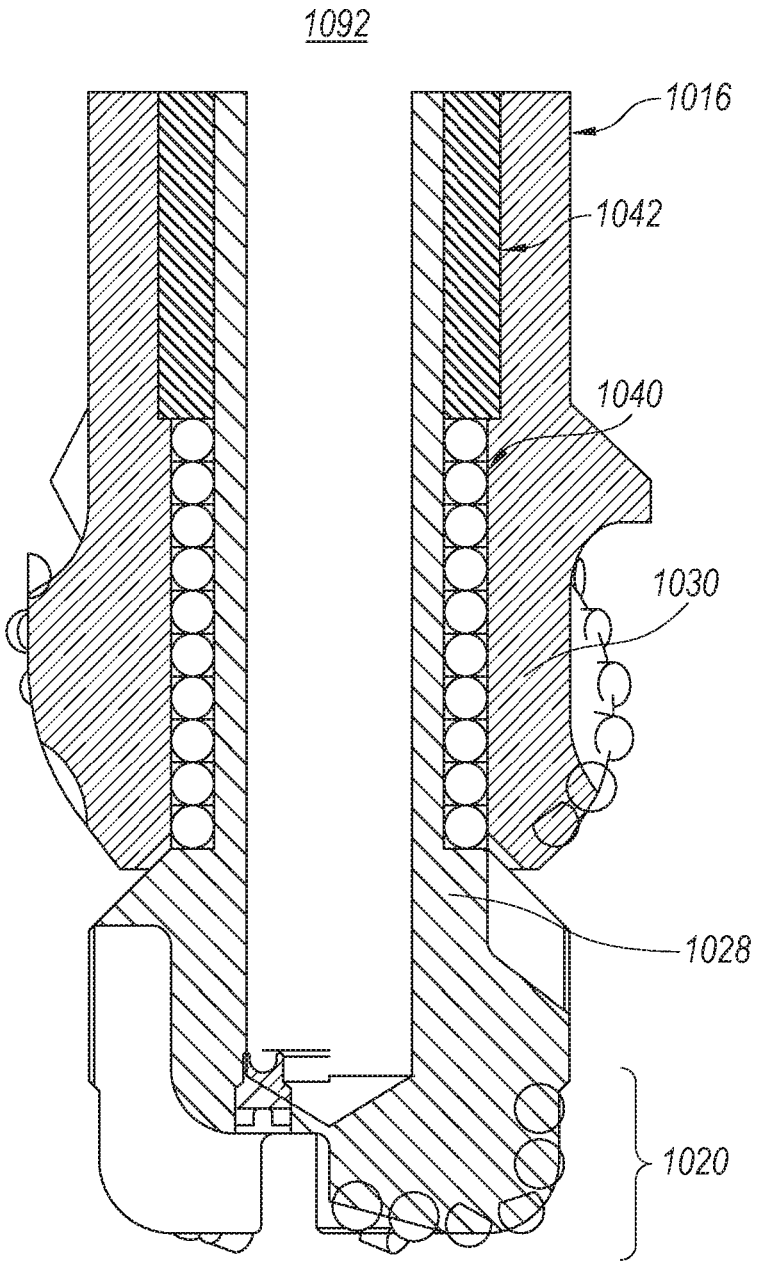

FIG. 10C provides a cross sectional view of Dual Rotating Cutting Structure (DRCS) system with a protruding inner drill bit or inner cutting structure as provided in FIG. 10B, consistent with the technology of the present application.

Figure 11:
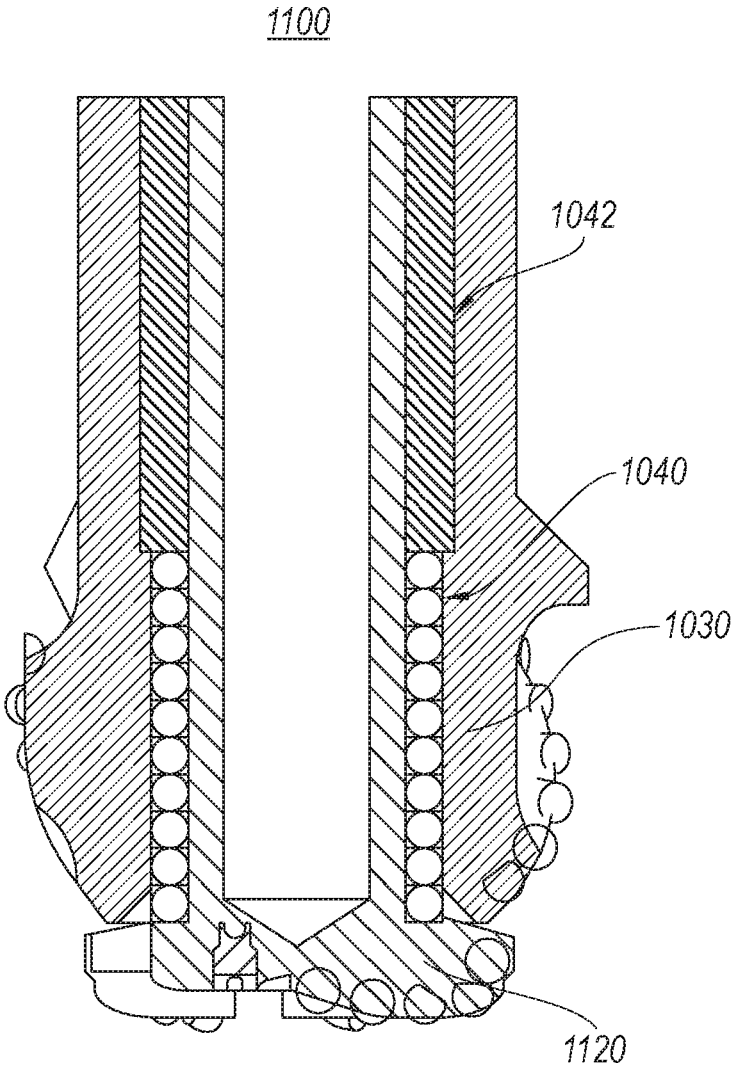

FIG. 11 provides a cross sectional view of a Dual Rotating Cutting Structure (DRCS) system with a substantially flush inner drill bit or inner cutting structure consistent with the technology of the present application.

Figure 12:
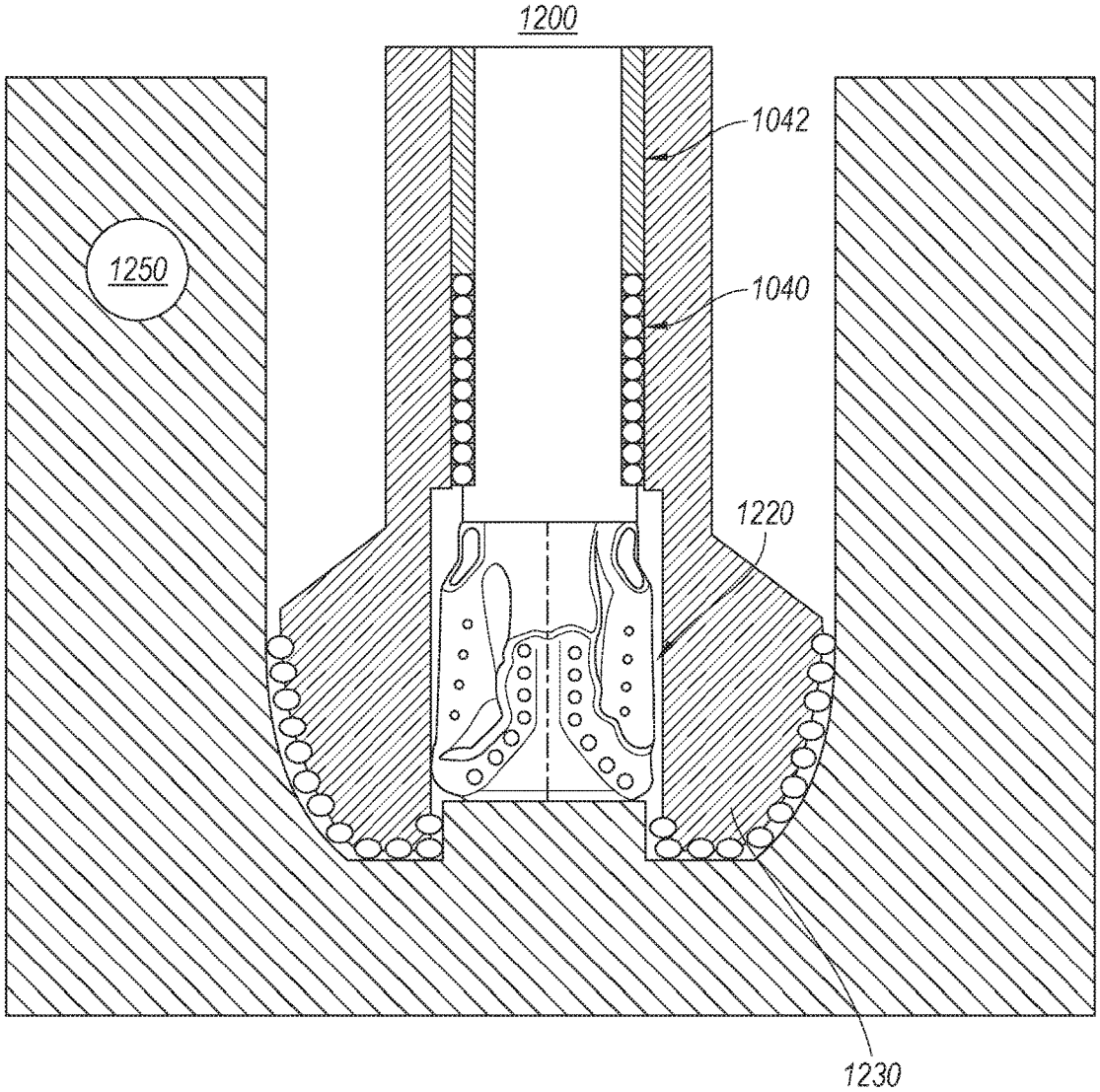

FIG. 12 provides a cross sectional view of a Dual Rotating Cutting System (DRCS) with a recessed inner drill bit or inner cutting structure consistent with the technology of the present application.

Figure 13:
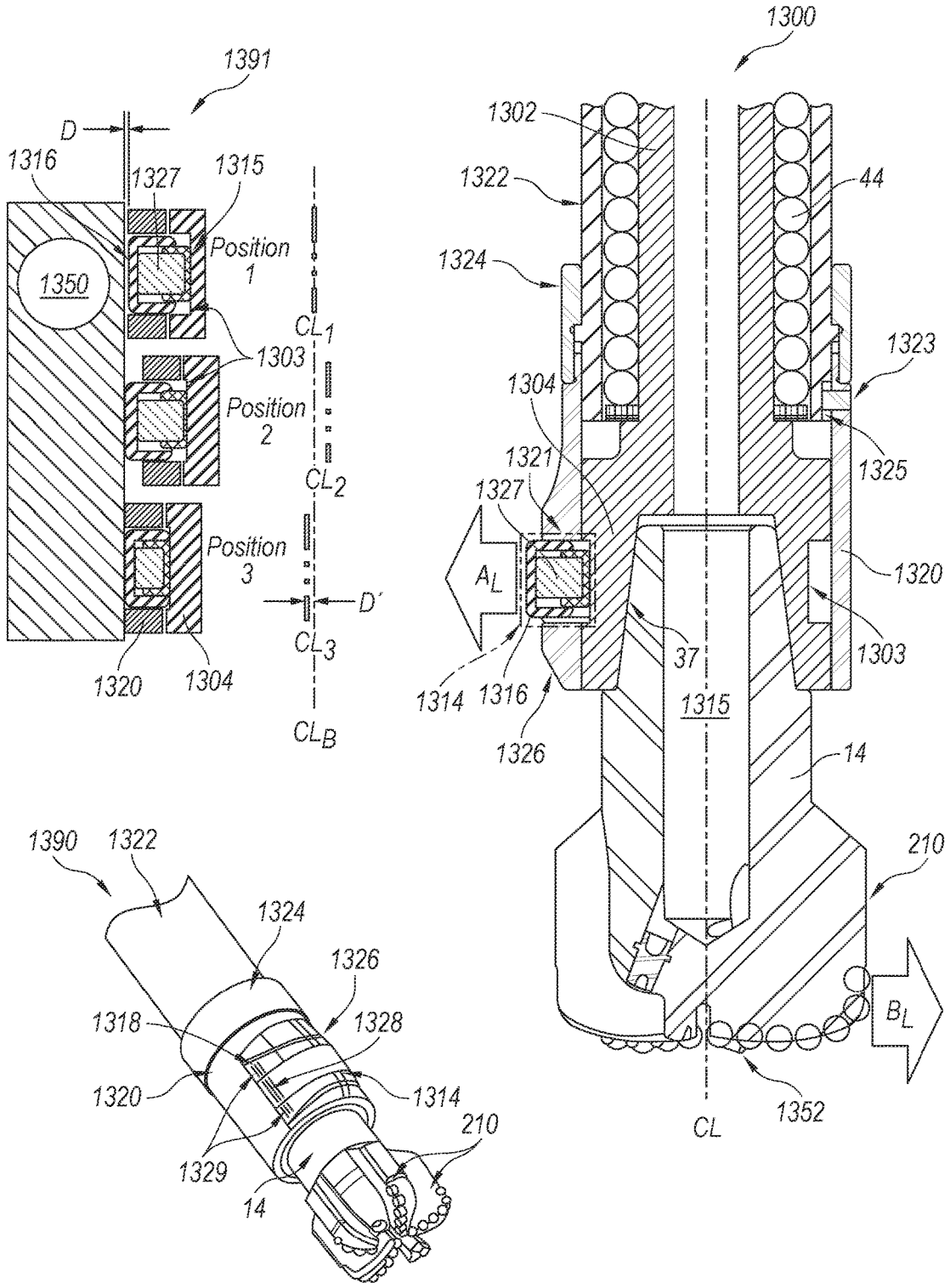

FIG. 13 provides a cross sectional view of a Dynamic Lateral Pad (DLP) system with a bit box cam, hinged circumferential pad and compliant actuator consistent with the technology of the present application and also including an isometric view and side view with multiple compliant actuator in various positions.

Figure 14:
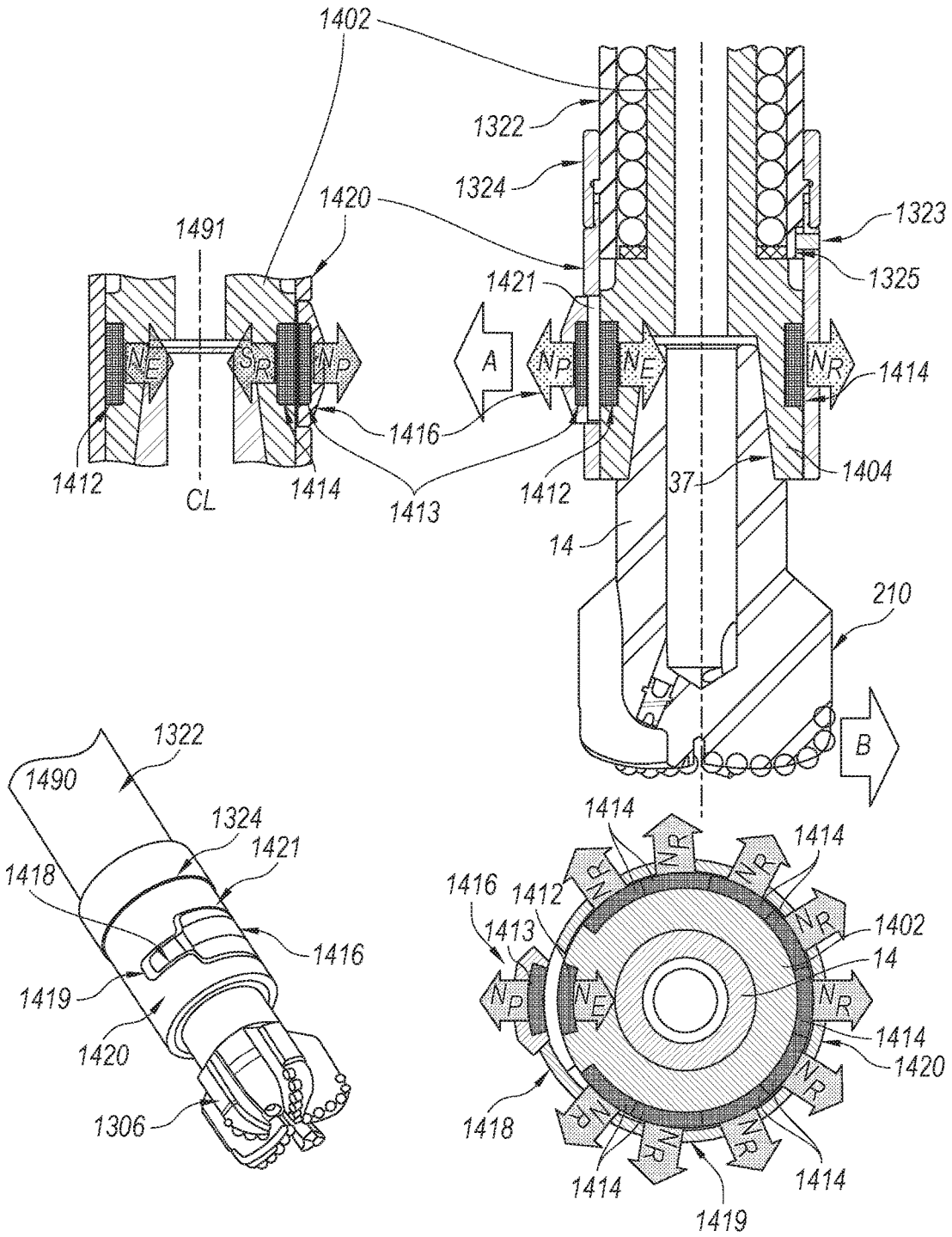

FIG. 14 provides a cross section view of a Dynamic Lateral Pad (DLP) system with magnetic actuators consistent with the technology of the present application with an extended pad. In addition, FIG. 14 provides an isometric view, and a side view with the pad retracted and a section view of the magnetic actuator.

Figure 15:
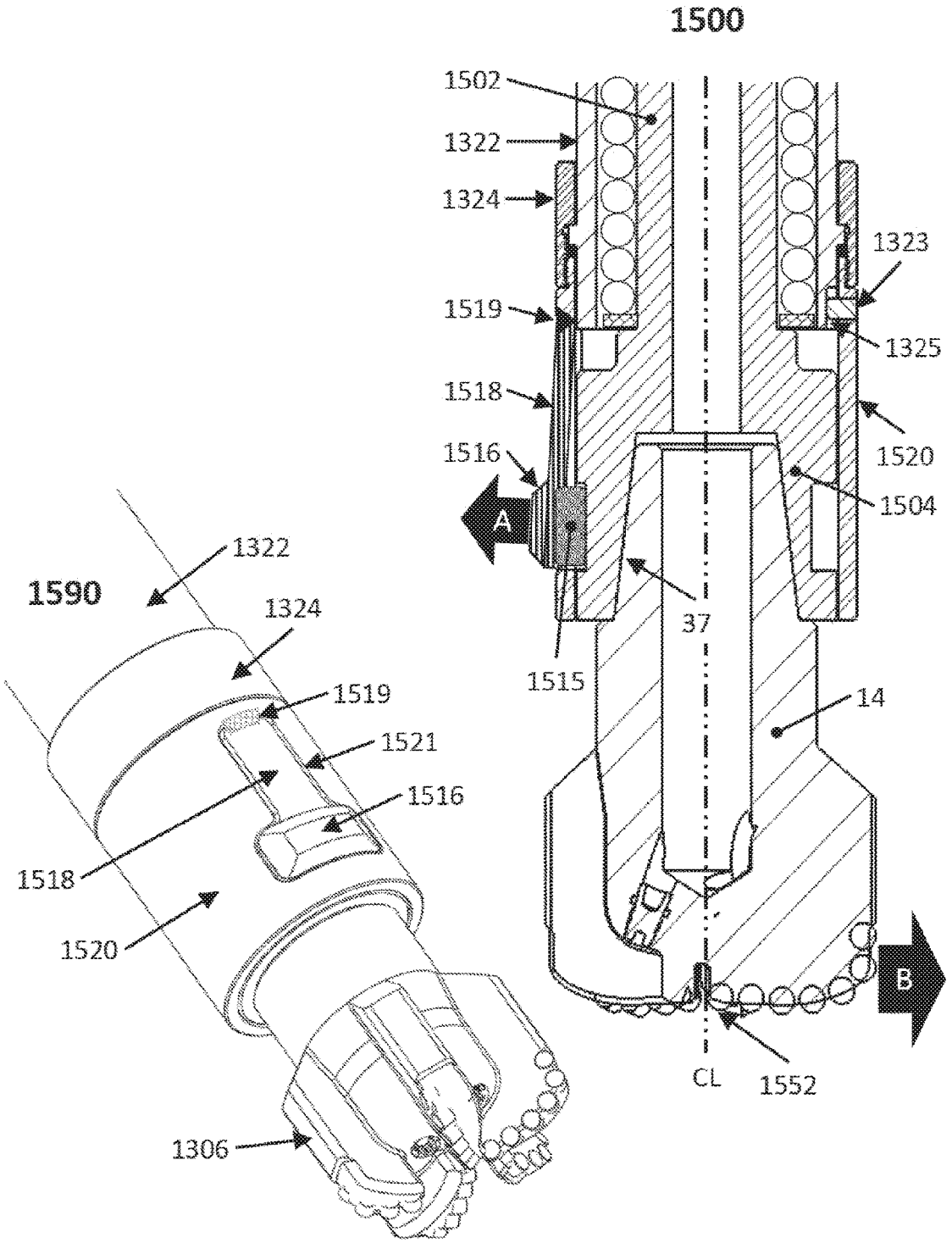

FIG. 15 provides a cross sectional and isometric view of a Dynamic Lateral Pad (DLP) system with a bit box cam, axially hinged pad and solid actuator consistent with the technology of the present application.

Figure 16A:
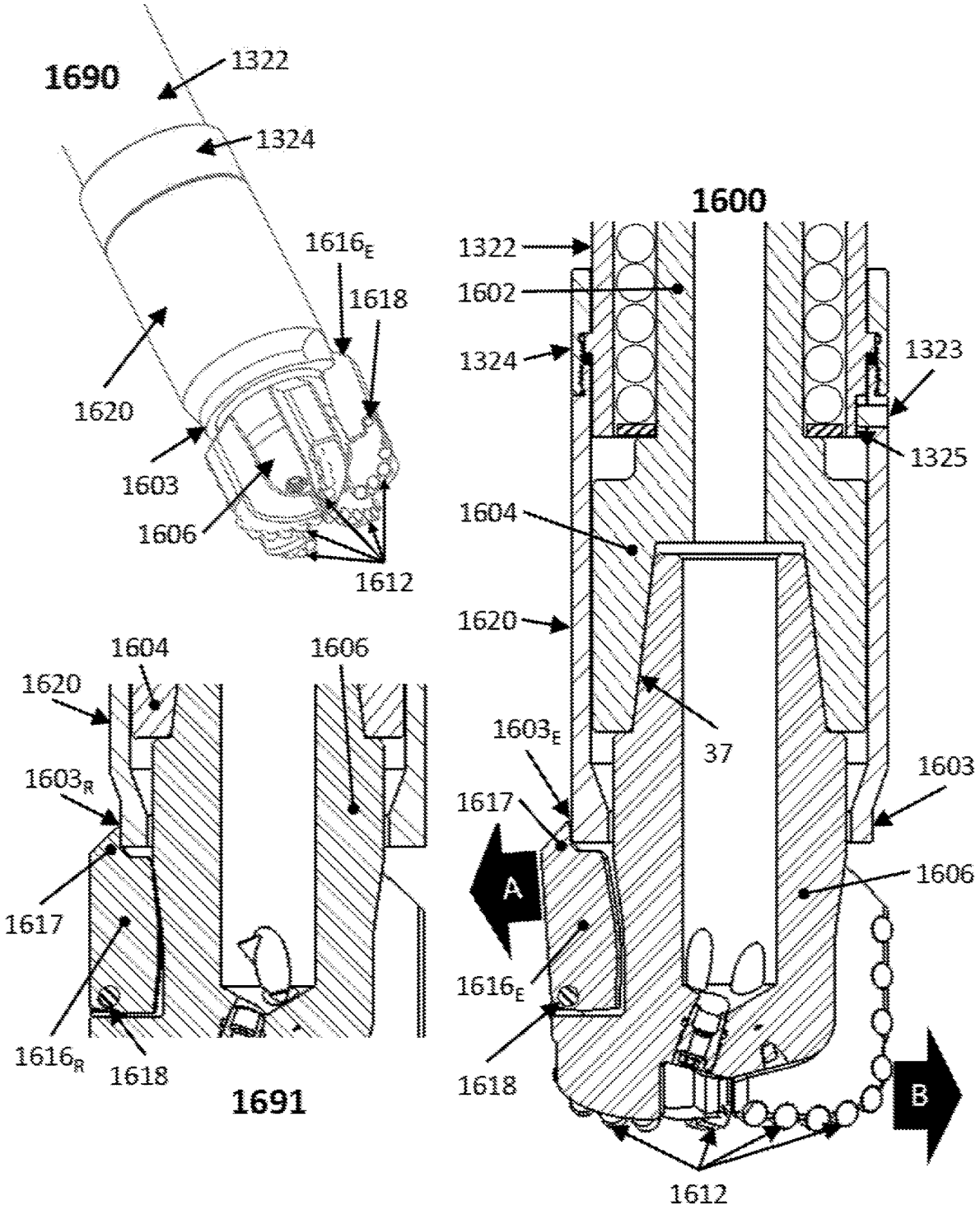

FIG. 16A provides a cross sectional view of a bit mounted Dynamic Lateral Pad (DLP) with a sleeve cam with an extended pad consistent with the technology of the present application. In addition, FIG. 16A provides an isometric view and a section view of a retracted pad.

Figure 16B:
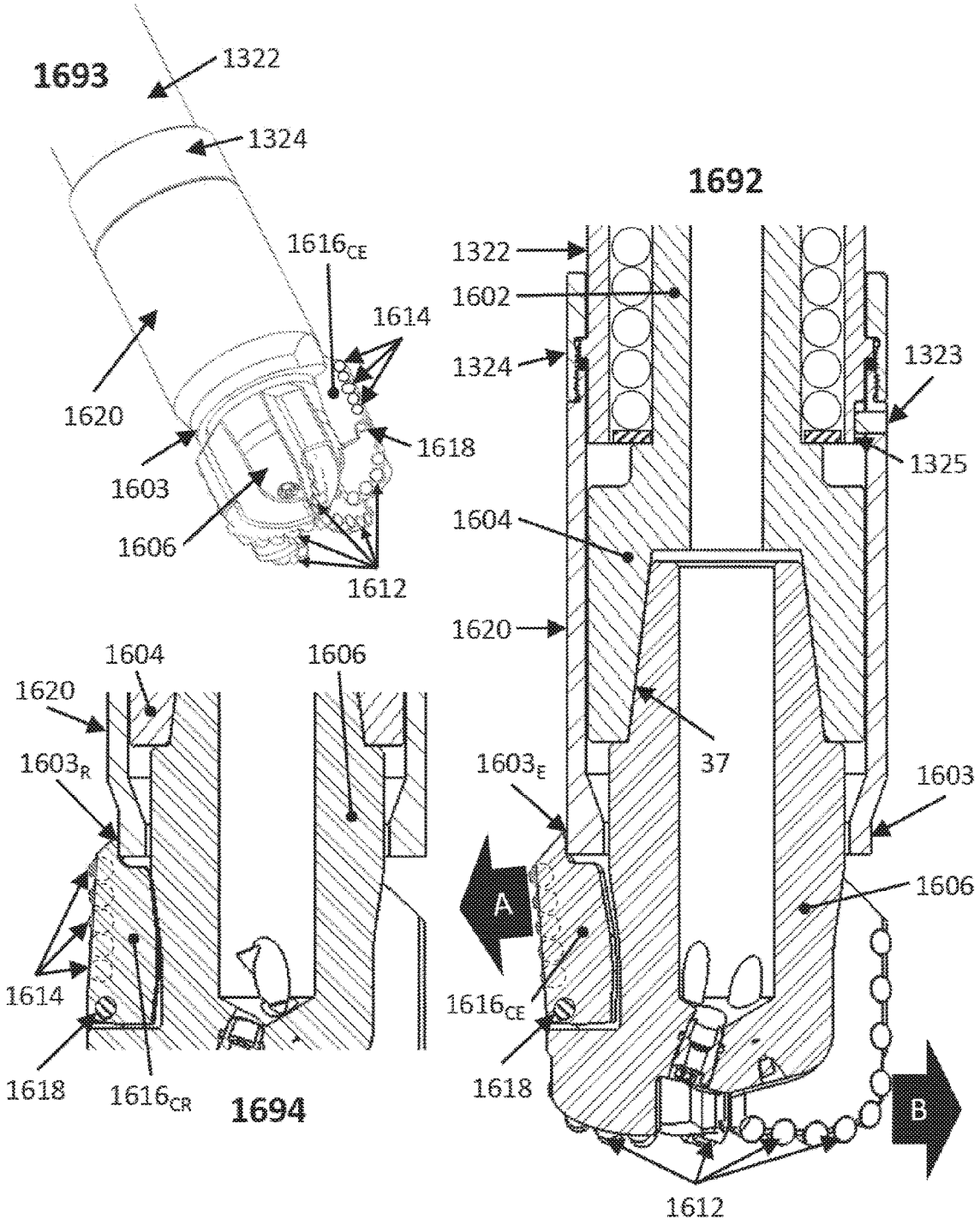

FIG. 16B provides a cross sectional view of a bit mounted Dynamic Lateral Pad (DLP) and Dynamic Lateral Cutter (DLC) with sleeve cam and an extended pad with cutters consistent with the technology of the present application. In addition, FIG. 16B provides an isometric view and a section view of a retracted pad with cutters.

Figure 17:
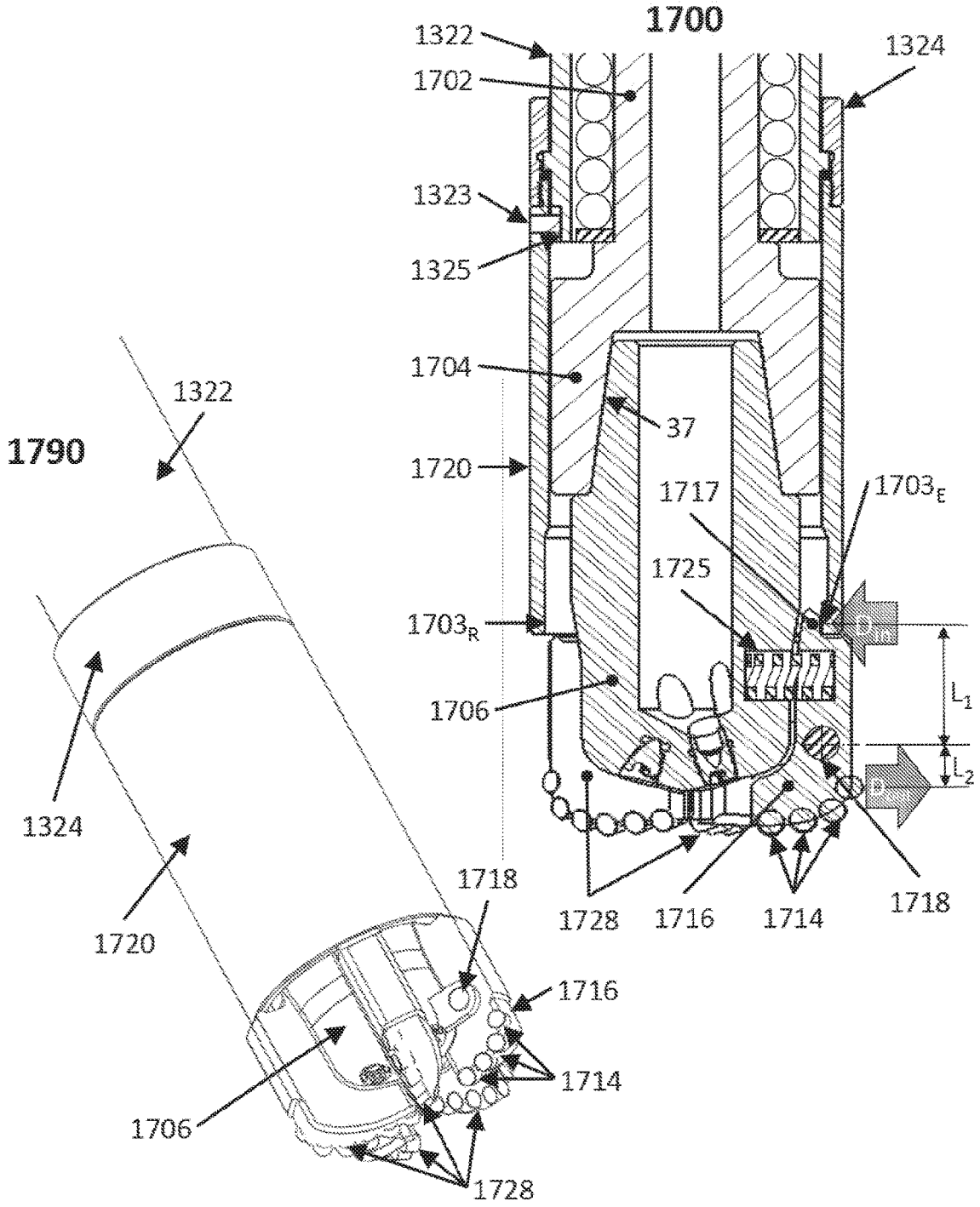

FIG. 17 provides a cross sectional view of a dynamic bit blade with sleeve cam and an extended blade consistent with the technology of the present application. In addition, FIG. 17 includes an isometric view and a section view of a retracted blade.

Figure 18:
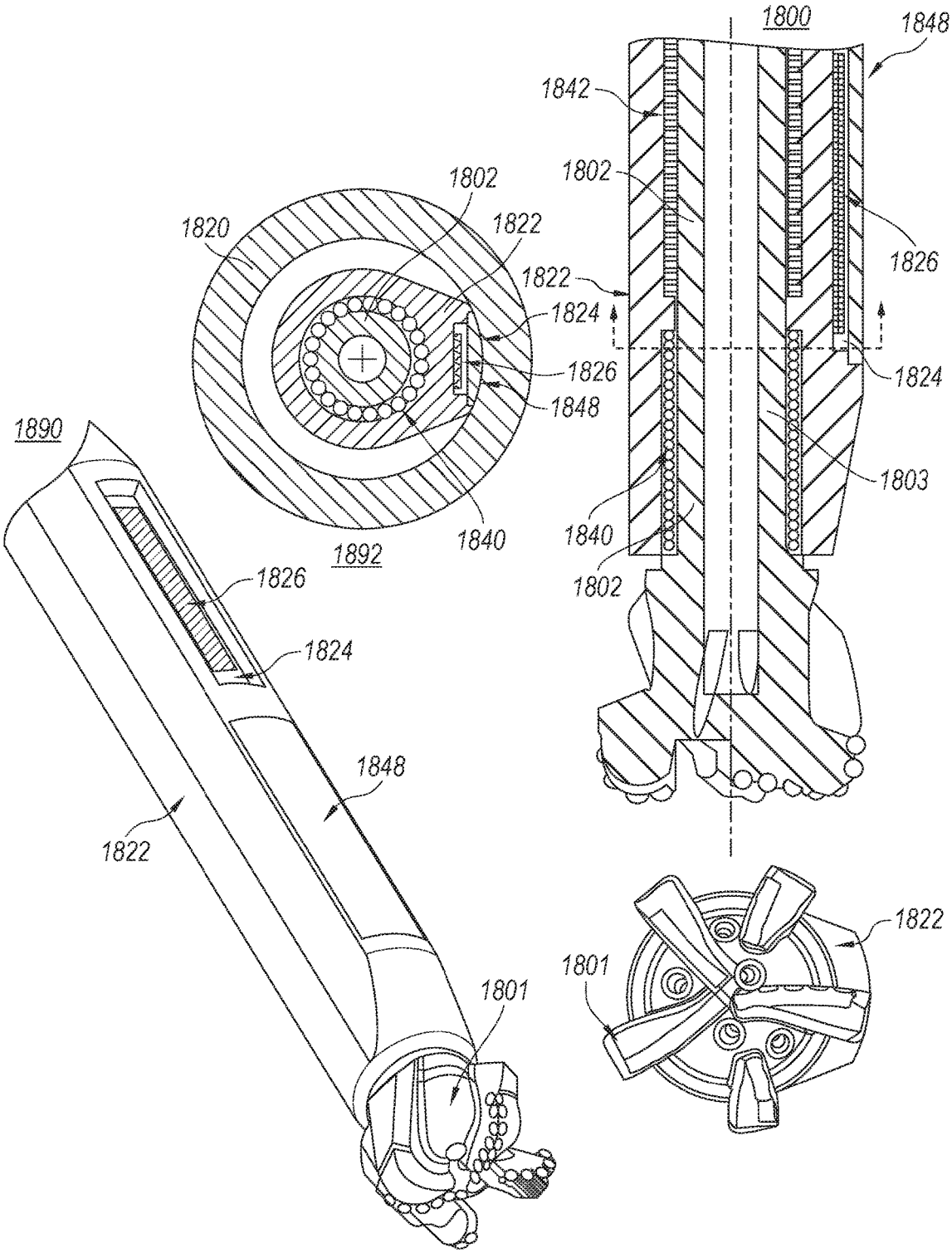

FIG. 18 provides a cross sectional view of an eccentric bearing housing with pockets consistent with the technology of the present application. In addition, FIG. 18 includes an isometric view, an end view and a section view of the eccentric bearing housing and a covered pocket.

FIG. 19A-H provide views of several exemplary embodiments of drill bit and drill string sections incorporating technology consistent with the disclosure of the present application.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense. Moreover, reference may be made to the figures using relatively locational or directional terms, such as, for example, top, bottom, left, right, axial up, axial down, radial outward, radial inward, or the like. The terms are used to describe relative movement and locations and should not be considered limiting.

The technology of the present application is described, in some embodiments, with specific reference to steerable motor systems. However, the technology described herein may be used for other applications including, for example, vertical drilling as well as directional drilling, and the like. Additionally, certain embodiments of the technology of the present application may be generally described with respect to a dual rotating cutting system having inner and outer bits or cutting structures that may include motor systems incorporating a bent housing that is not used for active directional drilling change requiring slide drilling. One of ordinary skill in the art will now recognize, on reading the disclosure, that more than two cutting structures are possible by providing inner, intermediate, and outer cutting structures for example. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

FIG. 2 shows a cross-sectional view of Dynamic Lateral Pad (DLP) system 200 consistent with the technology of the present application. DLP system 200 is shown in isolation from the remainder of the drill string for convenience. DLP system 200 includes a unitary, integral, or monolithic drill bit/drive shaft 202 (hereinafter integral or monolithic drill bit/drive shaft). Integral drill bit/drive shaft 202 has distal end 203 that terminates in a plurality of cutters 204. Cutters 204, in this case, are shown as PDC cutters, but could be, for example roller cones or the like. Integral drill bit/drive shaft 202 has a first diameter (generally the diameter of bit gauge 210) at the distal end of D'. Integral drill bit/drive shaft 202 also has proximal end 206 coupled to the transmission which then is connected to the rotor of the power section (shown below with reference to FIGS. 3A and 3B). Integral drill bit/drive shaft 202 has a second diameter at the proximal end of D". As shown, D' is generally greater than D" such that the drill bit portion of integral drill bit/drive shaft 202 extends the diameter of, but also rotates within, the wellbore (not shown); whereas, the drive shaft portion of integral drill bit/drive shaft 202 fits and rotates within drill string housing 208, therefore drill string housing 208 must generally have a diameter that is equal to or less than D'.

Distal end 203 of integral drill bit/drive shaft 202 has an axial surface formed by bit gauge 210 and upper radial surface 212. Pad hole 214 extends through bit gauge 210 radially inward a distance $d_1$ and forms a volume. Actuator hole 216 extends from upper radial surface axially downward a distance $d_2$ and forms a volume that intersects with pad hole 214. Pad 218 is sized to movably engage pad hole 214. Pad 218 moves radially in and out as shown by arrow B. Pad 218 may include a stop 219 to inhibit pad 218 from exiting pad hole 214. Acceptable pad 218 materials include hardened steel or ceramic that would be known to those ordinarily skilled in the art. Actuator 220, which is shown as a push rod, or cam follower is sized to movably engage actuator hole 216. By way of reference, the term actuator should be construed as a device, structure, or means to provide a motive force tending to cause the associated pad (or pads) to move radially in at least one direction. Actuator 220, which is one exemplary means for actuating, rides between pad 218 and the axial cam profile formed in the distal end of non-rotating axial cam sleeve 224. Axial cam sleeve 224 terminates in a spiral shaped or ramped cam surface 225. The spiral shape or ramp of cam surface 225 means cam sleeve 224 extends further on one side of integral drill bit/drive shaft 202 than the other and that cam surface 225 has a continuous, potentially constant slope up and down between minimum and maximum axial extension. Actuator 220 moves laterally up and down as shown by arrow C. Axial cam sleeve retainer 222 and axial cam sleeve 224 are operatively coupled and connected to the housing of the drill string. As the integral drill bit/drive shaft rotates relative to generally non-rotating housing 208, sleeve retainer 222 and axial cam sleeve 224. Axial cam sleeve 224 acts on actuator 220 to cause the actuator to slide, in this exemplary embodiment, into actuator hole 216. Sloped surface 226 of actuator 220, in this exemplary embodiment, drives pad 218 radially out to an extended position. Reactive force from the wellbore wall (not shown) on pad 218 acts to move pad 218 to a flush position as the axial cam rotates back to the start position. A bearing assembly 228, as is conventional, supports integral drill bit/drive shaft 202 in housing 208.

For convenience and understanding, in certain aspects, reference will be made to the parts and components of a drill string described in FIG. 1 while describing the technology of the present application. Power section 20 to which an integral drill bit/drive shaft 202 is connected comprises a transmission, mud turbine, positive displacement mud motor or other type of apparatus that creates suitable drilling action downhole. Other such apparatus include an electric motor, reciprocating motor or other type of motor to facilitate driving integral drill bit/drive shaft 202 or, as is conventional today, drill bit 14 connected to bit box 34 that is part of drive shaft 46. As one of ordinary skill in the art would understand, a drill string having for example a positive displacement motor includes: (1) a power section, which comprises the rotor and stator, (2) drive shaft, optionally (3) a bent housing (generally only included in directional assemblies), (4) a transmission coupling the power section to the drive shaft, and (5) a bit box to connect a conventional bit. Referencing back to FIG. 1, conventional drive shaft 46 is contained in a bearing housing 24 having both axial and radial bearings 44. The distal end of drive shaft 46 typically terminates in bit box 34 containing an API connection 37 (not shown) appropriate for the hole size being drilled. A separate drill bit 14, having a corresponding thread, is coupled to the distal end of drive shaft 46 through API connection 37 (not shown) on bit box 34. Connections other than threaded connections are possible such as a weld, interference fit, or other non-threaded attachment.

Although introduced as part of DLP system 200, integral drill bit/drive shaft 202 would increase the effectiveness of most drilling systems, including conventional steerable motor system 10, rotary steerable systems (not shown) and straight hole motor systems 300 (FIG. 3A), without incorporating dynamic lateral pad system 200 described in FIG. 2. As compared to conventional designs, providing monolithic or integral drill bit/drive shaft 202, as shown above, allows reduction of the distance from the most distal bearing set and the distal end of any drilling assembly. In directional assemblies with bend 35, integral drill bit/drive shaft 202 also allows reduction of the distance from bend 35 to distal end 52 of drill bit 14. Decreasing the distance from the most distal bearing set to the distal end of the drilling assembly and decreasing the distance from the bend on directional assemblies to the distal end of the bit improves drilling performance. By example, the shortened distance from the distal end of the bit to the bend on any directional assembly, generally means a more aggressive ability to move the drill axis off vertical or to change wellbore direction. The shortened distance from the most distal bearing set to the distal end of the drilling assembly significantly reduces counterproductive flex and possible failure points related to the added length required to form and service the connections. The shortened distance also reduces bending moments in the drive shaft resultant from the flex created by the connection of bit box 34 and drill bit 14. Decreased bending moments reduce bearing loads and resultant wear in all motors and other systems described above and reduce the potential for erratic bending vectors attributed to misalignment of the conventional API bit box and drill bit connection. Cutters of integral drill bit/drive shaft 202 could be made with any rock destroying cutting structures (i.e.; PDC, Roller Cone, Impregnated, Natural Diamond, etc.)

FIG. 3A shows a side by side comparison of a conventional motor drill string 300 and improved motor drill string 390 using integral drill bit/drive shaft 202 of the present application described above (both drill strings are without a bend). Both drill string 300 and drill string 390 include power section 320, transmission section 322 and bearing section 324. Conventional motor drill string 300, however, incorporates conventional drive shaft 346 with bit box 334, and separate drill bit 314 having API connection 337 (not shown) to couple to bit box 334. Conversely, improved motor drill sting 390 has a monolithic or integral drill bit/drive shaft 202. By replacing conventional drive shaft 346 and drill bit 314 with integral drill bit/drive shaft 202, distal end 352 of conventional motor drill string 300 is a distance L farther from bearing section 324 than distal end 352' of improved motor drill string 390.

FIG. 3B shows a side by side comparison of conventional directional drill string 391 and improved directional drill string 392 using integral drill bit/drive shaft 202 of the present application described above (both drill strings include a bend). Similar to the above, both conventional drill string 391 and improved drill string 392 includes power section 320, transmission section 322 and bearing section 324. In this example, conventional drill string 391 and improved drill string 392 also includes bent housing 335. Conventional directional drill string 391, however, incorporates a conventional drive shaft 346 with bit box 334, and separate drill bit 314 having API connection 337 (not shown) to couple to bit box 334. Conversely, improved directional drill string 392 has a monolithic or integral drill bit/drive shaft 202. As such, distal end 352 of conventional directional drill string 391 is a distance L' farther from the bend in bent housing 335 than distal end 352' of improved directional drill string 392.

Conventional directional drill string 391 has longitudinal axis A extending above and through power section 320 and, after the bend, longitudinal axis B extending through drive shaft 334 and drill bit 314 of drill string 391. Improved directional drill string 392 has longitudinal axis C extending above and through power section 320 and, after the bend, longitudinal axis D extending through integral drill bit and drive shaft 202 of improved drill string 392. Axis A and axis B form angle $\alpha$ and axis C and axis D form angle $\beta$, where angle $\beta$ is capable of being less than angle $\alpha$ yet have the same or greater build rates provided the ratio of angle $\alpha$ to angle $\beta$ is equal to or less than the ratio of the bit to bend distance (BTB) of conventional directional drilling string 391 and the bit to bend distance (BTB) of improved directional drill string 392. Build rate is generally computed as the angular change of the wellbore path over a set distance, such as 100 feet or 30 meters. As shown, the cutters are conventional PDC cutters, but most any cutting structures and/or cutting elements are usable. Similar to FIG. 3A, FIG. 3B provides drill string 391 with conventional drill bit 34 and drill string 392 with integral drill bit and drive shaft 202 without DLP system 200 of DLC system 800 or combination, although DLP system 200 or DLC system 800 or combination could be used with any of the configurations shown in FIGS. 3A and 3B.

As can now be appreciated, shorter lengths and smaller bends provide benefits for the overall drill operation. In certain aspects, the configuration of improved drill strings 390 and 392 provide reduction in stress on critical components most notably the drive shaft and bearing assemblies, reduction in magnitude of cyclical loads, higher build rates at lower bend angles, reduction in drag (resistance to axial movement along the path of the wellbore), increased power, and reduced bending moments as compared to conventional drill strings 300 and 391. Eliminating the connection also allows for the potential for more efficient and effective use of downhole sensors, power sources for sensors, potential communication devices and additional actuators. These sensors, devices, actuators and power sources can now be placed in closer proximity to the cutting structure area or in other longitudinal space made available because of the shorter length of integral bit/drive shaft 202. In addition, support wires and tubing can be prearranged during assembly at the shop, eliminating the hindrance of managing support wires and tubing across a rotary connection on the rig floor.

With reference back to FIG. 2, integral drill bit/drive shaft 202 comprises drill bit portion 401 with drive shaft portion 403 with no field connectors between the two portions. Drill bit portion 401 and drive shaft portion 403 are generally formed as a single unit, such as for example, machined from a single high strength steel forging, machined from a high strength metal bar, as an assembly between a low carbon steel bit core with drill bit matrix or steel bit head welded, shrink fit or chemically bonded to a drive shaft made from high strength steel. Alternatively, a custom or API threaded connection with no provision (axial length) included to make or break the connection at the drilling location.

FIG. 4A provides a side view of DLP drill string 400 in wellbore 452 drilled in formation 450. Drill string 400 includes power section 406, bent section 408 (and an associated scribe line (not specifically shown)), bearing housing 410 and DLP system 200 (first presented in FIG. 2). As shown, DLP system 200 includes a cam sleeve retainer 222, cam sleeve 224 and drill bit portion 401 with a number of blades 412 each including actuator 220, pad 218, and cutters or attached integral cutting structures 414, such as the PDC cutters shown. While shown as conventional blades 412 and cutting structures 414, the use of the DLP system 200, and other DLP system or the dynamic lateral cutter (DLC) system described below, may allow for customization of the blades 412 and cutting structures 414 to take advantage of the unique movement of the drill bit portion 401 caused by the DLP systems and DLC systems described herein.

FIG. 4B provides a cross-sectional view of DLP drill string 400 shown in FIG. 4A and illustrates the directional drilling action of drill string 490 in operation. In particular, because actuator $\mathbf{220}_1$ has moved axially downward due to the rotation of drill bit portion 401 relative to stationary axial cam sleeve 224 and ramped cam surface 225, pad $\mathbf{218}_1$ extends radially outward from blade $\mathbf{412}_1$ pressing against wellbore 452. Pad $\mathbf{218}_1$ provides force A pressing against wellbore 452. Force A results in pushing bit portion 401 in a direction opposite as shown by arrow B increasing the side cutting force of bit portion 401 against wellbore 452. As can be appreciated; pad $\mathbf{218}_1$, currently shown as extended radially in FIG. 4B, rotates 360° with bit 401 about longitudinal axis E. Pad $\mathbf{218}_1$ is extending the most directly opposite the direction an operator desires to steer the bit, which is the target direction, which target direction is typically associated with the scribe line as described above. Ideally, pad or pads 218 (including pad $\mathbf{218}_1$) are completely retracted and either inset or flush with the blade's axial wall or bit gauge 210 when the pad is oriented in the target direction, which is generally when aligned with the scribe line as described above. Depending on operating conditions, desired build, and formations associated with the wellbore, the pad $\mathbf{218}_1$ may not be directly opposite the target direction and scribe line but rather have the maximum extension offset less or more than 180° from the scribe line.

While not limiting, the direction in which the operator desires to steer the bit, or target direction, will be designated as 0° with drill string 490 stationary and oriented such that ramped cam surface 225 of axial cam sleeve 224 provides maximum extension of pad $\mathbf{218}_1$ at 180°, although as described above, operating conditions, desired build, and formations may alter the general case. As appreciated, the 0° target direction also may be aligned with the scribe line in certain embodiments. In other embodiments, the target direction of the bit may not be associated with a scribe line. As blade $\mathbf{412}_1$ rotates around longitudinal axis E, axial cam sleeve 224 moves actuator $\mathbf{220}_1$ down forcing outward movement of pad $\mathbf{218}_1$ from flush or inset to extended. Similarly, from 180° to 360°, the relative rotation of axial cam sleeve 224 allows actuator $\mathbf{220}_1$ to move up thus allowing pad $\mathbf{218}_1$ to move inward from maximum extension back to flush or inset. While described over a full rotation, pad $\mathbf{218}_1$ may extend only at 180° in certain embodiments. In other embodiments, pad $\mathbf{218}_1$ may be flush from 0° to 45° and from 315° to 360° (the pad is extended from 45° to 315°). In still other embodiments, pad $\mathbf{218}_1$ may be flush from 0° to 90° and from 270° to 360° (the pad extended from 90° to 270°). The range of motion for pad $\mathbf{218}_1$ is provided by axial cam sleeve 224 having a ramped cam surface 225. While described as symmetrical ranges, the ranges may be asymmetrical and rotationally offset as well. In addition, an oscillating cam profile can be provided such that the pad or pads may extend and retract partially or fully and may extend and retract multiple times during each rotation to add constant side force or pulsating side force or both in addition to the conventional forces pushing the cutters.

In addition to force A pushing to increase the side cutting force of bit portion 401 as shown by arrow B, force A literally moves bit portion 401, including a portion of drill string 400 laterally. This movement, coupled with the vibration created by repetitive extension and retraction of actuators 220 and pads 218 can potentially reduce friction between drill string 400, including the steerable motor (not shown), and wellbore 452 by breaking the static friction that normally occurs with non-rotating steerable motor system 10 (FIG. 1). Additionally, lateral movement of drill bit portion 401 and drill string 400 can potentially break a seal that can form between drill string 400 and formation 450 caused by differential sticking from over pressure of the drilling fluids in a permeable formation 450.

FIG. 4C provides a cross-sectional view of DLP drill string 491 to help illustrate a unique and highly beneficial supplemental bit motion provided by all the dynamic lateral pad system. Drill string 491 is identical to drill string 400 and drill string 490 (FIGS. 4A and 4B respectively) except drill string 491 (FIG. 4C) does not include bend 408 shown in FIGS. 4A and 4B. As previously described, because actuator $\mathbf{220}_1$ moves axially downward due to the rotation of drill bit portion 401 relative to stationary axial cam sleeve 224 and ramped cam surface 225, pad $\mathbf{218}_1$ extends radially outward from blade $\mathbf{412}_1$ pressing against wellbore 452. Pad $\mathbf{218}_1$ provides force A pressing against wellbore 452 and pushing bit portion 401 in a direction opposite as shown by arrow B. This increases the side cutting force of bit portion 401 acting against the sidewall of wellbore 452 while simultaneously moving the center of the bit laterally, as shown by arrow C, providing lateral cutting action at the center of wellbore 452. This lateral cutting action at the center of wellbore 452 reduces conventional drill bit inefficiencies by reducing or eliminating the possibility for pure drill bit portion 401 rotation that only fails rock by compressive failure. Moving the drill bit off its longitudinal axis provides a number of benefits over a conventional drill. One benefit is that conventional drill bits provided limited cutting forces at the geometric center of the drill bit, which is in part due to the lower rotational velocity of the cutting structures near the geometric center of the bit. The DLP system pushes the drill bit off the longitudinal axis and moves the geometric center of the drill bit as the drill operates. This also allows cutting structures with a higher rotational velocity (rpm) to drill the pile of formation that can build up at the center of the bit. While most beneficial with drilling systems without a bend like drill string 491, drill string 300, drill string 390 (FIG. 3A) and DRCS system 1000 (described below), drilling systems with a bend, like drill string 400, drill string 391, drill string 392 (FIG. 3B) and conventional drill string 12 (FIG. 1), also benefit.

As described above, pad 218 may be provided on a drill string with an integral drill bit/drive shaft or on a conventional steerable motor string having a drill bit coupled to a drive shaft with bit box described above. FIG. 5A provides a cross sectional view of a dynamic lateral pad (DPL) system 500 having a drive shaft 502 with bit box 504 at distal end 503 of drive shaft 502. Drill bit 506 with API connection 508 is coupled to bit box 504. Similar to drill bit portion 401 described above, drill bit 506 has a plurality of blades 510. Blades 510 have an axial outer wall 512 with pad hole 514 to receive pad 516. Blades 510 form channel 518 with bit box 504 into which radial cam sleeve 520 is operationally fitted. Drill bit 506, blades 510, outer wall 512, pads 514 and drive shaft 502 rotate together relative to the generally non-rotating cam sleeve 520, cam sleeve retainer 524 and drill string housing 522. Cam sleeve 520, in a manner similar to actuator 220 described above, moves pad 516 from a flush to an extended position, which pad 516 is currently shown extended. Cam sleeve 520 is coupled to drill string housing 522 by cam sleeve retainer 524. As previously presented, pad 516, presses against formation 550 providing a force shown by arrow A. Force A pushes the bit in a direction opposite as shown by arrow B. Also as previously presented, the cam action can provide symmetric, asymmetric or mixed motion.

FIG. 5B provides multiple end views of DLP string 500 in FIG. 5A showing the relative position of pad 516 in a progression of incremental 90 degree rotational steps by drill bit 506. While not limiting, the target direction in which the operator desires to steer the bit is shown by a double arrow T and will be designated as 0°. View 560 presents pad 516 positioned directly opposite target direction T at 180 degrees relative rotation, at maximum extension and pushing bit 506 in target direction T. As mentioned above, this exemplary embodiment describes the general case where the pad is extended a maximum distance directly opposite the target direction T. In certain embodiments, the maximum extension of the pad may be offset from 180 degrees. Also, for embodiments where the drill string has a bend or scribe line (as described above), the target direction T is generally aligned with the scribe line. As bit 506 rotates in direction R by 90 degrees into view 570, as shown by arrow $R_{90}$, rotationally stationary axial cam 520 allows extension of pad 516 to decrease as shown by arrow B. As bit 506 rotates an additional 90 degrees into view 580, for a total of 180 degrees displacement as shown by arrow $R_{180}$, pad 516 is oriented in target direction T but is not visible, as pad 516 has moved to the flush or inset position. Rotation into view 590, as shown by arrow $R_{270}$, extends pad 516 as shown by arrow C. Continued rotation to 360 degrees brings pad 516 back to the fully extended position shown by arrow A in view 560.

FIG. 6 shows DLP system 600 with multiple pads 608 having radial cam sleeve 602 that is operatively coupled and connected to the housing of drill string 610. Integral drill bit/drive shaft 604 rotates relative to the generally non-rotating (during steering of the bit) cam sleeve 602. Radial cam sleeve 602 fits around integral drill bit/drive shaft 604, above bit portion 601 to acts on pads 608. Radial cam sleeve 602 has continuous circumferential cam race 603 with variable radial width as shown by the cross sectional view in FIG. 6. Pad $\mathbf{608}_1$ is shown in an extended position while pad $\mathbf{608}_2$ is shown to be approximately flush. Radial width $W_1$ of cam race 603 on axial cam sleeve 602 is greater at pad $\mathbf{608}_1$ than the radial width $W_2$ of radial cam sleeve 602 at pad $\mathbf{608}_2$. The variable radial width of cam sleeve 602 may range from a minimum to a maximum. The minimum radial width would generally be located at the point closest to the direction in which the drill bit is to be pointed, whether a bent or straight drill string configuration; whereas, the maximum radial width would generally be located at a point opposite. As is well known by those familiar in the art, cam race 603 could be formed simply as an off center circle or profiled to better optimize pad 608 movement. Examples of potentially optimized pad 608 movement include steeper slopes for cam race 603 to provide more aggressive or faster movement of pad 608, non-symmetric pad movement and a plurality of full or partial pad 608 movements, in and out, per rotation.

FIG. 7 shows DLP system 700 with shank cam. As can be appreciated, DLP system 700 with shank cam includes integral drill bit/drive shaft 706 having drill bit portion 701, shank cam portion 702 and drive shaft portion 704. Shank cam portion 702 includes radial cam race 703 that encircles or partially encircles integral drill bit/drive shaft 706. Radial cam race 703 has variable radial width about the perimeter of integral drill bit/drive shaft 706 from a minimum radial width $W_4$ to a maximum radial width $W_3$. At maximum radial width $W_3$, pad 710 is extended to push against wellbore wall 752 a maximum amount to provide additional side force to actively steer the bit in the desired direction. At minimum radial width $W_4$, pad 710 is retracted by contact with well bore 752 to become flush or even slightly inset relative to the outer diameter of pad carrier 715 thus discontinuing the added side force to the drill bit. Pad 710 is physically positioned in slot 714 formed in pad carrier 715 and is operationally coupled to pad carrier 715 and shank cam portion 702 of integral drill bit/drive shaft 706. Pad carrier 715 allows radial movement of pad 710 and the combination of shank cam portion 702 and well bore 752 provides the radial locomotion. Integral drill bit/drive shaft 706 with shank cam portion 702 rotates relative to the generally non-rotating (during steering of the bit) pad 710 and pad carrier 715 that is fixedly connected to housing 716 and the drill string above (not shown) by retainer 716. Integral drill bit/drive shaft 706 is rotatably coupled to string housing 712 with bearing assembly 718 as is generally known in the art. As one of ordinary skill in the art would appreciate on reading the application, DLP system 700 could be implemented with a conventional bit coupled to a conventional drive shaft as described throughout the application.

An alternate embodiment to retain and retract pad 710 would provide for a "T" shaped or similar slot (not shown) fabricated into shank cam portion 702 with a complementary "T" shaped profile (also not shown) attached to pad 710. This would allow the cam to both push with cam race portion 703 to extend pad 710 and pull to retract pad 710 with the "T" slot. Additionally, a spring or springs (not shown) could be introduced between pad 710 and cam race portion 703 or pad 710 and pad carrier 715 to maintain continuous contact between pad 710 and wellbore 752. Conversely, a spring or springs (not shown) could be introduced between pad 710 and cam race portion 703 or pad 710 and pad carrier 715 to retract pad 710 away from wellbore 752 when cam race portion 703 is approaching a minimum position.

As described generally above, the DLP systems provide for a pad that is radially movable inward and outward with respect to the central longitudinal axis of the drill string housing. The DLP pad pushes against the wellbore to move the drill bit (or drill bit portion of the drill string) in an opposing direction that would generally be the desired direction to accomplish the drilling objectives whether a directional drill or a straight drill. In certain aspects, the DLP may push against the wellbore to position the drill bit to help mitigate harmful rotational patterns or vibration tendencies also supporting drilling efficiency gains. Combining the DLP systems with a bent housing and integral drill bit/drive shaft would further optimize this technical gain.

FIG. 8A shows a partial section view of DLC system 800 providing a plurality of Dynamic Lateral Pads (DLPs) and a plurality of Dynamic Lateral Cutters (DLCs). The basic DLC system 800 includes dynamic lateral pad with a cutter or series of cutters in certain aspects. As with the above, DLC system 800 is shown with integral drill bit/drive shaft 802 to reduce the overall distance between distal end 804 of drill string 806 and bend element 818. Integral drill bit/drive shaft 802 is rotatably coupled to drill string 806 by bearing assembly 832. While shown as with an integral drill bit/drive shaft 802 with drill bit portion 808 and drive shaft portion 810, DLC system 800 could also use a conventional drill bit and conventional drive shaft as described herein. DLC system 800 further comprises pad 812 having a cutting element or cutting assembly 814. Pad 812 is generally referred to as cutting pad 812 to distinguish from other pads as will be clear below. Cutting pad 812 is attached, in this exemplary embodiment, to a removable pad carrier and guide or cage 816. Removable cage 816 is similar to the blades described above, but rather than being machined into the drill bit portion of integral drill bit/drive shaft 802, cage 816 may be removed and replaced with a compatible alternate cage (not shown) allowing for greater operational flexibility and control regarding the location and number of pads that are radially positioned. Cage 816 may snap fit into a slot on integral drill bit/drive shaft 802 or, in other embodiments, cage 816 may be bolted, threaded, pinned, welded, chemically bonded or otherwise connected to integral drill bit/drive shaft 802.

Similar to embodiments described above, cutting pad 812 moves inward and outwardly based on an actuator, which, in this exemplary embodiment, is cam sleeve 820 having cutting pad cam race 822. Cam sleeve 820 is coupled to drill string 806 using retainer 824. Cutting pad cam race 822 may have a variable radial width similar to the widths described above, but not re-summarized here. The wellbore sidewall 852 would be subject to more cutting force the further outward cutting pad 812 extends and with greater numbers of cutter pads 812. DLC system 800's destruction of formation 850 and therefore movement of bit portion 808 would be in the direction of cutter pad 812 extension.

Further, DLC system 800 may have bearing pad or pads 826. The bearing pad is similar to the non-cutting pads described above and is referred to as a bearing pad as it does not including a cutting element. In this exemplary embodiment, the position of bearing pad 826 is controlled by a second actuator, bearing pad cam race 830, which is also part of cam sleeve 820. Bearing pad cam race 830 has a variable radial thickness generally 180 degrees out of phase with cutting pad cam race 822 such that bearing pad 826 pushes against the side of wellbore 850 a maximum amount when the opposite cutting pad 812 is exerting the maximum cutting force. As shown, cutting pad cam race 822 and bearing pad cam race 830 are provided on sleeve 820, but could alternatively be provided in separate sleeves, machined directly into drive shaft portion 810, or a combination thereof. Similarly, both pads could use an actuator similar to actuator 220 described with respect to FIG. 2 above. Based upon the above teaching, one ordinarily skilled in the art could easily see that many additional cam races driving many additional bearing pads and cutter pads, with similar or differing cutting structures, operationally in or out of phase or operationally independent of the other actuators could be implemented.

FIG. 8B shows an elevation view of an exemplary DLC system 800 with an odd number of blades 828 and removable cage (not visible) with cutting pad 812 and bearing pad 826 axially aligned with each blade 828. The exemplary elevation view shows a cutting pad $\mathbf{812}_1$, and bearing pads $\mathbf{826}_3$ and $\mathbf{826}_4$ in extended positions providing a direct, balanced and generally stable resultant force from the combination of force $A_3$ and force $A_4$. The resultant of force $A_3$ and force $A_4$ moves drill bit, and therefore the wellbore to be drilled, in the desired direction by providing added side force to drill bit portion 808 plus cutting force $B_1$ from cutting pad $\mathbf{812}_1$ with cutter $\mathbf{814}_1$ to independently scrape or crush the wellbore sidewall (not specifically shown). Based upon the above teaching, one ordinarily skilled in the art could easily see that this could also extend to DLC systems with a plurality of asymmetrically mounted bearing and cutting pads and to DLC systems with an odd or even number of blades with or without a plurality of cutting pads and/or bearing pads.

In the exemplary embodiment of a five (5) bladed DLC system 800 described by the combination of FIGS. 8A and 8B, first cam race 822 is provided to drive cutter pads 812 and second cam race 830 is provided to drive bearing pads 826. In this embodiment and with appropriate profiles for cutting pad cam race 822 and bearing pad cam race 830, as integral drill bit/drive shaft 802 rotates relative to cam sleeve 820, bearing pad cam race 830 approaches and extends bearing pad $\mathbf{826}_3$ in advance of bearing pad $\mathbf{826}_4$ potentially introducing additional rock cutting actions. With cutting pad $\mathbf{812}_1$ also extended, the earlier extension of bearing pad $\mathbf{826}_3$ will cause bit portion 808 and cutter pad $\mathbf{812}_1$ to potentially tip and change the angle of attack of cutter $\mathbf{814}_1$ As bit portion 808 continues rotation, bearing pad cam race 830 rotates under, and extends bearing pad $\mathbf{826}_4$ to bring the angle of attack of cutter $\mathbf{814}_1$ back to neutral. Similarly, with continued rotation, bearing pad $\mathbf{826}_3$ retracts before bearing pad $\mathbf{826}_4$ causing bit portion 808 and cutter pad $\mathbf{812}_1$ to potentially tip and change the angle of attack of cutter $\mathbf{814}_1$ in the reverse direction. Depending on the specific profiles of cutting pad cam race 822 and bearing pad cam race 830 similar tipping action could be created by the cutting pads.

Referencing FIG. 8B, simultaneous extension of bearing pad $\mathbf{826}_3$ and bearing pad $\mathbf{826}_4$, or any pair of pads, can be provided by introducing a second bearing pad cam race with identical profiles but out of phase, by ⅕ of a revolution (for a 5 bladed system). This would cause both bearing pads to extend and retract in unison. Based upon the above teaching, one ordinarily skilled in the art could easily see the possibility of additional cam races, additional cutter pads and additional bearing pads, limited only by the space, particularly length required to fit the components. In addition, one ordinarily skilled in the art could easily see that pad profiles can be manipulated to extend, retract, hold and oscillate in an almost limitless number of permutations and combinations while controlling both the amount of lift and timing. Further, the pads could also contain sensors that extend and retract.

Rocker arms (not shown) provide another alternative actuator allowing multiple actuators to operate simultaneously off a single reference, like a cam. In addition, a rocker arm actuator, hinged between an input of force and the output, reverses the direction of motion like a teeter-totter; a rocker arm actuator can be used to operate both a cutter pad and bearing pad from a single cam race. In another embodiment, a single cam could be used to drive a hydraulic pump, the output of which could be ported to any number of hydraulic actuators.

DLC system 800 (FIG. 8A) provides moveable lateral cutting structures opposite one or more moveable lateral pads providing enhanced cutting aggressiveness, primarily with side cutting action, to support the directional change capability in directional wells and in vertical wells where the objective is to stay close to vertical. DLC system 800 in vertical wells, associated or not with an optimized fixed cutting design, would be used to nudge the wellbore back to vertical when the wellbore has drifted off the planned vertical axis. As extension of the pad is controllable based on orientation, location, width of the actuator, profile of the cam race or the like acting on the pad, the extension of a pad can be used to enhance or negate/offset aggressiveness of angular deviation of a drill bit while initially drilling a wellbore or correct unwanted deviations for after the initial drilling of a wellbore section. In certain aspects, as described above, the pad may include a cutting element and, as a pad pushes against the wellbore, a cutter or series of cutters in an opposing pad or cutter assembly may destroy rock in the opposing section of the wellbore.

Previously, all pad hole extension paths for DLP systems (200, 400, 500) and DLP/DLC system 800 were oriented perpendicular to the axis of rotation and all pad faces were oriented parallel to the axis of rotation. In certain applications, changes to the pad hole extension axis and changes to pad face orientation can improve system overall performance. Using DLP system 500 as exemplary, FIG. 9 shows enlarged views of a base pad mechanism 900, consistent with pad hole extension path $P_1$ perpendicular to axis of rotation A and pad face $\mathbf{518}_1$ orientation parallel to axis of rotation A as presented in each of the exemplary embodiments presented above. Also shown in FIG. 9 is a second exemplary pad mechanism 920 that adds to base pad mechanism 920, pad face $\mathbf{518}_2$ that is closer to parallel with well bore 552. FIG. 9 also includes a third exemplary pad mechanism 940 that reorients hole pad extension axis $P_3$ to provide pad face $\mathbf{518}_3$ that is closer to parallel with well bore 552. A fourth exemplary pad mechanism 960 significantly reorients hole pad extension axis $P_4$ while providing pad face $\mathbf{518}_4$ close to parallel with well bore 552 with possible modifications to better grip well bore 552 described later.

Referring to FIG. 9, base pad mechanism 900 includes pad $\mathbf{516}_1$ that is constrained by pad hole $\mathbf{514}_1$ to limit motion to the radial direction. Pad hole $\mathbf{514}_1$ is contained in axial outer wall 512, part of drill bit 506. Pad $\mathbf{516}_1$ translates along pad hole axis $P_1$ that extends radially, perpendicular to axis of rotation A of drill bit 506. Pad $\mathbf{516}_1$ extends and retracts as cam sleeve 520 rotates under pad cam face $\mathbf{519}_1$ that is parallel to the curvature of pad well bore face $\mathbf{518}_1$. As previously discussed, when DLP system 500 includes a bend (not shown), axis of rotation A of drill bit 506 is offset from the drill string axis and therefore well bore 552 by a magnitude close to the magnitude of the bend angle. When loaded during the directional drilling process, the tilt of drill bit rotation axis A typically increases and may more than double the unloaded tilt depending on such things as the well bore geometry, load applied and the geometry of the associated drilling equipment. Assuming the tilt of rotation axis A is doubled relative to the bend angle, results in a misalignment angle $\varphi_1$ between pad well bore face $\mathbf{518}_1$ and well bore 552 that is twice the bend angle. Misalignment between pad well bore face $\mathbf{518}_1$ and well bore 552 can add wear to pad $\mathbf{516}_1$ and cause rock destruction at the contact point, directly opposite the target direction. The item numbers included but not cited are provided as reference to tie back to DLP system 500 (FIG. 5A).

Again referencing FIG. 9, second pad mechanism 920 is virtually identical to base pad mechanism 900 with the exception that pad well bore face $\mathbf{518}_2$ of pad $\mathbf{516}_2$ is profiled to be more generally parallel to well bore 552 under load. Using the previous example of a bend in the assembly and the assumption that, under load, the tilt of rotation axis A is doubled relative to the bend angle; leads to profiling the angle of pad well bore face $\mathbf{518}_2$ by twice the angle of the bend.

Continuing to reference FIG. 9, third pad mechanism 940 creates pad well bore face $\mathbf{518}_3$ of pad $\mathbf{516}_3$ that is generally parallel to well bore 552 by rotating pad hole axis $P_3$ from perpendicular as shown by angle $\theta_3$. Assuming again a bend in the assembly and, when under load, the tilt of rotation axis A is doubled relative to the bend angle; leads to rotating pad hole axis $P_3$ from perpendicular by twice the angle of the bend. While addressing possible wear to pad $\mathbf{516}_3$ and unintended rock destruction directly opposite of the target direction, this mechanism reduces force delivered to pad $\mathbf{516}_3$ by the sine of the angle of pad hole axis $P_3$ rotation unless the profile of the cam pad face $\mathbf{519}_3$ is at least partially conical to be parallel to pad well bore face $\mathbf{518}_3$ and the cam sleeve 520 profile matches the profile of cam pad face $\mathbf{519}_3$.

Fourth pad mechanism 960 contains all the parts of the three preceding mechanisms but adds a new dimension to pad action. By further rotating pad hole axis $P_4$ from perpendicular as shown by angle $\theta_4$, that is greater than the tilt of rotation axis A under load, pad $\mathbf{516}_4$ can be used to simultaneously push the bit sideways and momentarily push drill bit 506 along the axis of rotation A. To achieve optimal results in some applications, for example in hard competent formations, improvements could be provided in the pad well bore face $\mathbf{518}_4$ to reduce pad $\mathbf{516}_4$ slippage relative to formation 550. There are many ways to decrease the probability that pad $\mathbf{516}_4$ will slip relative to formation 550 including adding a rubber pad to pad well bore face $\mathbf{518}_4$, under or over rotating pad hole axis $P_4$ in relation to pad well bore face $\mathbf{518}_4$ to promote a geometry that tends to gouge formation 550 (the reverse objective of second pad mechanism 920 and third pad mechanism 940) and introducing hardened steel, carbide, PDC or like teeth to pad well bore face $\mathbf{518}_4$ Although, all pads might visually appear as "not sealed" and as having sharp edges, this should not be considered to be in any way limiting. Each alternative such as sealing, or not, and edge details such as sharp, tapered, chamfered, well rounded and half dome bring potential advantages and disadvantages to be considered relative to the specific implementations and drilling objectives.

FIG. 13 provides a section view of drill string 1300 with Dynamic Lateral Pad (DLP) inclusive of conventional bit 14 at distal end 1352. In this exemplary embodiment, drill string 1300 includes the components described by drill string 12 (FIG. 1) as positioned above bearing package 24 with the possible exception of bend 35 that may or may not be included depending on the desired aggressiveness of the drilling objectives. Returning to FIG. 13, drill string 1300 also includes bearing housing 1322 connected to the distal end of transmission housing 36 (FIG. 1) and drive shaft 1302 inclusive of bit box 1304 and cam race 1303 connected to the distal end of transmission drive line 38 (FIG. 1). Drill bit 14 is connected to bit box portion 1304 of drive shaft 1302 by API connection 37. Drill string 1300 further includes pad carrier 1320 with raised section 1326, slot 1321, mounting provisions 1329 for pad hinge pin 1318, and torsion lock pin 1323 to engage axial slot 1325 cut into bearing housing 1322 to prevent rotation of pad carrier 1320 relative to bearing housing 1322. Pad carrier 1320 is fixedly mounted to bearing housing 1322 with retainer 1324 and torsion lock pin 1323. Pad assembly 1314 is comprised of pad 1316, cam follower 1315 and elastic element 1327. Pad 1316 includes hinge portion 1317, and mounting provisions 1328 to operationally attach hinge pin 1318. Pad assembly 1314 is operationally positioned in slot 1321 with a hinged connection to pad carrier 1320 and contacting cam race 1303 with cam follower 1315 of pad assembly 1316.

While similar to DLP system 700 (FIG. 7), drill string 1300 with Dynamic Lateral Pad (FIG. 13) incorporates conventional drill bit 14, with hinged reciprocating pad assembly 1314 and adds compliance 1327 in pad assembly 1314 drive mechanism. As one of ordinary skill in the art would appreciate on reading this application, DLP system 1300 could also be implemented with integral drill bit/drive shaft as described throughout the application.

Drill string 1300 with Dynamic Lateral Pad includes radial cam race 1303 that encircles the outer perimeter of bit box portion 1304 of drive shaft 1302. During steering of the drill string, drill bit 14 and drive shaft 1302 including cam race 1303 rotate relative to the generally non-rotating (during steering of the drill bit) pad assembly 1314, pad carrier 1320, retainer 1324, housing 1322 and the remaining drill string components (not shown) terminating at the proximal end generally at or near the surface of the earth. The radial thickness of radial cam race 1303 alternates between one or more minimum and maximum thicknesses and the profile of cam race 1303 may include one or more cam race profile features including all of the types presented elsewhere in this application. As previously discussed, at maximum cam race 1303 radial thickness, pad assembly 1314 is fully extended to push against the wellbore wall of formation 1350 to steer the bit in the desired direction. However, in this embodiment an elastic element 1327 such as a rubber pad, Belleville washers or machine springs is located between cam follower 1315 and pad 1316 to provide compliance in the actuator, to limit pad assembly 1314 force and allow pad assembly 1314 to temporarily collapse to prevent potential interference between drill string 1300 with Dynamic Lateral Pad and formation 1350.

View 1391 is a section view of pad assembly 1314 interacting with formation 1350 at three positions. Position 1 illustrates a fully retracted pad assembly 1314 with cam race 1303 at a minimum and presenting pad 1316 to be flush or possibly slightly inset with respect to the outer diameter of raised section 1326 of pad carrier 1320. In position 1, force $A_L$ and added resultant force $B_L$ are zero and axis of rotation $CL_1$ is in a neutral position generally near the center of borehole $CL_B$ and not affected by pad extension. Position 2 illustrates extended pad assembly 1314 with the radial thickness of cam race 1303 approaching or at a maximum. Pad 1316 of pad assembly 1314 is pressing against formation 1350 but elastic element 1327 has not been compressed beyond the pre-load force of elastic element 1327. In position 2, force $A_L$ is a function of such things as drill string mechanics, hole angle and bit characteristics but, in position 2 elastic element 1327 was defined to be not compressed beyond the pre-load force, therefore the magnitude of force $A_L$ and added resultant force $B_L$ are limited to the magnitude of the preload on elastic element 1327. In position 2, axis of rotation $CL_2$ is offset from neutral position $CL_B$ in the target direction by the length of pad assembly 1314 extension due to the increased radial thickness of cam race 1303. Position 3 illustrates extended pad assembly 1314 with cam race 1303 at a maximum thickness with pad assembly 1314 fully collapsed and sharing the lateral load with raised section 1326 of pad carrier 1320. In position 3, the magnitude of force $A_L$ is equal to the force required to fully collapse pad assembly 1314 but is largely irrelevant as the drilling actions and conditions, largely irrespective of pad assembly 1314 force $A_L$, are controlling the forces on the bit including added force $B_L$. Additionally, axis of rotation $CL_3$ has returned to near "neutral" position $CL_B$ just offset by clearance distance D' that is equal to distance D, the distance between raised section 1326 and wall of formation 1350 at position 1.

View 1390 is an isometric view of the distal end of drill string 1300 with Dynamic Lateral Pad. This view shows pad 1316 with hinge pin 1318 oriented parallel to drill string 1300 axis of rotation CL. Hinge pin 1318 is supported by mounting provisions 1329 as are well known in the art. Hinge pin 1318 mounting provisions 1329 are located as shown in raised section 1326 of pad carrier 1320. Hinge pin 1318 is also connected using well-known mounting provisions 1328 as part of pad 1316. In operation, pad 1316 pivots on hinge pin 1318 allowing controlled radial movement of pad assembly 1314 as cam race 1303 rotates under and then away from cam follower 1315.

FIG. 14 provides a section view of drill string 1400 with Dynamic Lateral Pad (DLP) with a magnetic actuator and conventional bit 14 at distal end 1452. Similar to drill string 1300 described above, drill string 1400 includes the components described by drill string 12 (FIG. 1) positioned above bearing package 24 with the possible exception of bend 35 that may or may not be included depending on the desired aggressiveness of the drilling objectives. Returning to FIG. 14, drill string 1400 also includes bearing housing 1322 connected to the distal end of transmission housing 36 (FIG. 1) and drive shaft 1402, inclusive of bit box 1404 and magnets 1412 and 1414, connected to the distal end of transmission drive line 38 (FIG. 1). Drill bit 14 is connected to bit box portion 1404 of drive shaft 1402 by API connection 37. Drill string 1400 further includes pad carrier 1420 with slot 1421. Operationally positioned in slot 1421 is pad 1416 including magnet 1413 and containing hinge portion 1418 with fixed mounting provision 1419 fixedly connecting pad hinge portion 1418 to pad carrier 1420. Pad carrier 1420 is fixedly mounted to bearing housing 1322 with retainer 1324 and torsion lock pin 1323 engaging axial slot 1325 cut into bearing housing 1322.

While sharing many components with DLP drill string 1300 (FIG. 13), and providing similar pad extension and retraction as DLP drill string 1300, drill string 1400 with Dynamic Lateral Pad utilizes fixed mounting provision 1419, which may be a weld, adhesive, chemical bonding, or the like to fixedly connect cantilevered spring hinge portion 1418 of pad 1416 to pad carrier 1420 and utilizes a magnetic drive mechanism to provide locomotion for reciprocating pad 1416. The magnetic drive, described below, provides a non-contacting and compliant drive mechanism. As one of ordinary skill in the art would appreciate on reading this disclosure, the DLP system 1400 could also be implemented with integral drill bit/drive shaft as described throughout the application.

Drill string 1400 with Dynamic Lateral Pad includes a magnetic actuator to extend pad 1416. Pad magnet 1413 is fixedly attached to pad 1416 with north magnetic field $N_P$ of pad magnet 1413 orthogonal to and oriented away from axis of rotation CL. Extend magnet 1412 is fixedly attached to bit box portion 1404 of drive shaft 1402 with north magnetic field $N_E$ of extend magnets 1412 orthogonal to but oriented in the direction of axis of rotation CL. As drill bit 14 and drive shaft 1402 including bit box portion 1404 and extend magnet 1412 rotate relative to the generally stationary (while directional drilling) pad carrier 1420, pad 1416 including pad magnet 1413, retainer 1324 and bearing housing 1322; extend magnet 1412 rotates under pad 1416 and pad magnet 1413. Because the polarity of pad magnetic field $N_P$ is opposed to the polarity of extend magnetic field $N_E$, as proximity and alignment of pad magnet 1413 and extend magnet 1412 increase, pad 1416 is forced outwardly with force A to push against the formation creating an opposing force B in drill bit 14 to steer the bit in the desired direction. As extend magnet 1412 rotates away from pad magnet 1413, alignment and proximity decrease and the magnetic force decreases. As one of ordinary skill in the art will now recognize on reading the disclosure, additional extend magnets 1412 positioned on the perimeter of the bit box portion, or magnets with a longer arc length could be used to apply force to extend the pad for a longer portion of the revolution. Conversely, a magnet or magnets with a shorter arc length could be used to apply force to extend the pad for a lesser portion of drill bit 14 revolution. Once extend magnet 1412 sufficiently clears pad magnet 1413, either cantilevered spring hinge portion 1418 or the formation (not shown) or both act to retract pad 1416 to the withdrawn position. Compliance is provided by mechanical fit as, by design, clearance is always provided between extend magnet 1412 and pad magnet 1413, even if pad 1416 and pad magnet 1413 do not move as extend magnet 1412 rotates under pad 1416 and pad magnet 1413. Maintaining clearance, regardless of the orientation of extend magnet 1412 and pad magnet 1416 prevents the creation of an interference condition between drill string 1400 with Dynamic Lateral Pad and the formation (not shown). Magnets materials for these embodiments include but are not limited to iron, ferromagnets, rare earth magnets such as samarium-cobalt and neodymium-iron-boron (NIB) and electromagnets. Magnets are attached using one or more means such as a chemical adhesive, mechanical fastener or interference fit In addition to cantilevered spring hinge portion 1418 or the formation (not shown) or a combination of both acting to retract pad 1416 to the withdrawn position, a third method to retract pad 1416 is possible by use of one or more retract magnets 1414 also mounted on the perimeter of bit box portion 1404 of drive shaft 1402 with north magnetic fields $N_R$ orthogonal to and oriented away from the direction of axis of rotation CL (the opposite orientation as extend magnet 1412). As drill bit 14 and drive shaft 1402 including bit box portion 1404 and retract magnets 1414 rotate relative to the generally stationary (while directional drilling) pad carrier 1420, pad 1416 with pad magnet 1413, retainer 1324 and bearing housing 1322; retract magnets 1414 rotate under pad 1416 and pad magnet 1413. Because the polarity of pad magnetic field $N_P$ is congruent with the polarity of retract magnetic field $N_R$, as proximity and alignment of pad magnet 1413 to retract magnets 1414 increase, pad 1416 is attracted inwardly towards the retract magnets. Conversely, as retract magnet 1414 rotates away from pad magnet 1413, alignment and proximity decrease and the magnetic force decreases.

FIG. 14 provides a section view of drill string 1400 with Dynamic Lateral Pad (DLP) with extend magnet 1412 rotationally positioned such that pad magnet 1413 of pad 1416 and extend magnet 1412 are face to face providing magnetic force to extend pad 1416. View 1491 provides a section view of the actuator section of drill string 1400 with Dynamic Lateral Pad rotated 180 degrees and therefore rotationally positioned such that pad magnet 1413 of pad 1416 faces retract magnet 1414 retracting pad 1416. View 1492 is a cross sectional cut through the center of pad magnet 1416 providing an exemplary magnet configuration providing about 45 degrees of extension and 300 degrees of retraction. View 1490 is an isometric view of the distal end of drill string 1400 with Dynamic Lateral Pad further showing carrier slot 1421 and pad hinge portion 1418 with fixed mounting provision 1419 such as, but not limited to a weld or brazed joint fixedly connecting pad hinge portion 1418 and pad carrier 1420. Alternatively, the pad and the carrier could also be manufactured as a single piece using for example steel tubing, steel bar or a metal casting.

FIG. 15 shows a section view of drill string 1500 with DLP and an axial hinged pad. Drill string 1500 is essentially identical to drill string 1300 (FIG. 13 above) with a few notable exceptions. One exception is drill string 1500 provides a pad 1516 mounted on pad carrier 1520 that is mounted parallel to axis of rotation CL as opposed to the embodiment provided in drill string 1300 where pad 1316 is mounted about the outer circumference of pad carrier 1320. Between the circumferential pad mounting provided in in drill string 1300 and the axial pad mounting provided in drill string 1500, one of ordinary skill in the art will now recognize, on reading the disclosure that, the orientation of a hinged reciprocating pad is not constrained to a single orientation. In addition to a circumferential orientation provided in drill string 1300 and axial orientation provided in drill string 1500 above, one of ordinary skill in the art will now recognize that a hinged pad can be implemented at virtually any angle about a physical or virtual cylinder, such as the pad carrier. Examples include a pad such as pad 1516 on drill string 1500 rotated, with carrier slot 1521, 180 degrees along axis of rotation CL resulting in pad hinge 1518 mounted closer to distal end 1552 of drill string 1500. Similarly, while never intended to be limiting, pad 1316 of drill string 1300 is shown with hinge pin 1318 leading rotation but hinge pin 1318 and the requisite mounting provisions could be flipped 180 degrees on the horizontal with hinge pin 1318 trailing rotation. Further, the pad could be rotated at virtually any angle off horizontal or off axis of rotation CL and could have a plurality of hinges. Alternative orientations for hinge mounting allow for the potential to improve operational mechanics specific to a given drilling environment. Examples include; more abrupt or less abrupt pad extension and retraction, larger pad area in the generally cylinder volume, longer hinge portions within a given space allowing for more complex extension and retraction mechanism such as providing a fulcrum, adding compliance, and creating an alternative pad extension vector that is more effective at rock removal than just the added side load previously explained.

Another exception of drill string 1500 as compared to is drill string 1300 is drill string 1500 includes hinge portion 1518 of pad 1516 fixedly attached to carrier 1520, in this case weld 1519, as previously presented as part of drill string 1400. Another possible exception of drill string 1500 as compared to drill string 1300 is use of a non-descript cam follower 1515 that could be compliant or not. Also, the actuator could be of a type consistent with the magnet system presented as part of drill string 1400, other actuators presented earlier or following in this application and actuator alternatives that one of ordinary skill in the art will now recognize on reading the disclosure. FIG. 15 also includes view 1590, an isometric view of the distal end of drill string 1500 with Dynamic Lateral Pad identifying carrier slot 1521.

FIG. 16A provides a section view of drill string 1600 with drill bit mounted Dynamic Lateral Pad (DLP). In this exemplary embodiment, drill string 1600 includes the components described by drill string 12 positioned above bearing package 24 with the possible exception of bend 35 (FIG. 1) that may or may not be included depending on the desired aggressiveness of the drilling objectives. Returning to FIG. 16A, drill string 1600 also includes bearing housing 1322 connected to the distal end of transmission housing 36 (FIG. 1) and drive shaft 1602 inclusive of bit box 1604 connected to the distal end of transmission drive line 38 (FIG. 1). Drill bit 1606 is connected to bit box portion 1604 of drive shaft 1602 by API connection 37. Drill string 1600 further includes cam sleeve 1620 and torsion lock pin 1323 to engage axial slot 1325 cut into bearing housing 1322 and cam sleeve 1620 that is fixedly mounted to bearing housing 1322 with retainer 1324 and torsion lock pin 1323 to prevent relative rotation between cam sleeve 1620 and bearing housing 1322. The distal end of cam sleeve 1620 terminates with an external cam profile 1603 on the outer surface of cam sleeve 1620. In addition to multiple drill bit cutters 1612 shown as PDC type and more thoroughly described above, drill bit 1606 includes hinge pin 1618, a possible supplemental pad 1616 retraction apparatus (not shown) and pad 1616 with cam follower portion 1617. Pad 1616 swings on hinge pin 1618 and is operationally coupled to external cam race 1603 of cam sleeve 1620 at cam follower portion 1617. Although not shown in FIG. 16A, exemplary supplemental pad retraction apparatus include, but are not limited to, springs, magnets and scavenging hydraulics from mud-flow. An example supplemental pad retraction apparatus is shown as spring 1725 in FIG. 17. Similar to previous discussions, cam race 1603 varies in radial thickness about the perimeter of cam sleeve 1603 causing pad 1616 to extend and retract by rotating in and out on hinge pin 1618. Consistent with previous cam race descriptions, it is possible to have multiple undulations and multiple cam races with differing radial thicknesses and slopes.

Very similar to DLP string 600, cam sleeve 1620 of drill string 1600 is fixedly attached to bearing housing 1322 but the cam sleeve and bearing housing could also be made to be integral or as one piece. As in previous embodiments, bearing housing 1322 is fixedly connected to the drill string components above (not shown) and are oriented as required to cause bit 1606 to advance drill string 1600 in the desired direction when drill bit 1612 is rotated and weight is applied. Cam sleeve 1620, bearing housing 1322 and the drill string above (not shown) are generally not rotating during directional drilling. As previously discussed, to advance drill string, mud (not shown) is pumped from the surface through drill string 1600 to cause rotor 30 (FIG. 1) to rotate drive shaft 1602 and drill bit 1606 relative to cam sleeve 1620 and bearing housing 1322. As drill bit 1606 rotates, pad 1616 pivots on hinge pin 1618 due to cam follower portion 1617 of pad 1606 reacting to the changing radial thickness of cam race 1603. As the thickness of cam race 1603 increases, pad 1606 rotates outward towards the formation wall (not shown) in the direction of arrow A. Upon contact to the formation wall (not shown) the outward rotation of pad 1616 pushes bit 1606 in the opposite direction as shown by arrow B. The added force results in additional formation removal in the direction of arrow B. Drill string 1600 in FIG. 16A illustrates pad $\mathbf{1616}_E$ outwardly rotated on pin 1618 in an extended position with cam follower portion 1617 of pad 1606 positioned at cam race $\mathbf{1603}_E$ oriented to a maximum thickness. Conversely, view 1691 illustrates cam race $\mathbf{1603}_R$ at a minimum thickness with pad $\mathbf{1616}_R$ and rotated to the retracted position. In this example, pad 1616 contact with the formation wall (not shown) causes retraction of pad 1616 as the bit rotates away from a maximum thickness of cam race 1603. View 1690 is an isometric view of the distal end of drill string 1600.

FIG. 16B shows drill string 1692 as identical to drill string 1600 (FIG. 16A) except drill string 1692 includes pad cutters 1614 on pad $\mathbf{1616}_C$ (shown as $\mathbf{1616}_{CE}$ and $\mathbf{1616}_{CR}$). Operationally, drill string 1692 and drill string 1600 are identical as extended pad $\mathbf{1616}_{CE}$, upon contact with the formation wall (not shown), the outward rotation of pad 1616 as shown by arrow A pushes bit 1606 in the opposite direction causing added formation removal in the direction of arrow B. However, when pad $\mathbf{1616}_C$ is in the extended position, cutters 1614 on pad $\mathbf{1616}_C$ of drill string 1692 also cause added formation removal in the direction of arrow A. Drill string 1692 in FIG. 16B illustrates pad $\mathbf{1616}_{CE}$ rotated and extended with cam follower portion 1617 of pad 1606 positioned at cam race $\mathbf{1603}_E$ that is oriented at a maximum thickness. Conversely, view 1694 illustrates cam race $\mathbf{1603}_R$ at a minimum thickness with pad $\mathbf{1616}_{CR}$ rotated to the retracted position. View 1693 is an isometric view of the distal end of drill string 1692. While drill string 1600 shows bit mounted hinged pad 1616 to be axially mounted, one of ordinary skill in the art will now recognize on reading the disclosure that a bit mounted hinged pad could be formed as a partial helix (pure or a segmented approximation) and hinged at an angle provided the retracted pad does not radially extend beyond a cylinder formed by bit gauge 210 (FIG. 2) and the helix does not wrap than about 45 degrees about the perimeter of the cylinder also formed by bit gauge 210.

FIG. 17 provides a section view of drill string 1700 with a moveable blade in the drill bit. In this exemplary embodiment, drill string 1700 includes the components described by drill string 12 positioned above bearing package 24 with the possible exception of bend 35 (FIG. 1) that may or may not be included depending on the desired aggressiveness of the drilling objectives. Returning to FIG. 17, drill string 1700 also includes bearing housing 1322 connected to the distal end of transmission housing 36 (FIG. 1) and drive shaft 1702 inclusive of bit box 1704 connected to the distal end of transmission drive line 38 (FIG. 1). Drill bit 1706 is connected to bit box portion 1704 of drive shaft 1702 by API connection 37. Drill string 1700 further includes cam sleeve 1720 and torsion lock pin 1323 to engage axial slot 1325 cut into bearing housing 1322 that is fixedly mounted to bearing housing 1322 with retainer 1324 and torsion lock pin 1323. The distal end of cam sleeve 1720 terminates with an internal cam profile 1703 on the inner surface of cam sleeve 1720. In addition to multiple fixed blades 1728 with cutters shown as PDC type and more thoroughly described above, drill bit 1706 also includes a moveable bit blade 1716 with cam follower portion 1717, hinge pin 1718, and may include a supplemental retraction apparatus 1725. Moveable blade 1716 pivots on hinge pin 1718 and is operationally coupled to internal cam race 1703 of cam sleeve 1720. Similar to previous discussions, cam race 1703 varies in thickness about the perimeter of cam sleeve 1720 causing moveable bit blade 1716 to extend and retract by rotating in and out on hinge pin 1718. Consistent with previous cam race descriptions, it is possible to have multiple undulations and multiple cam races with differing thickness and slopes. While in this exemplary embodiment supplemental pad retraction apparatus 1725 is shown as a single coiled spring, the supplemental pad retraction apparatus could include a plurality of devices including different spring types, magnets, scavenged hydraulics from mud flow or U shaped cam follower, the later to mechanically extend and retract blade 1716.

Similar to drill string 1600 (FIG. 16A), cam sleeve 1720 of drill string 1700 is fixedly attached to bearing housing 1322, or could be manufactured as a single piece, and the drill string components above (not shown) are oriented as required to cause bit 1706 to advance drill string 1700 in the desired direction when drill bit 1706 is rotated and weight is applied. Cam sleeve 1720, bearing housing 1322 and the remaining drill string components mounted above (not shown) are generally not rotating during directional drilling. As previously discussed, to advance drill string, drilling mud (not shown) is pumped from the surface through drill string 1700 to cause rotor 30 (FIG. 1) to rotate drive shaft 1702 and drill bit 1706 relative to cam sleeve 1720. As drill bit 1706 rotates, moveable bit blade 1716 pivots on horizontal hinge pin 1718 due to cam follower portion 1717 of moveable bit blade 1706 reacting to the changing thickness of cam race 1703. As the thickness of cam race 1703 increases moveable bit blade 1716 above hinge pin 1718 rotates inward, away from the formation wall (not shown) in the direction of arrow $D_{IN}$ compressing coil spring 1725. With hinge pin 1718 acting as a fulcrum, the lower portion of moveable bit blade 1716 moves outwardly towards the formation (not shown) by the relationship: travel distance out $D_{OUT}$=travel distance in $D_{IN}*L_2/L_1$ where $L_1$ is the distance from the center line of hinge pin 1718 to the contact point between cam race 1703 and cam follower portion 1717 and $L_2$ is the distance from the center line of hinge pin 1718 to the cutter of interest. Outward motion $D_{OUT}$ increases the rate of formation removal in the direction of arrow $D_{OUT}$ for the portion of bit rotation where moveable bit blade 1716 is extended. As drill bit 1706 continues to rotate, cam race 1703 moves away from maximum radial thickness allowing moveable bit blade 1716 above hinge pin 1718 to rotate outwardly driven by contact with the formation (not shown), spring 1725 or both. By now, one of ordinary skill in the art will now recognize on reading the disclosure that more than one moveable blades 1716 could be implemented in a given drill bit, there could be multiple types of actuators such as those detailed above and moveable bit blade 1716 could be implemented, similar to moveable pad 1616, at an angle as a pure or segmented helix within the limits detailed for drill string 1600. In addition, also presented above, an integral bit/drive shaft could replace the conventional bit and drive shaft with all the incumbent advantages described earlier.

Drill string 1700 in FIG. 17 illustrates moveable bit blade $\mathbf{1716}_E$ rotated to extend cutters 1714 out into the formation (not shown) with cam follower portion 1717 of pad 1706 located at a maximum thickness of cam race $\mathbf{1703}_E$. View 1790 is an isometric view of the distal end of drill string 1700.

FIG. 18 provides a section view of the distal end of drill string 1800, an isometric view 1890 of the distal end of drill string 1800, end view 1891 and cross section view 1892 cutting through eccentric mud motor bearing housing 1822 at pocket portion 1824 and cover 1848. In this exemplary embodiment, drill string 1800 includes all the components described by drill string 12 positioned above bearing package 24 with the possible exception of bend 35 (FIG. 1) that may or may not be included depending on the desired aggressiveness of the drilling objectives. Returning to FIG. 18, drill string 1800 also includes an eccentric bearing housing 1822 with pocket portions 1824, axial bearings 1840, lateral bearings 1842, electronics 1826, and cover 1848 fixedly connected to the distal end of transmission housing 36 (FIG. 1). In addition, drill string 1800 includes integral drill bit/drive shaft 1802 with drive shaft portion 1803 and drill bit portion 1801 fixedly connected to the distal end of transmission drive line 38 (FIG. 1) and rotatably coupled with eccentric bearing housing 1822 with bearings 1840 and bearings 1842. Bearing housing 1822 is machined eccentrically, cast, forged or otherwise formed so that one side provides substantially more wall thickness but does not exceed the well bore diameter (not shown). The additional thickness created by this innovation may run the full axial length of the bearing housing or any portion there-of and extend circumferentially from 10 to 160 degrees. The additional thickness may also be used to house an extendable pad, which could directionally drive the drilling assembly towards a target, as well as sensors or electronics to measure drilling parameters, batteries to power electronics, chemical sources or any combination of the afore mentioned.

Use of pockets containing electronics, sensors, chemical sources and batteries in an eccentric housing above the bearing housing is relatively common but this improvement provides for pockets 1824 containing electronics 1826 and other components, in (eccentric) bearing housing 1822. This is an improvement over the current art as it allows placement of electronics, sensors, batteries, chemical sources, extendable pads and other such components within around 8 to 18 inches, possibly closer, to the terminal cutting structures of drill bit portion 1801 of integral drill bit/drive shaft 1802. In addition to positioning components closer to the cutting structure, the components are located in a section of drill string 1800 that does not rotate with bit 1801 making for better connectivity as compared to current art that limits placement of sensors and electronics to locations above the motor bearings, above the entire motor or in locations connected to and rotating with the drill bit. With electronics or other components not rotating with the bit, connectivity to other electronics, sensor and power sources is in the drill string is greatly simplified compared to the current art that generally requires sensors and electronics positioned close to and rotating with the drill bit to provide their own power and communications through or around the motor. In situ power requires the assembly to lengthen and electronic communications through or around the motor is generally complex, expensive (cost and power) and often comes with significant communications bandwidth limitations. Utilizing a conventional drill bit and drive shaft in lieu of the integrated drill bit/drive shaft 1802 with an eccentric mud motor bearing housing 1822, as frequently discussed above, would also be a significant improvement but comes with some length penalty, perhaps doubling the distance to the bit cutting structure as detailed in FIGS. 3A and 3B.

As described herein, the numerous DLP systems and DLC systems provide pads or cutters on the drill bit associated with the drill string. Locating the DLP or DLC on the drill bit in certain embodiments provides the structures as close to the cutting structures on the drill bit as possible, which provides certain advantages, some of which are explained herein. Drilling strings may be provided consistent with the technology described herein with DLP systems and DLC systems mounted removed from the drill bit but placed on the housing of the drill string below the power section 20 (see FIG. 1). For example, in certain embodiments, a DLP system may be provided on the drill bit and a complementary DLP system may be provided on the transmission housing 36 (see FIG. 1). Similarly, a DLP system may be provided on the bearing housing 42 (see FIG. 1) and a DLC system may be provided on the transmission housing 36 (see FIG. 1). Thus, depending on the drilling conditions and rock formation, the DLPs and DLCs described herein may be located on the drill bit, the drill string housing below the power section, or a combination thereof.

FIG. 10B provides a side view 1000 of the distal end of an exemplary Dual Rotating Cutting Structure (DRCS) drilling system. FIG. 10C provides cross sectional view 1092 of the exemplary Dual Rotating Cutting Structure (DRCS) drilling system provided in FIG. 10B. Dual rotating cutting structure systems may be referred to as the DRCS system or dual rotating cutting structure herein. FIG. 10A provides partial section views of two exemplary embodiments of drill strings including a dual rotating cutting structure. One embodiment is a DRCS drill string with no bend ($DRCS_{no\ bend}$) 1090 and the second is a DRCS drill string with a bend ($DRCS_{w\text{-}bend}$) 1091. Both drill strings include power section 1002, transmission section 1004, bearing section 1006 with outer cutting structure portion 1030, and integral drill bit/drive shaft 1028 (reference FIG. 10C) with inner cutting structure portion 1020. While presented with integral drill bit/drive shafts, both drill strings could utilize a conventional bit and drive shaft. DRCS drill string with a bend ($DRCS_{w\text{-}bend}$) 1091 also includes bend 1008, generally at or near the junction of transmission housing 1014 and bearing housing 1016.

Referencing FIG. 10A unless otherwise noted, DRCS drill string with no bend ($DRCS_{no\ bend}$) 1090 and DRCS drill string with a bend ($DRCS_{w\text{-}bend}$) 1091 both comprise power section 1002 including motor stator housing 1012 and motor rotor 1010 that rotates inside motor stator housing 1012 when mud flows from the surface. Motor housing 1012 is rigidly coupled to the drill string above (not shown) that extends to the surface. Transmission section 1004 includes transmission housing 1014 and transmission driveline 1018 that rotates inside of transmission housing 1014. The distal end of motor housing 1012 is rigidly coupled to transmission housing 1014 with transmission driveline 1018 rigidly connected to the distal end of motor rotor 1010. Bearing section 1006 includes bearing housing 1016 with outer cutting structure portion 1030, a bearing assembly (not shown), drive shaft cap 1047 (partially shown) and integral drill bit/drive shaft 1020 (reference FIG. 10C). Bearing housing 1016 is rigidly connected to the distal end of transmission housing 1014. Integral drill bit/drive shaft 1020 is rotatably coupled to bearing housing 1016 through the bearing assembly (not shown) and is rigidly connected to the distal end of transmission driveline 1018 through drive shaft cap 1047. Outer cutting structure portion 1030 of bearing housing 1016 is essentially hollow (reference FIG. 10C) to allow integral drill bit/drive shaft 1028, potentially including inner cutting structure portion 1020, to rotate within and with respect to the outer cutting structure portion 1030. As explained above, the drill string located the power section 1002 is rigidly coupled to outer cutting structure portion 1030 of bearing housing 1016 through motor stator housing 1012 and transmission housing 1014, and it should now be clear outer cutting structure 1030 rotates with the drill string.

Again referencing FIG. 10A and starting at power section 1002; motor rotor 1010 (absent rotor catch 18 shown in FIG. 1) is essentially not connected at proximal end 1048 but the distal end of the rotor is rigidly coupled to transmission driveline 1018. The distal end of transmission driveline 1018 is rigidly coupled to integral drill bit/drive shaft (reference FIG. 10C) that includes inner cutting structure 1020 terminating at distal end 1046 of drill strings 1090 and 1091.

With reference to FIG. 10B, an expanded side view of dual rotating cutting structure system 1000 used with DRCS drill string with no bend ($DRCS_{no\ bend}$) 1090 and DRCS drill string with a bend ($DRCS_{w\text{-}bend}$) 1091 is provided showing inner cutting structure 1020 including blades 1021 containing cutters 1022, interrupted gauge pad 1024 and junk slots 1026 rotating inside of the outer cutting structure as shown by arrows $R_1$. Also shown in FIG. 10B, is outer cutting structure 1030 including blades 1031 containing cutters 1032, interrupted gauge pad 1034, junk slots 1036 and interrupted follow guide 1038 that rigidly connects to bearing housing 1016 (and the drill string above) rotating with the drill string above as shown by arrow $R_O$ As will be explained further below, dual rotating cutting structure system 1000 may be useable as a straight hole drilling assembly or as part of a directional drilling assembly. By way of background, a cutting structure of a drill bit generally creates the wellbore size desired as the wellbore extends into the formation, which may comprise rock and other mineral layers. The DRCS system provides at least two, essentially independent, cutting structures/cutter sets that operate concurrently to create one wellbore. The two cutting structures generally operate at differing rotation rates to most effectively drill the wellbore. Generally, DRCS 1000 system includes an inner cutting structure 1020 and an outer cutting structure 1030. In certain embodiments, for example, inner cutting structure 1020 will rotate at a higher rate of rotation than outer cutting structure 1030. In other embodiments, for example by reversing the pitch angle of rotor 1010 and motor housing/stator 1012, inner cutting structure 1020 will rotate at a lower rotation rate than outer cutting structure 1030. In a further embodiment inner cutting structure 1020 and outer cutting structure 1030 can rotate in opposite directions for example by again reversing the pitch angle on rotor 1010 and motor housing/stator 1012 and operating mud motor 1002 at a rotation rate greater than the rotation rate of the drill string. In a further embodiment, inner cutting structure 1020 and outer cutting structure 1030 can be made to rotate at essentially the same rotation rate for example by rotationally locking the two cutting structures while bypassing flow around the rotor or not.

One unique feature of the technology of the present application with respect to DRCS system 1000 is the inner cutting structure 1020 and the outer cutting structure 1030 may include multiple types of cutters. As described above, cutting structures may take many forms, such as, for example, polycrystalline diamond cutters (PDC), roller cones (RC), impregnated cutters, natural diamond cutters (NDC), thermally stable polycrystalline cutters (TSP), carbide blades/picks, hammer bit (a.k.a. percussion bits), etc. or a combination thereof. DRCS system 1000 may have a conventional drill bit that is, for example, a roller cone, and an outer cutting structure that is a natural diamond cutter. Other combinations are possible as well such as having identical drill cutting structures for the inner and outer cutting structures. The inner or outer cutting structures may mix different rock destroying mechanisms such as an inner cutting structure with PDC and impregnated diamond or an outer cutting structure with natural diamond and roller cones or any combinations of the aforementioned rock destruction mechanisms.

Also unique to DRCS system 1000 is the use of a drilling mud motor that has the inner bit/cutting structure integrated monolithically with the mud motor drive shaft. This configuration provides for a shorter drilling assembly that is desirable for many reasons. For example, the farther a drill bit face/cutting structure is located from the supporting radial bearings in or below the mud motor, the greater the moment force. This greater force leads to earlier bearing wear, which leads to reduced drill bit stabilization and accelerated wear or damage to the drill bit/cutting structure. Another benefit of the integrated drill bit/drive shaft is better rigidity of the drill bit/cutting structure and higher torque transmitting capacity than conventional mud motor/drill bit connections that are typically 2⅜" thru 7⅝" regular API connections.

Another unique feature with DRCS system 1000 is the ability to use a (¼ to 5 degrees) bent housing in DRCS drill string with bend 1091 (FIG. 10A) to create an off-axis rotation of both inner 1020 and outer 1030 cutting structures. This off-axis rotation creates a variable pivoting pattern at the cutting structure/rock engagements. In a drilling assembly without a bent housing such as DRCS drill string with no bend 1090 (FIG. 10A) and conventional motor drill string 300 (FIG. 3A), the low rotational surface speed of inner most cutters 1022 create drilling inefficiencies that limit the performance of the drilling system. Cutter rotational surface speed when under pure rotation (that is no lateral motion) as can happen without a bend, is defined by the relationship: cutter rotation surface speed is equal to the RPM*2πr where RPM is the rotational speed and r is the radius or distance of the subject cutter from the axis of rotation. As r approaches zero, the cutter rotation surface speed approaches 0. Bent housing element 1008 reduces conventional inefficiencies by introducing enhanced multi axis motion at center cutters 1008 (generally PDC) to better fail the rock in the center of the wellbore. The enhanced multi axis motion effectively removes the center cutter inefficiencies allowing for improved drilling efficiency of the entire system. This feature also improves the life of the PDC cutters Another important aspect of DRCS system 1000 is the ability to use some components of conventional steerable system 10 (reference FIG. 1) in combination with the described improvements for DRCS system 1000. Generally, the motor is selected to generate sufficient torque to rotate and power all of the cutting structures (conventionally the drill bit). For example, for an 8¾" bit, the likely choice would be a 6" OD range mud motor. With DRCS system 1000, the mud motor power is only required to rotate the generally smaller diameter inner bit/cutting structure 1020 as outer cutting structure 1030 is rotated by drill string rotation. In this embodiment, much less power should be required and a smaller OD, shorter length and/or higher speed power section could suffice. As examples, a 6" OD range mud motor but with a shorter power section or a smaller OD power section. The benefit derived could be a shortened power section or additional space (adjacent, radial or axial) around or just above the power section is now available for placing a variety of measurement sensors and power sources more convenient to the drill bit or cutting structures. This closer proximity can provide better and more accurate data to make decisions related to the drilling efficiency, safety of the drilling operation and cost of the well. Another potential advantage of extracting less power from the drilling fluid is that more hydraulic power is now available to increase bit HSI (horsepower per square inch) for better hole cleaning. Based upon the above teaching, one ordinarily skilled in the art could easily see that DRCS system 1000 in this embodiment cannot create the active directional change made possible by certain features of conventional steerable system 10.

FIG. 10C shows an exemplary embodiment of dual rotating cutting structure system 1000 where inner cutting structure 1020 extends below the distal end of outer cutter structure 1030, contacting the formation to be drilled first and supported by axial bearings 1040 and radial bearings 1042. Outer cutting structure 1030 would then increase the wellbore diameter to the desired size as it removes undrilled formation above inner bit or inner cutting structure 1020. As shown in FIG. 10A and FIG. 10B, a unique feature of outer cutting structure 1030 is follow-guide 1038 designed to enter hole just drilled by inner bit 1020 and provide radial stabilization for outer cutting structure 1030 to enlarge the uncut portion of the wellbore. This follow-guide 1038 can be made with junk slots 1036, similar to a PDC drill bit or it can be made as a ring (not shown) that provides 360-degree wellbore contact with orifices and/or nozzles to allow cuttings and return fluid flow. The distal end of follow-guide 1038 may be angled or tapered to assure smooth entry into the pilot hole cut earlier by inner cutting structure 1020 and provides stability for outer cutting structure 1030 reducing the chances of PDC cutter impact damage for outer cutters 1032. In a tapered embodiment of the follow-guide (not shown), the proximal end of the taper may be extended slightly to a greater diameter than the above-mentioned pilot hole and contain cutting elements. This allows the follow-guide to radially centralize and axially stabilize as outer cutting structure 1030 drills the uncut portion of the hole. Another benefit of follow-guide 1038 is reduced loading on radial bearing 1042 thus extending bit and motor life and effectiveness. As shown in FIG. 10C, inner cutting structure 1020 can extend below outer cutting structure 1030, inner cutting structure 1020 can be substantially flush with outer cutting structure 1030 as shown in FIG. 11, or inner cutting structure 1020 can be retracted relative to outer cutting structure 1030 as shown in FIG. 12.

Figure 19A:
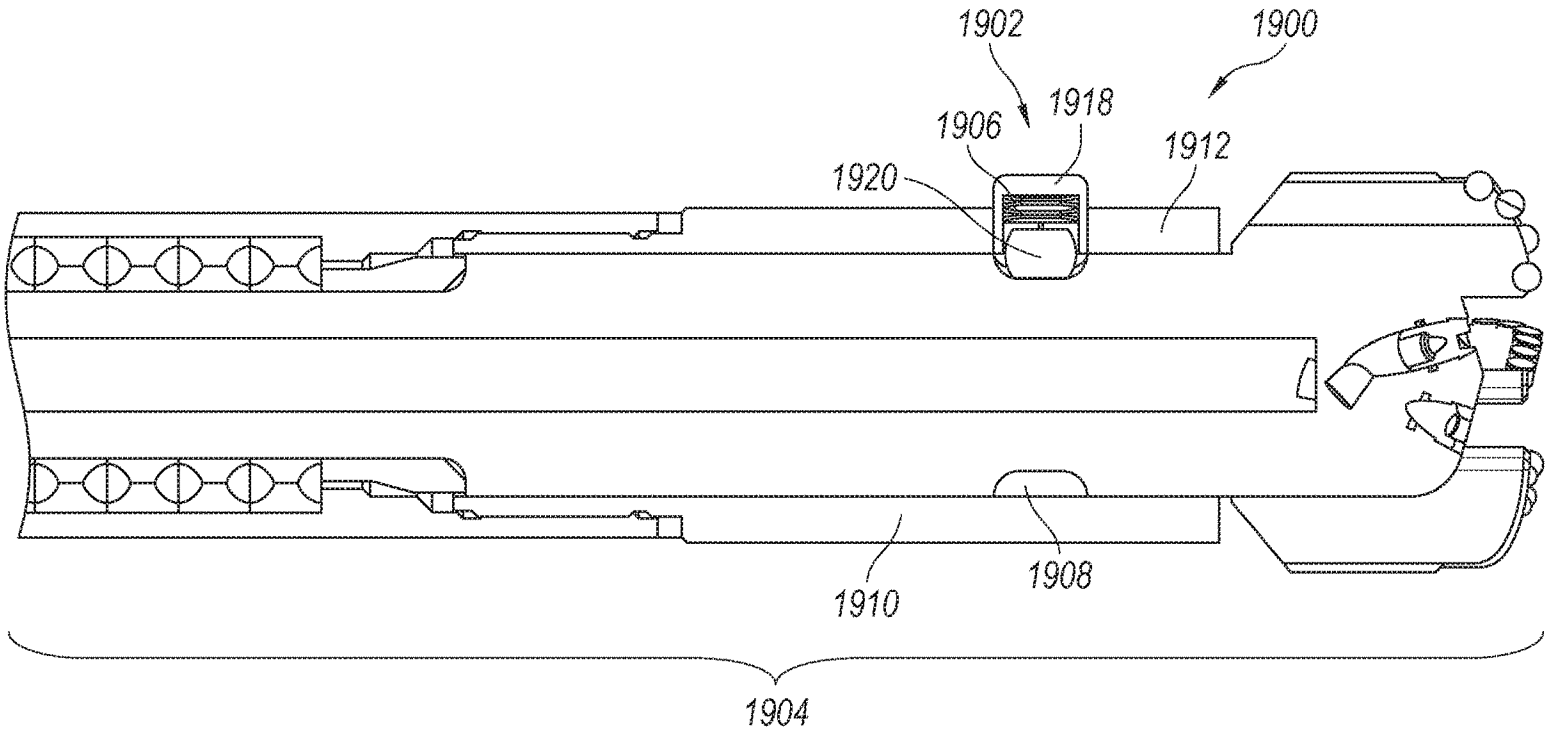
Figure 19B:
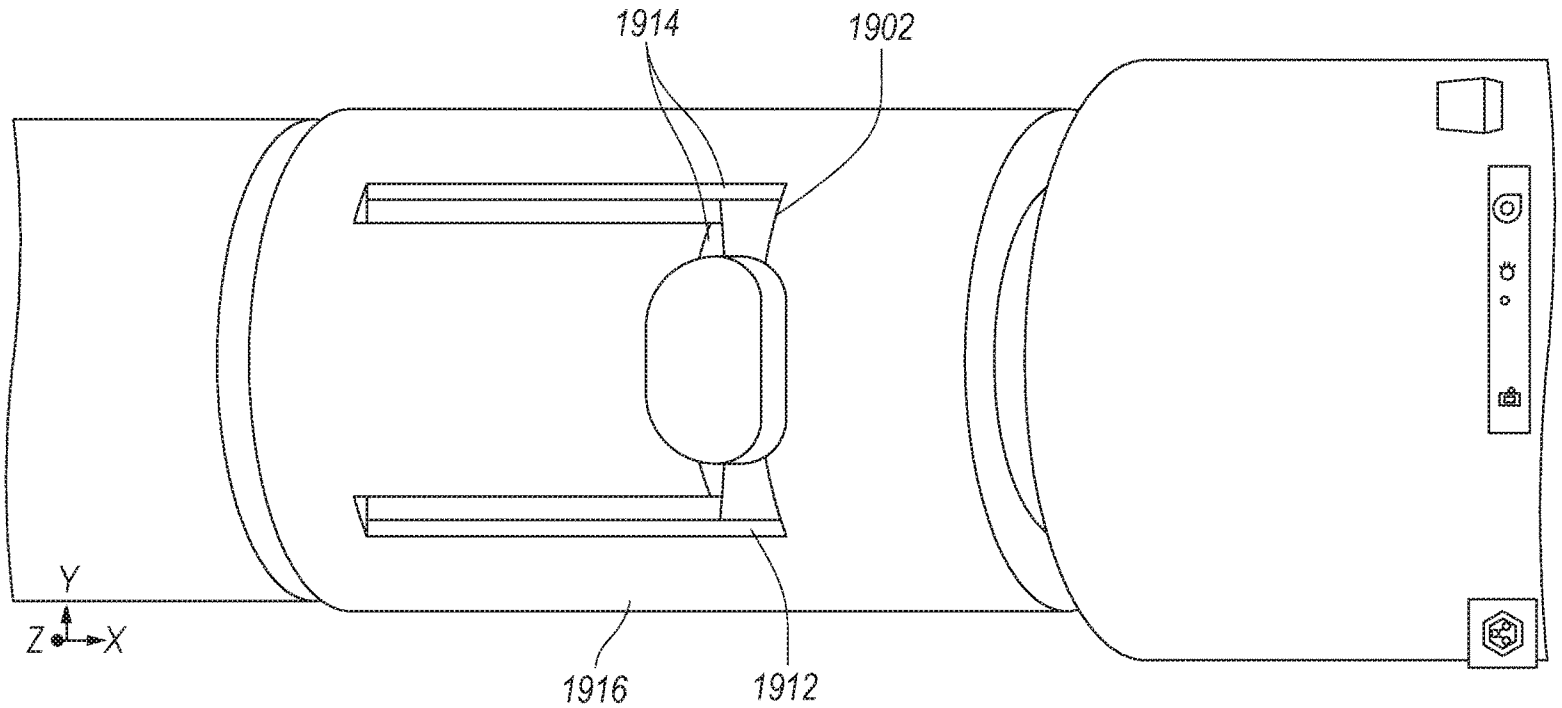

FIG. 19A is a cross sectional view of a non-limiting, exemplary embodiment is of a dynamic lateral pad system 1900 with one moveable pad 1902. The illustration shows a cut away view of an integral drill bit and drive shaft 1904 and a moveable pad 1902 acted upon by a cam following mechanism 1906, some of which have been described herein before. During slide mode drilling, the moveable pad 1902 will extend and retract based on the cam following mechanism 1906 and the cam race 1908 geometry. When the moveable pad 1902 is in the extended position, the exterior surface engages the sidewall of the wellbore creating a directional bias. When the moveable pad 1902 is in the retracted position, the moveable pad 1902 is generally flush with the housing 1910, although in certain embodiments it may extrude slightly and/or be recessed. The integral drill bit and drive shaft 1904 rotates relative to the generally non-rotating drill string housing 1910 during steering of the of device. The integral drive shaft and drill bit 1904 has a continuous circumferential cam race 1908 with variable radial depth. On the outer housing of the bottom hole assembly, at least one recess 1912 is formed in the housing 1910 for the moveable pad 1902 to extend and retract. As shown in FIG. 19B, the moveable pad 1902 as shown in the illustration has two opposing locking tabs 1914 to retain the moveable pad 1902 within the recess 1912. In certain embodiments, exterior plates 1916 are attached with bolts (not specifically shown) or similar method over top of the tabs to retain the moveable pad 1902 operatively in the recess while allowing the pad to freely extend and retract within a given range of travel. The moveable pad 1902 may be hollow to accommodate an elastic member 1918 (FIG. 19A), such as, a coned-disc spring stack as shown, which is commonly referred to as a Belleville spring. The moveable pad 1902, optionally, has a hole or bore to allow fluid communication between the outer housing and the inner housing primarily to provide flush cooling and to help lubricate the surface between the moveable pad and a cam follower cup 1920. The coned-disc spring stack serves multiple functions. One exemplary function may be to provide compliance to varying wellbore internal diameters. Another exemplary function may be to provide shock load dampening. Another exemplary function may be to provide a calibrated maximum force on the moveable pad 1902. Another exemplary function may be to act as a failsafe allowing the moveable pad 1902 to revert to a retracted safe condition in the event of an unexpected interference fit with the borehole thus protecting the mechanism. Any given embodiment may include some, all, none, or other of these functional example. An optional gasket (not specifically shown) can be positioned in a groove of the inner diameter of the recess 1912 to centralize the moveable pad 1902 and mitigate fluid flow between the recess 1912 and the moveable pad 1902. Underneath the coned-disc spring stack is the cam follower cup 1920 (FIG. 19A). The cone follower cup has a mating surface to operatively transfer force from the cam follower to the moveable pad. The cam follower cup 1920 can be a roller ball, tapered roller, cylinder roller, sliding pad or similar cam following system. It should be noted that the cam race 1908 has an extended width to accommodate axial displacement due to potential wear from the ball bearing thrust stack typical in most bottom hole assemblies. It should also be noted that it is possible to have any variety of cam profiles, ramp build and decay rates or timing schemes formed on the cam race. Unique to this configuration is that as the pad is extended, the tabs act to provide a counter force to retract the pads back into the housing as the cam follower force is relieved. It can be appreciated that more than one pad may be used. It can also be appreciated that pads may be arranged in any variety of positions both radially and colinearly to create different biasing, steering and timing options, some of which are exemplified herein. It can also be appreciated that a box pin connection configuration to attach the bit may also be used for this embodiment.

Figure 19C:
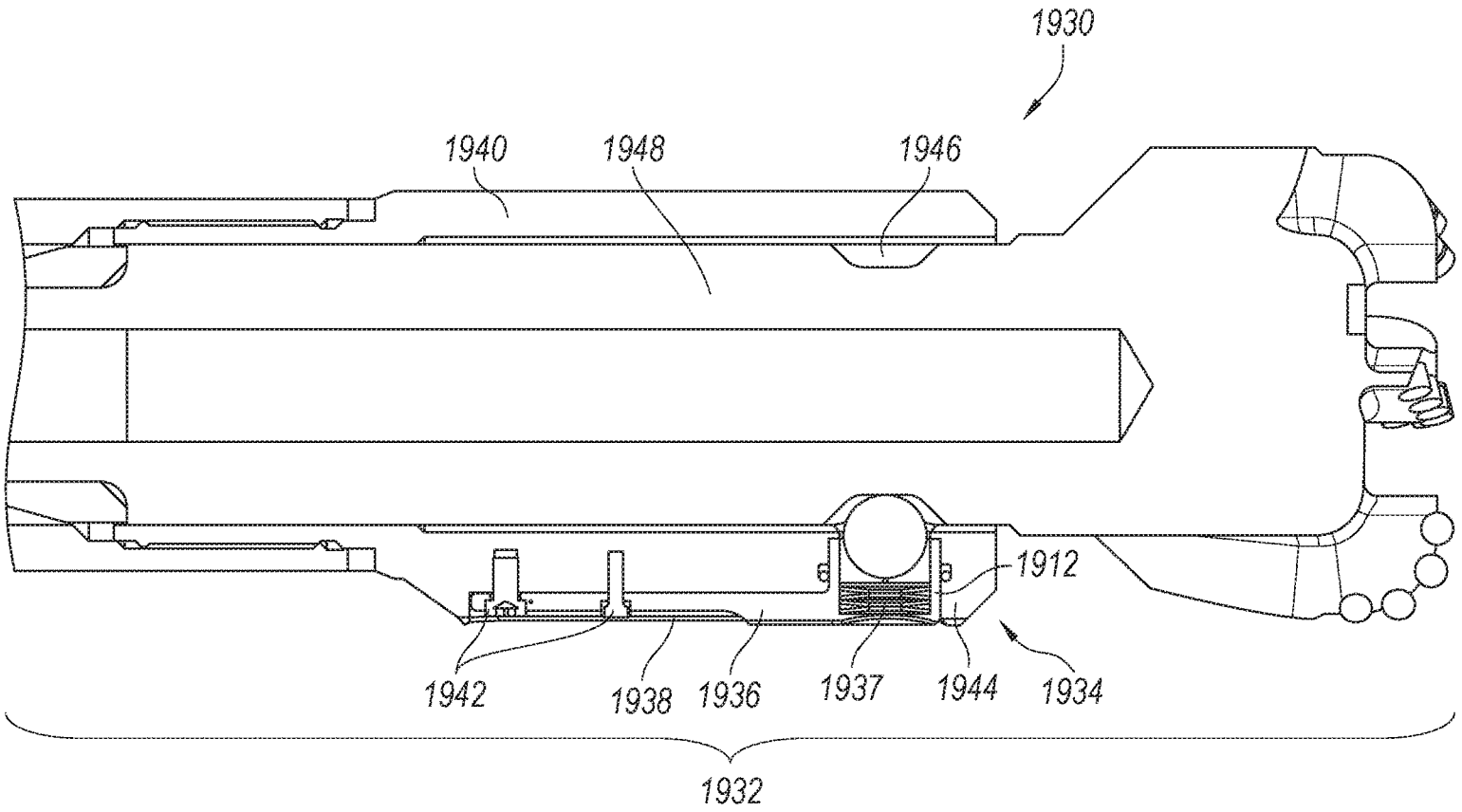
Figure 19D:
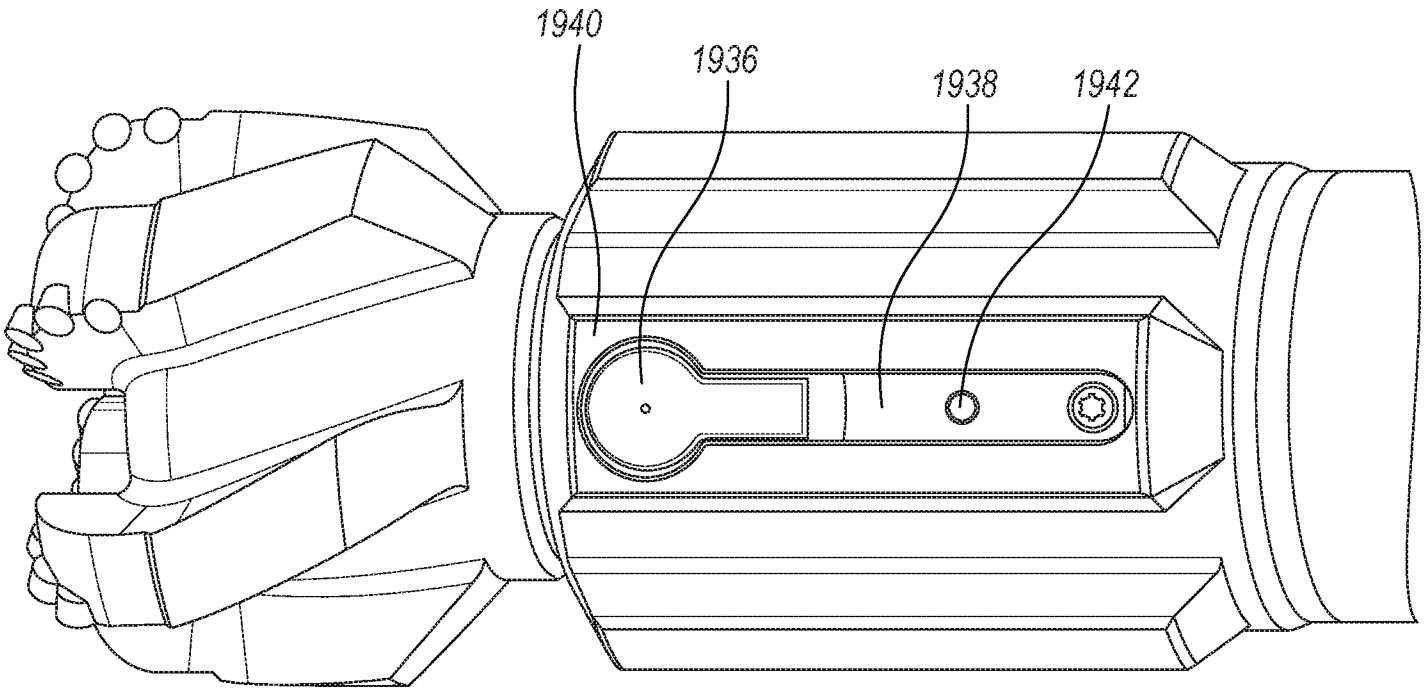

With reference now to FIGS. 19C and 19D, a non-limiting, exemplary embodiment 1930 to the embodiment 1900 is provided. The non-limiting, exemplary embodiment 1930 uses an integral drill bit and drive shaft 1932 and a cam following mechanism 1934 acting upon a moveable pad 1936 allowing it to extend and retract within a recess 1912. This design demonstrates an alternative moveable pad 1936 assembly. The generally cylindrical moveable pad 1936 assembly uses an integral cantilever shaft 1938, which is attached to the housing 1940. The cantilever shaft is secured to the housing using bolts 1942 or similar attachment means. The cantilever shaft 1938 operatively provides a retraction force on the pad to return it back into the recess 1912. A gasket 1944, such as an O-ring, is seated in an inner diameter groove of the cylinder to circumferentially support the cantilever arc path of the pad as well as mitigate fluid flow in the recess 1912 channel between the moveable pad 1936 and cylinder. The moveable pad 1936 may include a hole 1937 allowing fluid communication between the outer and the inner housing primarily to provide flush cooling and to help lubricate the surface between a ball 1946 and the cam follower cup 1948. It can be appreciated that the pad mechanism can be positioned in other orientations, such as 180 degrees on the housing from what is illustrated, such that the attachment of the cantilever shaft can be toward the cutting structure. It can also be appreciated that more than one cam following pad can be mounted on the housing. It can also be appreciated that multiple pads can be placed in different radial positions and with the option of different timing schemes. It can also be appreciated that a box pin connection configuration to attach the bit could also be used for this embodiment.

Figure 19E:
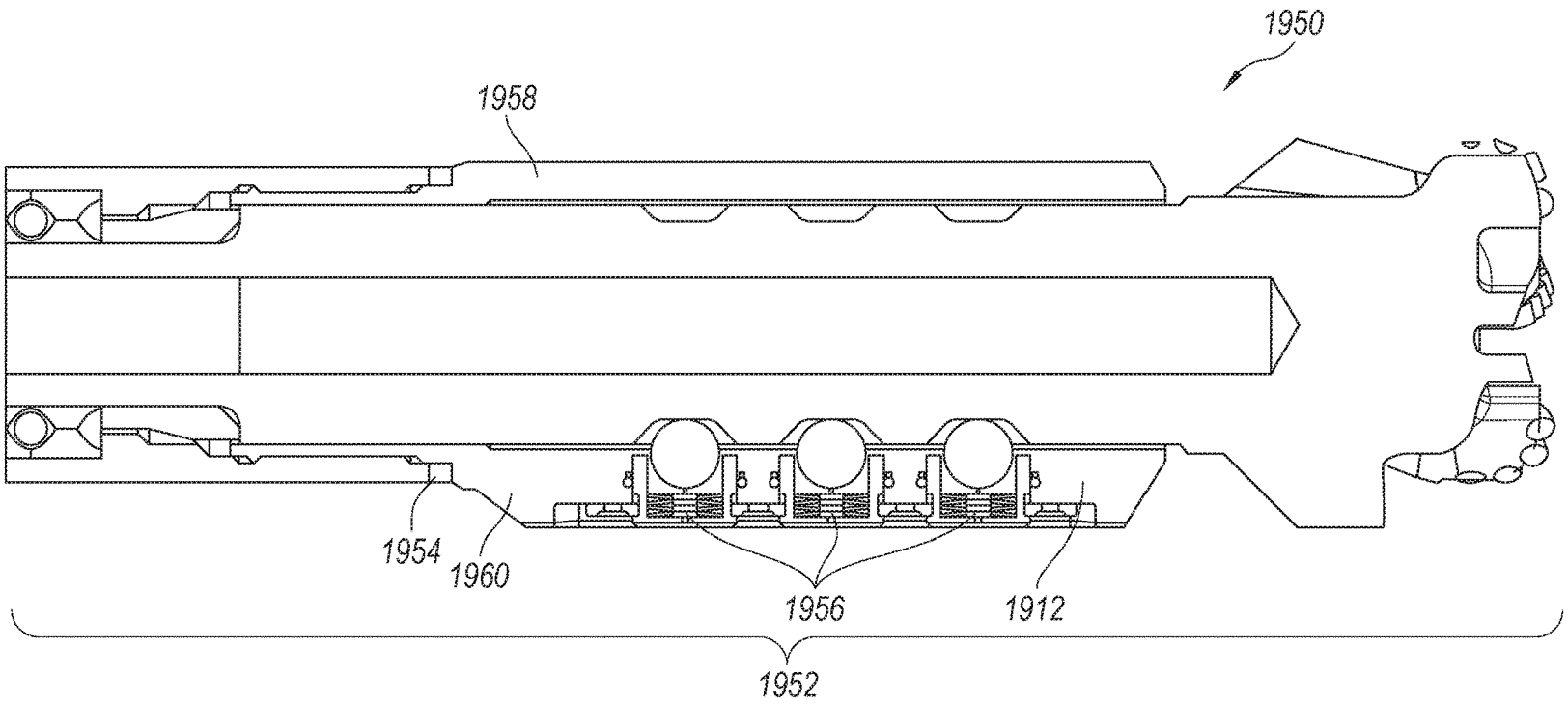
Figure 19F:
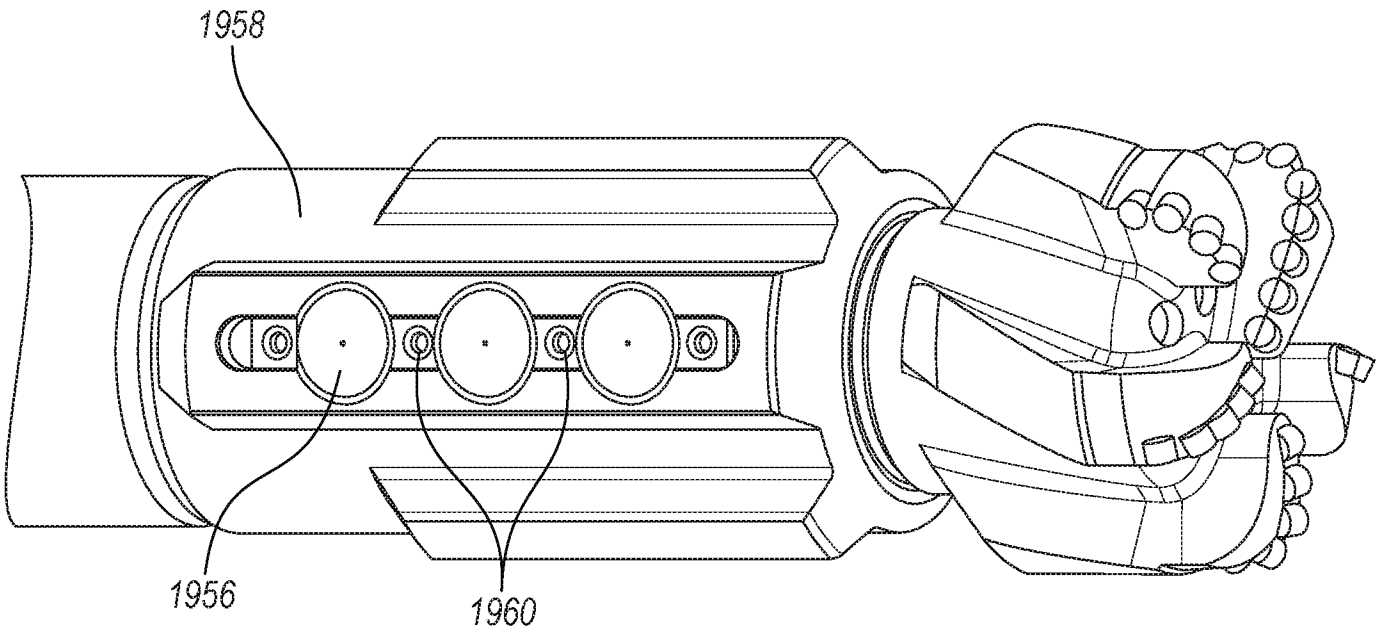

FIGS. 19E and 19F show a DLP system 1950, which is similar to the above in certain aspect. In particular, the DLP system 1950 uses an integral drill bit and drive shaft 1952, and a cam following mechanism 1954 acting upon a plurality of moveable pads 1956, in this exemplary embodiment, allowing them to extend and retract within corresponding recesses 1912. The DLP system 1950 provides three moveable pads 1956 collinearly positioned on the housing 1958. Each of the moveable pads 1956 is partitioned with two outer diameters such that an exterior locking retention plate 1960 on each side will restrict the moveable pads 1956 from over extending. Depending on the space between pads, and other design factors, one exterior locking plate 1960 could be used to lock two pads or more pads. In some embodiments, each moveable pad 1956 would have one or more locking plates 1960. The locking plate 1960 could also be a ring or other locking structure surrounding each pad. As described in the previous embodiment, each pad may use a fluid communication hole between the outer housing and the inner housing primarily to provide flush cooling and to help lubricate the surface between the ball and the cam follower cup 1954. This embodiment allows for the advantageous rotation of the pads. Active rotation could be induced using a modified cam race profile creating a bias to spin the cam follower, spring, and pad. Alternatively, pad rotation can be induced via various contoured patterns of grooves or channels on the pad face. Consistent with previous cam race descriptions, it is possible to have multiple undulations as well as differing thickness and slopes. It can also be appreciated that any number of timing patterns between pads as well as ramp build and decay rates for each pad can be configured depending on the drilling application. It can also be appreciated that a box pin connection configuration to attach the bit could also be used for this embodiment.

Figure 19G:
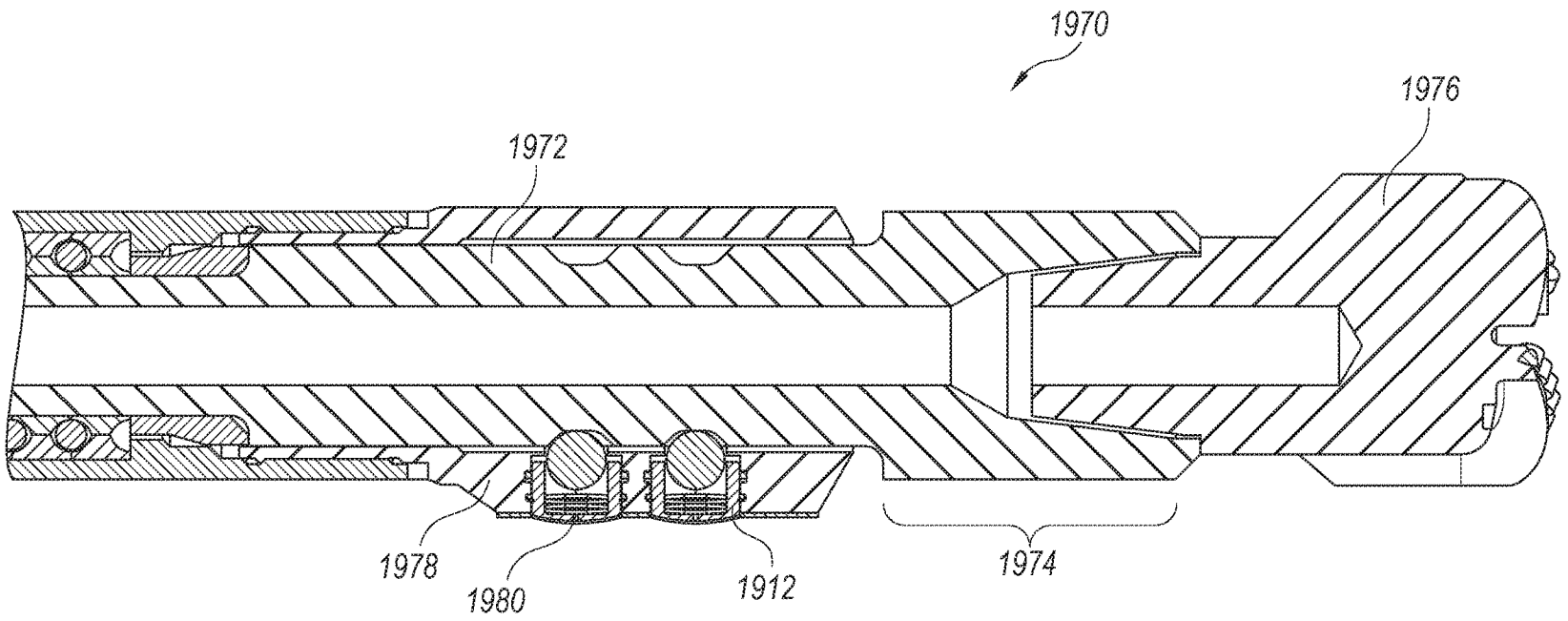
Figure 19H:
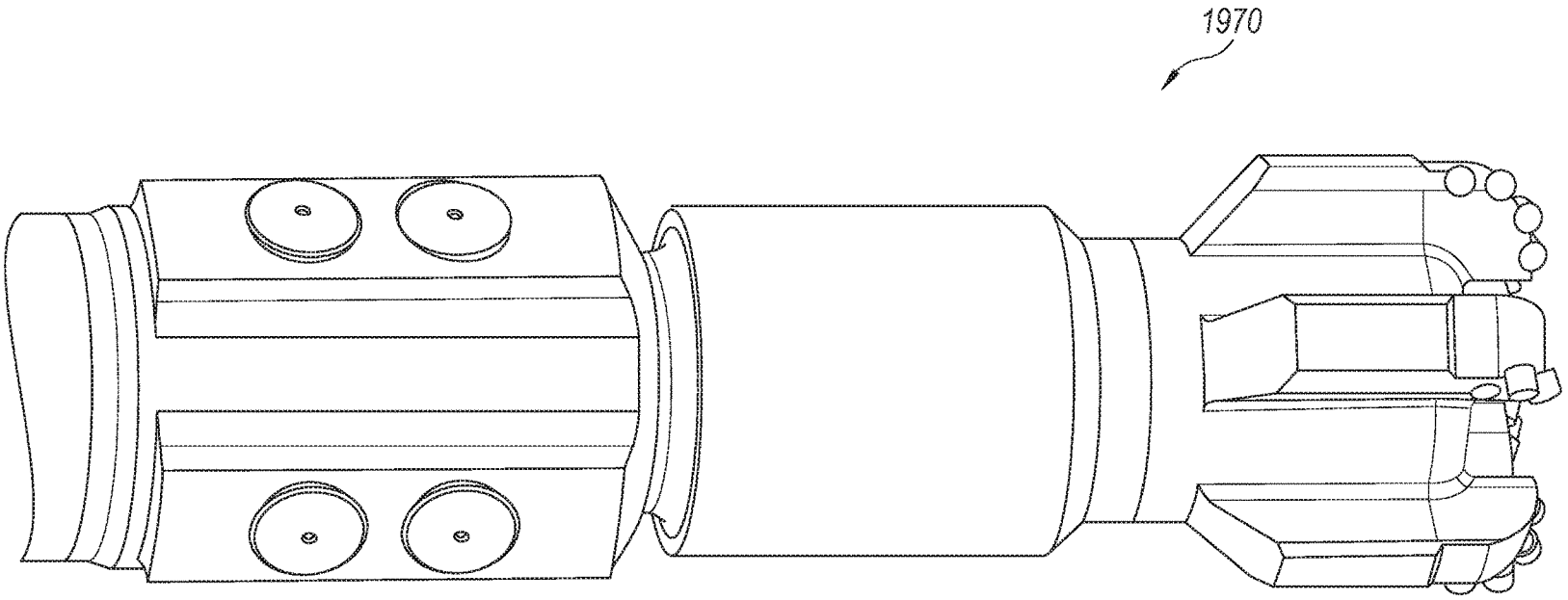

FIGS. 19G and H provide an exemplary DLP system 1970 a mandrel 1972 with a box pin connection 1974 to attach a drill bit 1976 and a cam following mechanism 1978 acting upon a plurality of cylindrical, movable pads 1980 allowing it to extend and retract within a recess 1912. In this configuration, two moveable pads 1980 are collinearly positioned in two different radial locations on the housing. As described in the previous embodiment, each individual pad 1980 will extend and retract specific to a prescribed cam profile. As described in the previous embodiment each pad can optionally rotate via a biasing cam profile pattern, contoured grooves and patterns on the pad or similar methods. It should be noted that pads can be positioned in any number of patterns on the housing. Non-limiting and non-inclusive examples are collinear rows of pads, radial patterns of pads, helix patterns, symmetric clusters, asymmetric clusters, and pads in random positions on the housing. It can also be appreciated that any variety of extension and retraction patterns can be configured. Non-limiting and non-inclusive examples are the sequential extension and retraction of a collinear group of pads, two or more pads extended with one or more retracted in a collinear group, sequential timing between pads in different radial positions and at least two pads extending or contracting at the same time in different radial positions. It should be noted that any number of custom pad extension and retraction patterns can be customized based on the drilling application and bottom hole assembly configuration. It will be appreciated that certain pad extension and retraction patterns can induce favorable vibrations to reduce drill string friction with the borehole wall, especially during build and lateral drilling. Certain pad extension and retraction patterns could induce advantageous drill string rocking to facilitate well bore cleaning and cuttings removal. It should be noted that an integral drill bit and drive shaft configuration could also be used in place of a box pin connection to attach the drill bit.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An apparatus comprising
- a drive shaft having a recess defined therein,
  - wherein a radial thickness of the recess varies between at least two thicknesses;
- a drill bit having
  - at least one cutting structure,
  - a gauge structure that defines a diameter of the drill bit, and
  - a connecting structure that directly connects the drill bit to a distal end of the drive shaft;
- a sleeve that encircles an outer perimeter of at least a portion of the drive shaft;
- a slot formed in at least one axially extending outer sidewall of the sleeve defining a volume,
  - wherein the sleeve is arranged such that the volume is radially adjacent to the recess in the drive shaft; and
- a pad sized to fit within the slot and move in the volume from a retracted position to an extended position as the radial thickness of the recess varies due to rotation of the drive shaft,
  - wherein when in the extended position, the pad has a surface that is configured to engage a sidewall of a wellbore, and
  - wherein the pad is configured to move between the retracted position and the extended position over a portion of a circumference as the drive shaft rotates about a longitudinal axis to cause a directional change in the wellbore.

2. The apparatus of claim 1 wherein the pad selectively engages the wellbore to vibrate a drill string such that static friction is reduced.

3. The apparatus of claim 1 wherein the drill bit comprises a plurality of cutting elements.

4. The apparatus of claim 3 wherein the pad in the extended position is configured to push against the sidewall of the wellbore and point the drill bit in a direction relative to a longitudinal axis of the drive shaft.

5. The apparatus of claim 4 further comprising at least one lateral cutting apparatus located on a side of the drilling apparatus opposite the pad wherein the lateral cutting apparatus is configured to contact the wellbore and remove formation at least when the pad is in the extended position.

6. The apparatus of claim 1 further comprising a cutting element coupled to the surface of the pad.

7. The apparatus of claim 1 wherein the drill bit is monolithically formed with the drive shaft that is configured to be coupled to a positive displacement motor.

8. The apparatus of claim 7 wherein the positive displacement motor is a mud motor.

9. The apparatus of claim 1 further comprising a cam follower positioned beneath the pad for contacting the recess in the drive shaft and an elastic element coupled between the cam follower and the pad.

10. The apparatus of claim 9 wherein the pad, the elastic element, and the cam follower form an assembly able to partially collapse to prevent interference between the drive shaft and the sidewall of the wellbore.

11. The apparatus of claim 9 wherein the elastic element includes a rubber pad or a spring.

12. The apparatus of claim 1 wherein the drive shaft further includes a second recess with a radial thickness that varies between at least two thicknesses, the apparatus further comprising:
- a housing between a power section and the drill bit;
- a second slot defining a second volume formed in the housing between the power section and the drill bit,
  - wherein the housing is arranged such that the second volume is radially adjacent to the second recess in the drive shaft;
- a second pad sized to fit within the second slot and move in the second volume from a retracted position to an extended position as the radial thickness of the second recess varies due to rotation of the drive shaft,
  - wherein when in the extended position, the second pad has a surface that is configured to engage the sidewall of the wellbore.

13. The apparatus of claim 12 wherein the housing is selected from the group of housing consisting of a transmission housing, a bearing housing, or a combination thereof.

14. The apparatus of claim 12 wherein the second pad comprises a cutting element coupled to the surface of the second pad.

15. The apparatus of claim 1 wherein the sleeve remains stationary while the drill bit rotates.

16. The apparatus of claim 1 wherein the cutting slot is formed in a raised section of the sleeve.

17. An apparatus comprising
- a drive shaft that includes a recess defined therein,
  - wherein a radial thickness of the recess varies between a first thickness and a second thickness;
- a drill bit having
  - a plurality of cutting structures,
  - a gauge structure that defines a diameter of the drill bit, and a connecting structure that directly connects the drill bit to a distal end of the drive shaft;

a sleeve that encircles an outer perimeter of at least a portion of the drive shaft;

a cutting slot formed in at least one axially extending outer sidewall of the sleeve defining a first volume, wherein the sleeve is arranged such that the volume is radially adjacent to the recess in the drive shaft;

a cutting pad having an outwardly facing surface sized to movably fit within the cutting slot and move in the first volume from a retracted position to an extended position as the radial thickness of the recess alternates between the first and second thicknesses due to rotation of the drive shaft;

a cutting element coupled to the outwardly facing surface such that at least when in the extended position, the cutting element is configured to engage a sidewall of a wellbore to remove formation; and an actuator operatively coupled to the cutting pad wherein the actuator causes the cutting pad to move between the extended position and the retracted position.

18. An apparatus comprising a drive shaft that includes a recess defined therein, wherein a radial thickness of the recess varies between a first thickness and a second thickness;

a drill bit that includes— a cutting structure, a gauge structure that defines a diameter of the drill bit, and a connecting structure that directly connects the drill bit to a distal end of the drive shaft;

a sleeve that encircles an outer perimeter of at least a portion of the drive shaft, wherein the sleeve includes a slot that defines a volume, and wherein the sleeve is arranged such that the volume is radially adjacent to the recess in the drive shaft; and a pad configured to move in the volume between a retracted position and an extended position as the radial thickness of the recess alternates between the first and second thicknesses due to rotation of the drive shaft, wherein the pad moves from the retracted position to the extended position over a first portion of a rotation of the drive shaft, thereby causing a surface of the pad to engage a sidewall of a wellbore, and wherein the pad moves from the extended position to the retracted position over a second portion of the rotation of the drive shaft, thereby causing the surface of the pad to disengage the sidewall of the wellbore.

19. The apparatus of claim 1 wherein the drive shaft comprises a mandrel and the recess is defined in the mandrel.

* * * * *